US012690614B2

(12) United States Patent
Lee et al.

(10) Patent No.: US 12,690,614 B2
(45) Date of Patent: Jul. 28, 2026

(54) CARTRIDGE AND AEROSOL-GENERATING DEVICE INCLUDING THE SAME

(71) Applicant: KT&G CORPORATION, Daejeon (KR)

(72) Inventors: Jongsub Lee, Sungnam-si (KR); Minkyu Kim, Seoul (KR); Jueon Park, Seoul (KR); Byungsung Cho, Gwangmyung-si (KR)

(73) Assignee: KT&G CORPORATION, Daejeon (KR)

( * ) Notice: Subject to any disclaimer, the term of this patent is extended or adjusted under 35 U.S.C. 154(b) by 391 days.

(21) Appl. No.: 18/288,869

(22) PCT Filed: May 19, 2022

(86) PCT No.: PCT/KR2022/007176
§ 371 (c)(1),
(2) Date: Oct. 30, 2023

(87) PCT Pub. No.: WO2022/245151
PCT Pub. Date: Nov. 24, 2022

(65) Prior Publication Data

US 2024/0215641 A1 Jul. 4, 2024

(30) Foreign Application Priority Data

May 20, 2021 (KR) ..... 10-2021-0064511

(51) Int. Cl.
*A24F 40/42* (2020.01)
*A24F 40/10* (2020.01)
*A24F 40/44* (2020.01)

(52) U.S. Cl.
CPC ..... *A24F 40/42* (2020.01); *A24F 40/10* (2020.01); *A24F 40/44* (2020.01)

(58) Field of Classification Search
CPC ..... A24F 40/42
See application file for complete search history.

(56) References Cited

U.S. PATENT DOCUMENTS

2020/0221776 A1 7/2020 Liu et al.
2020/0288778 A1 9/2020 Kim et al.
(Continued)

FOREIGN PATENT DOCUMENTS

CN 210726705 2/2011
CN 210158015 3/2020
(Continued)

OTHER PUBLICATIONS

PCT International Application No. PCT/KR2022/007176, International Search Report dated Sep. 6, 2022, 3 pages.
(Continued)

*Primary Examiner* — Cynthia Szewczyk
(74) *Attorney, Agent, or Firm* — LEE, HONG, DEGERMAN, KANG & WAIMEY

(57) ABSTRACT

An aerosol-generating device is disclosed. The aerosol-generating device of the disclosure includes a pipe defining an insertion space having an opening toward an outside of the cartridge; a first chamber configured to store a liquid and positioned outside of the pipe; a second chamber in communication with the insertion space; an upper frame disposed between the pipe and the second chamber and comprising a connecting hole allowing communication between the second chamber and the insertion space; a lower frame disposed below the upper frame and configured to define the second chamber together with the upper frame; a wick provided in the second chamber and configured to be in communication with the first chamber through an opening between the upper frame and the lower frame; and a heater
(Continued)

configured to heat the wick, wherein securing the pipe applies pressure to the upper frame toward the lower frame.

18 Claims, 41 Drawing Sheets

(56) References Cited

U.S. PATENT DOCUMENTS

| | | | |
|---|---|---|---|
| 2020/0345066 | A1 | 11/2020 | Kim et al. |
| 2020/0352240 | A1 | 11/2020 | Spencer et al. |
| 2020/0367574 | A1 | 11/2020 | Choi |
| 2021/0127742 | A1 | 5/2021 | Kim et al. |

FOREIGN PATENT DOCUMENTS

| | | | | |
|---|---|---|---|---|
| EP | 3725170 | | 10/2020 | |
| JP | 2020503880 | | 2/2020 | |
| KR | 10-2019-0019118 | | 2/2019 | |
| KR | 10-2019-0138458 | | 12/2019 | |
| KR | 10-2021-0043102 | | 4/2021 | |
| WO | WO-2015180370 | A1 * | 12/2015 | ..... H05B 3/16 |
| WO | 2019017654 | | 1/2019 | |
| WO | 2019081571 | | 5/2019 | |
| WO | 2020222495 | | 11/2020 | |
| WO | 2021020861 | | 2/2021 | |

OTHER PUBLICATIONS

Korean Intellectual Property Office Application No. 10-2021-0064511, Notice of Allowance dated Jul. 17, 2023, 2 pages.

Japan Patent Office Application No. 2023-570176, Office Action dated Aug. 27, 2024, 4 pages.

European Patent Office Application Serial No. 22805004.3, Search Report dated Feb. 13, 2025, 10 pages.

The State Intellectual Property Office of the People's Republic of China Application Serial No. 202280034687.3, Office Action dated Mar. 30, 2026, 8 pages.

* cited by examiner

【FIG. 1】
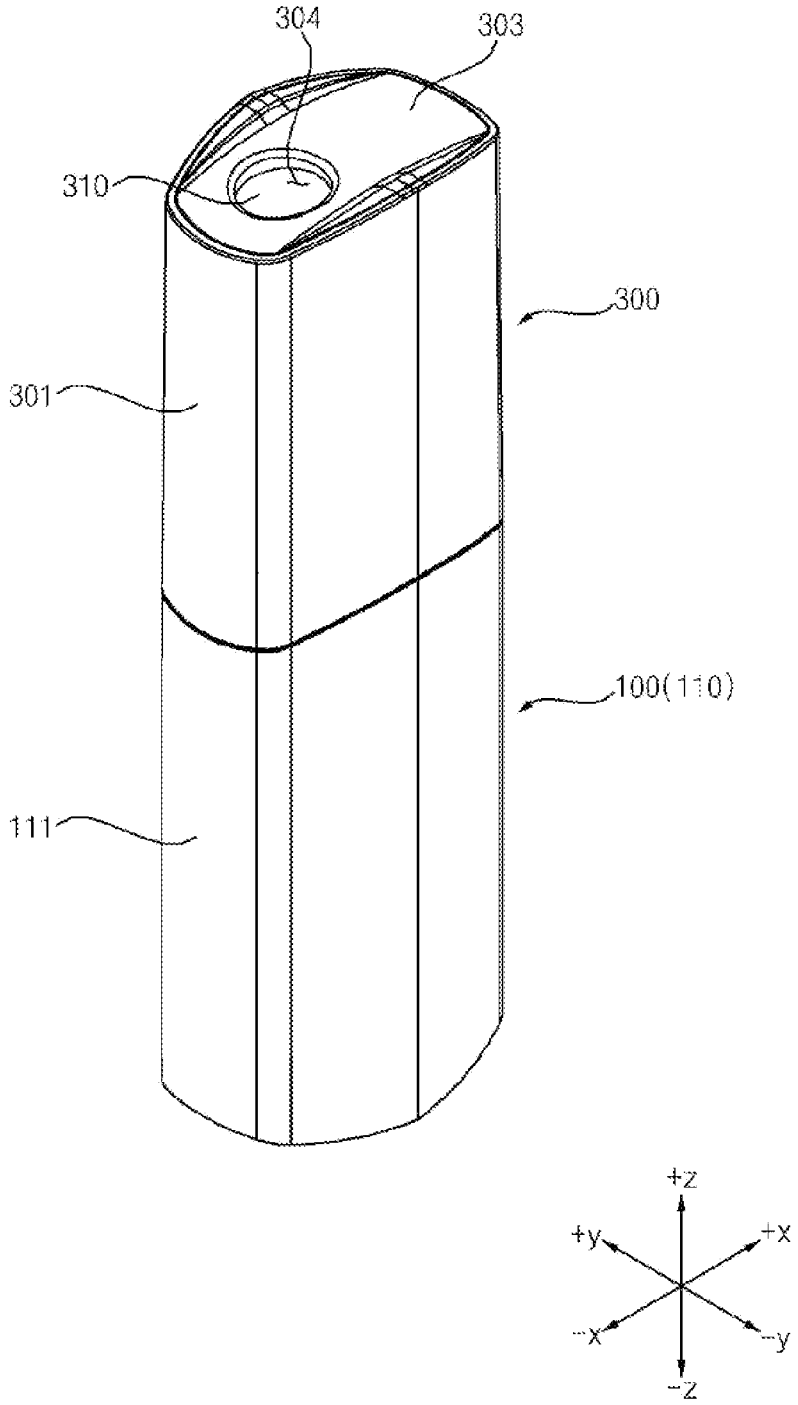

【FIG. 2】
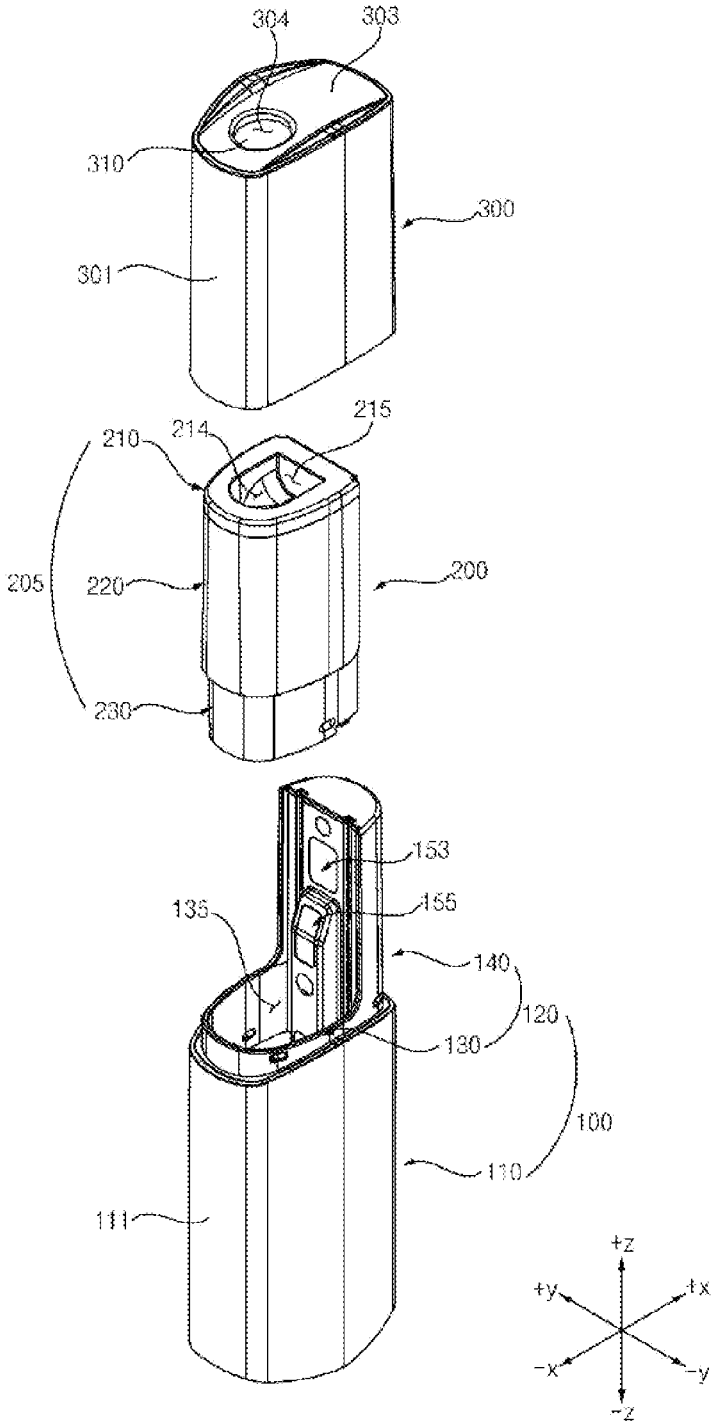

【FIG. 3】
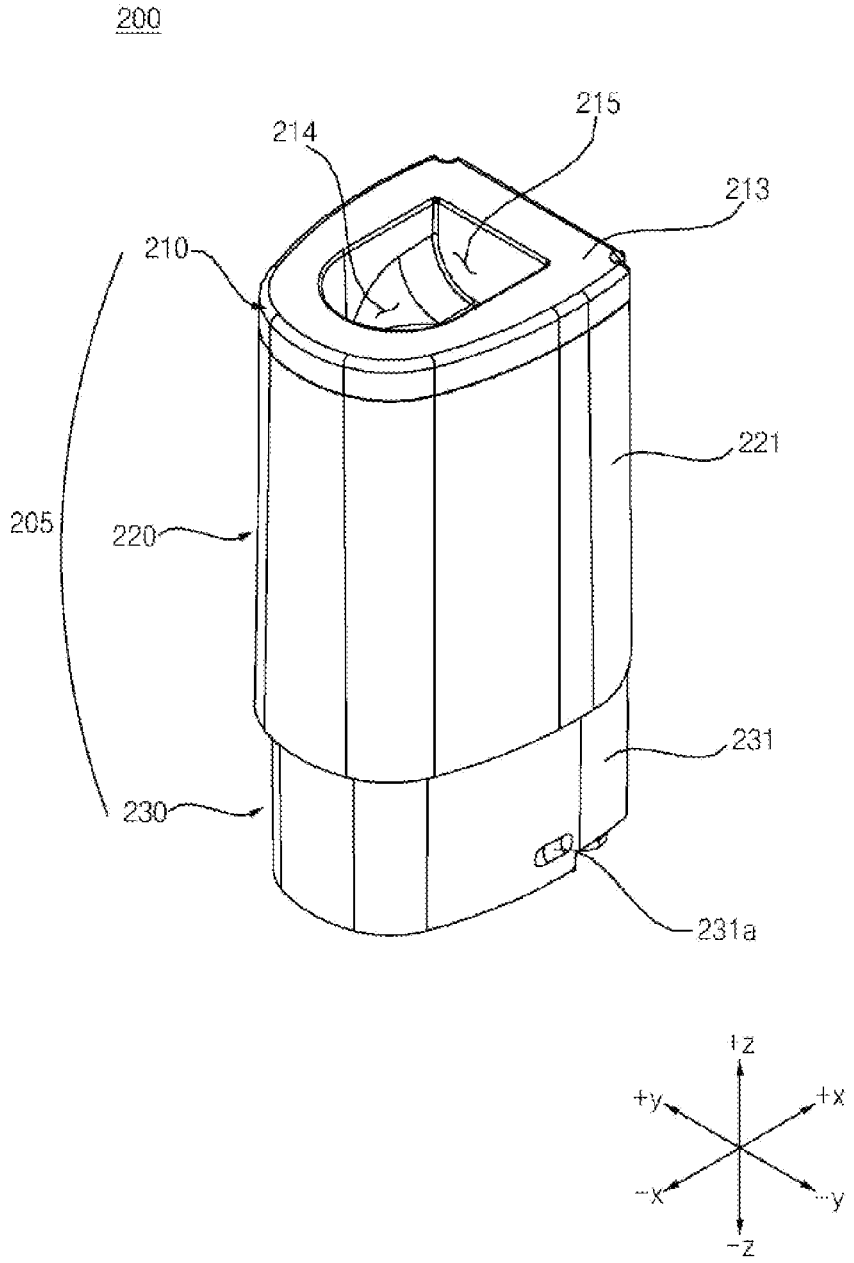

【FIG. 4】
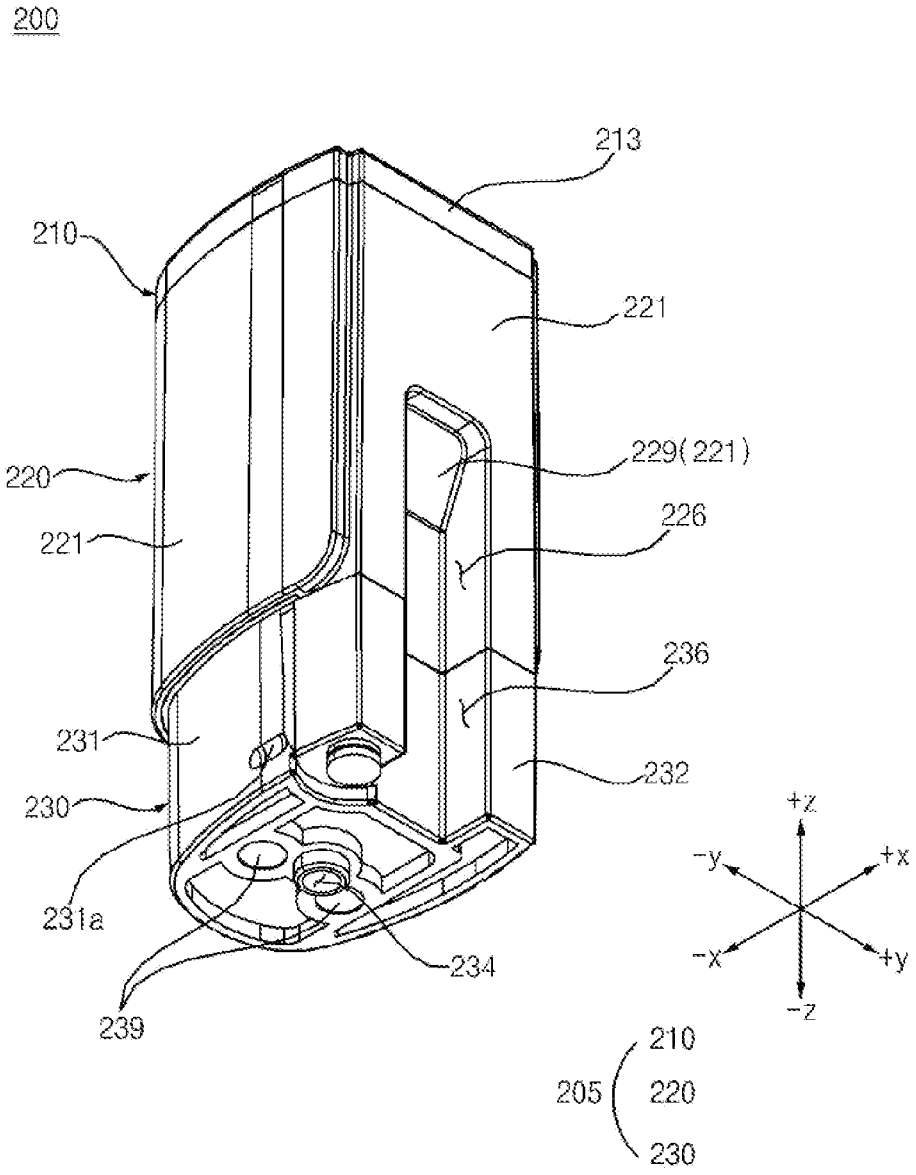

【FIG. 5】
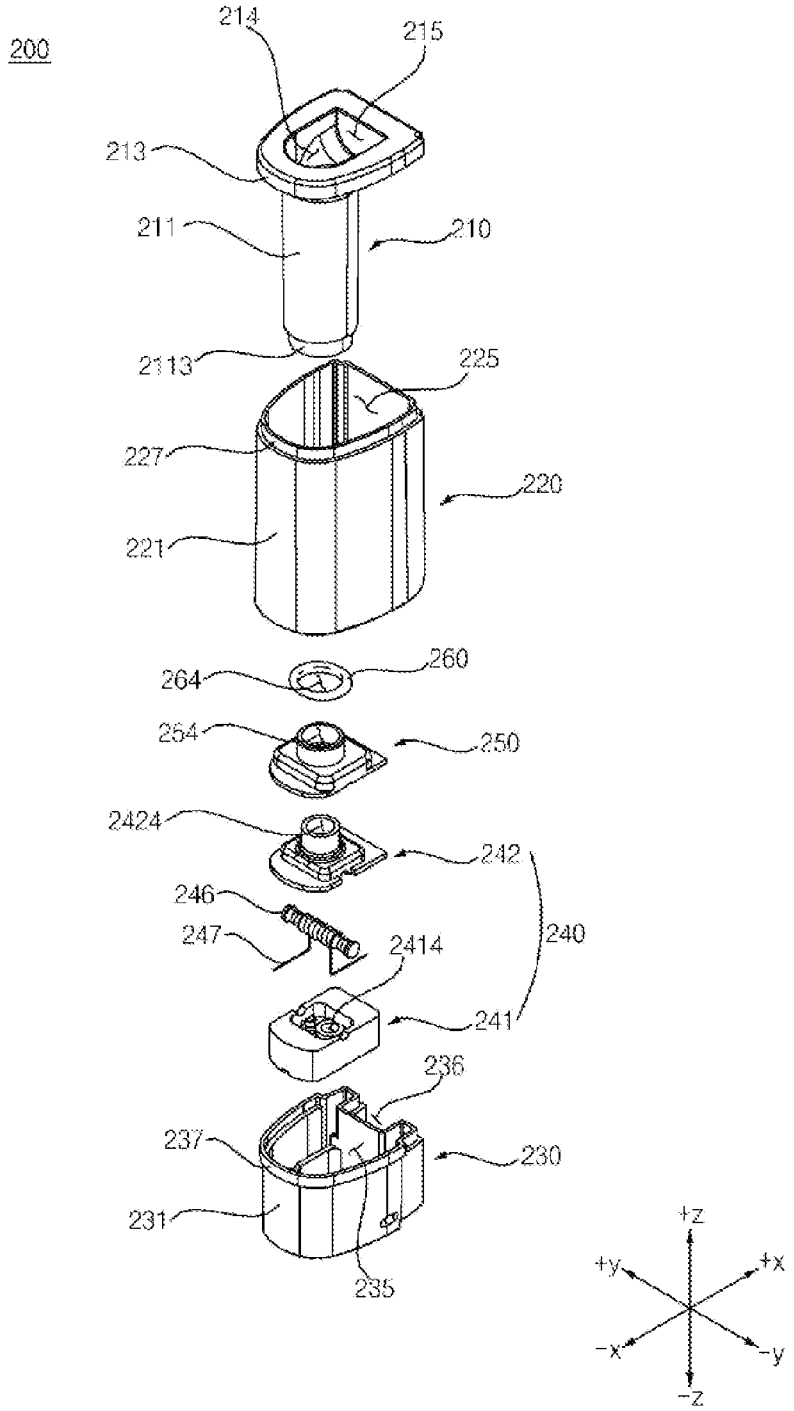

【FIG. 6】
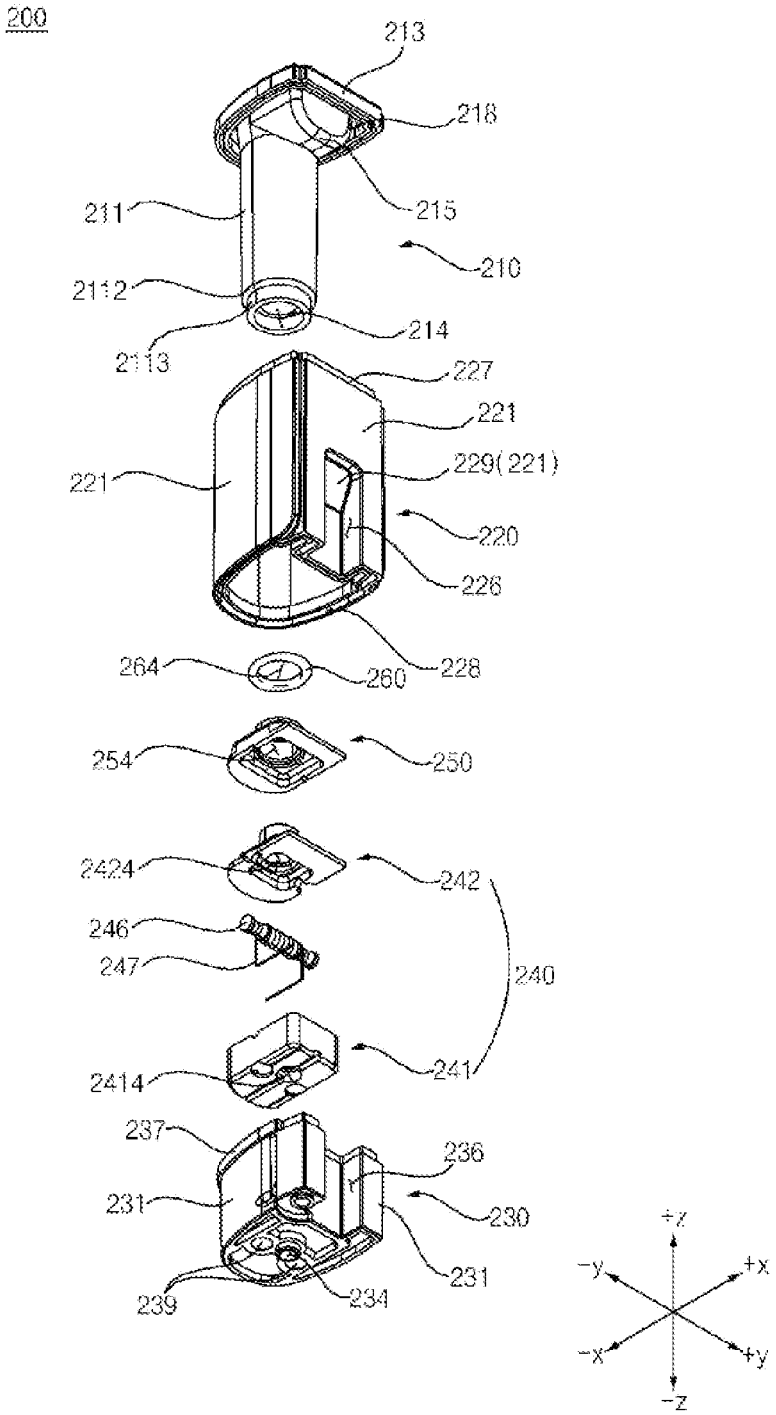

【FIG. 7】
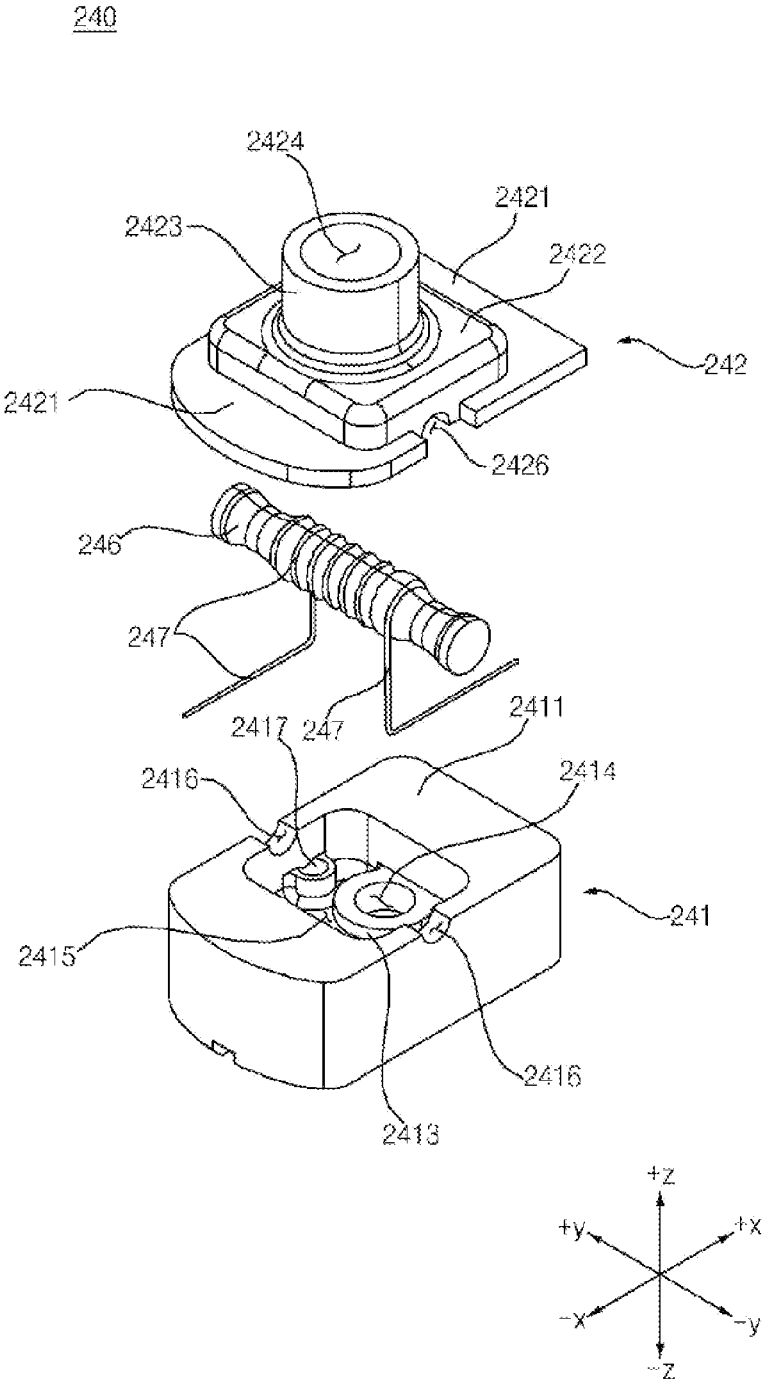

【FIG. 8】
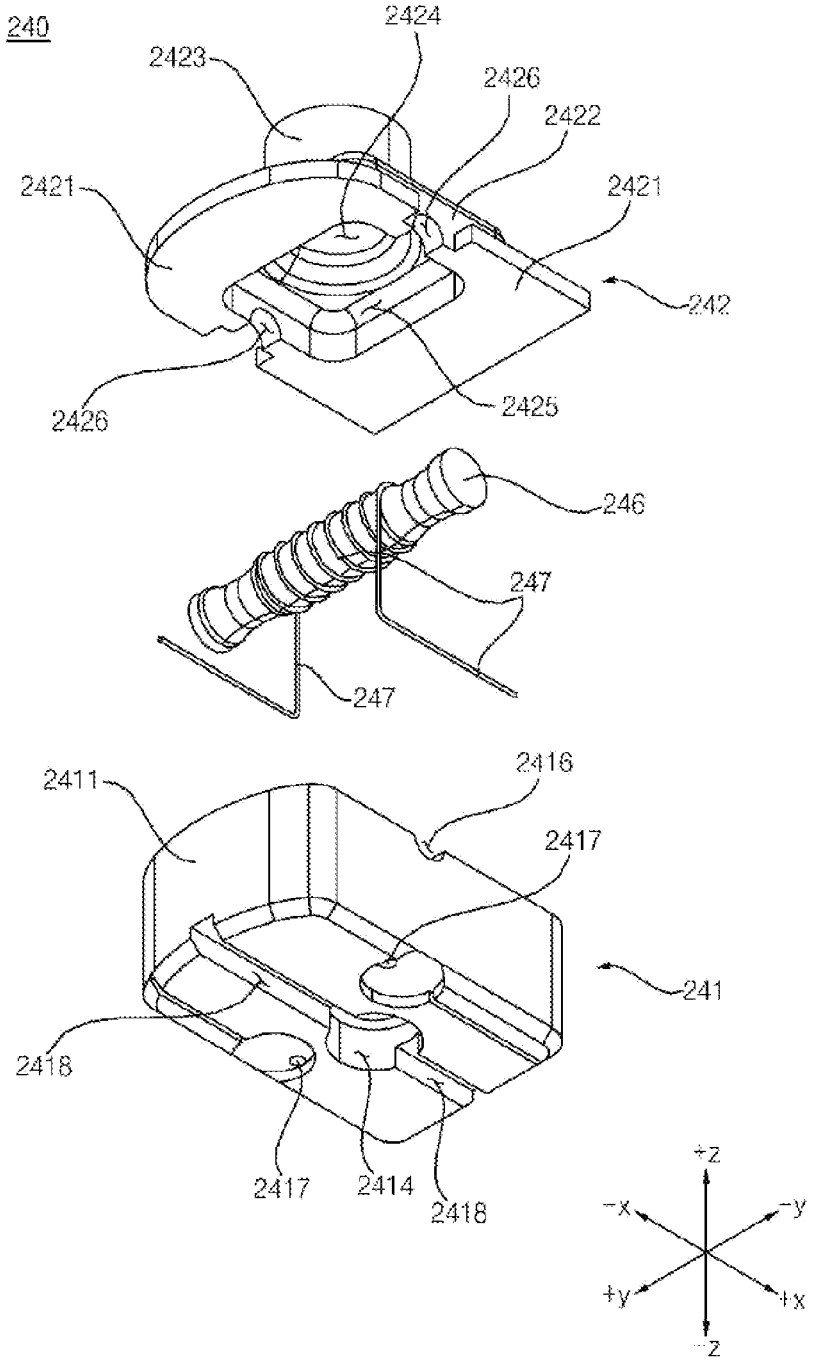

【FIG. 9】
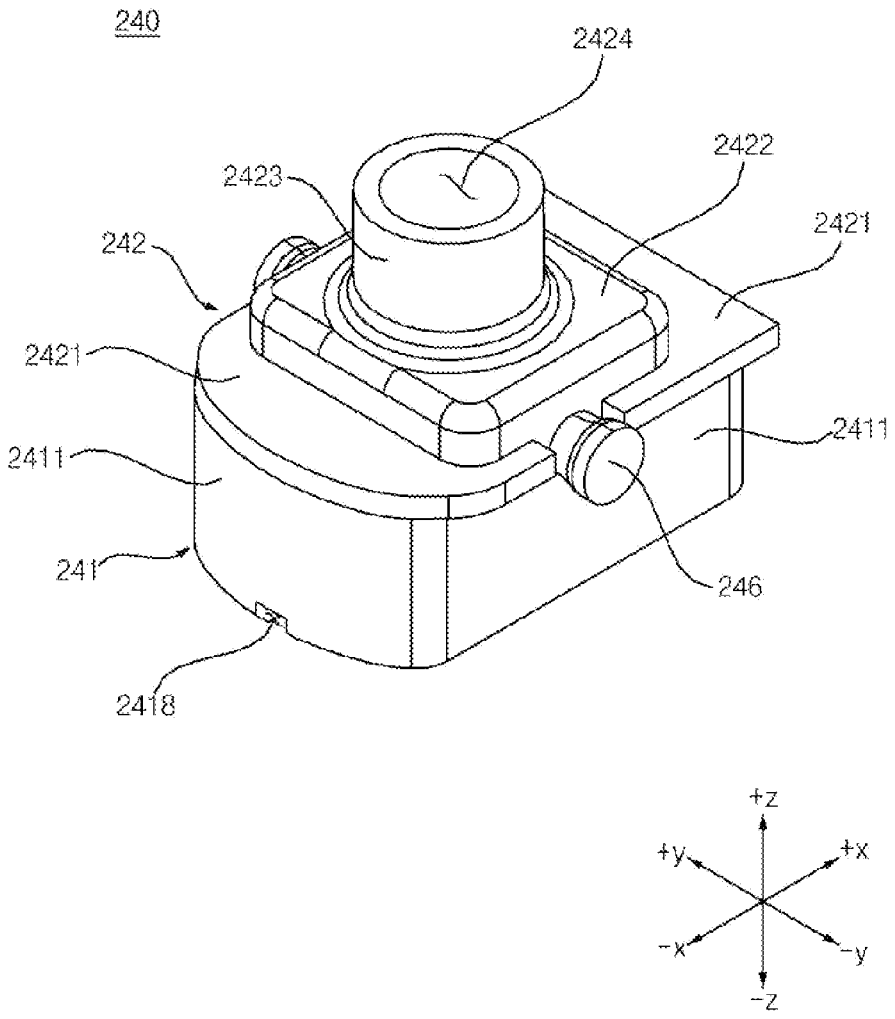

【FIG. 10】
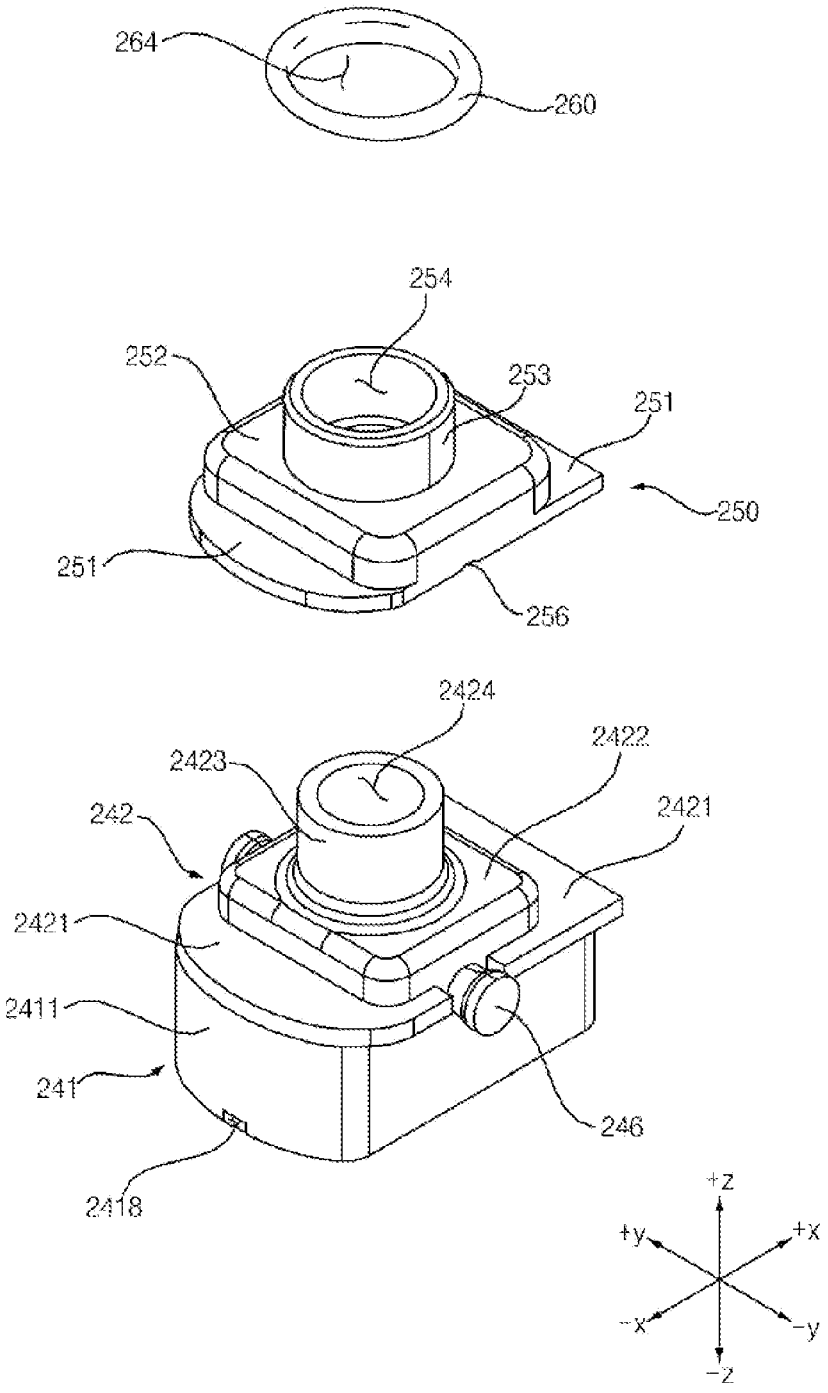

【FIG. 11】
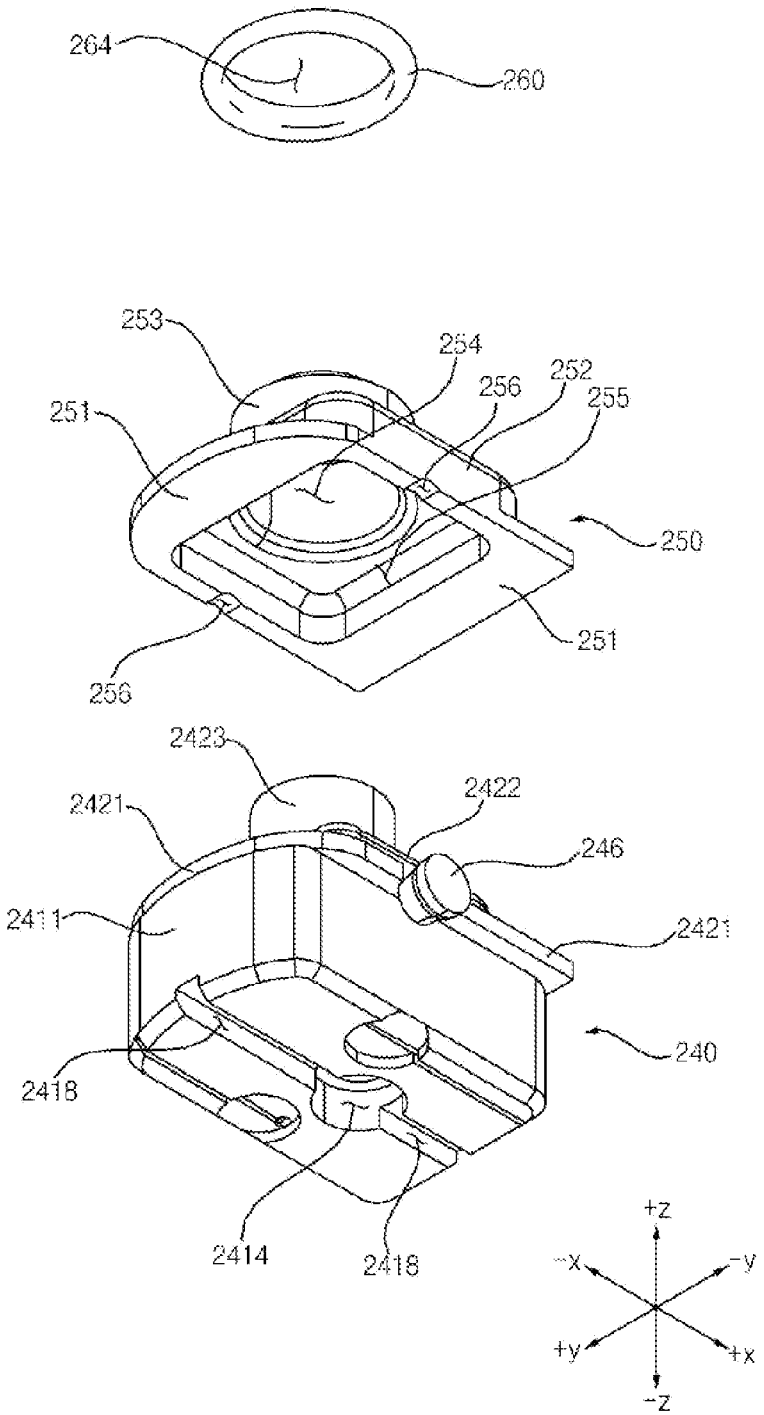

【FIG. 12】
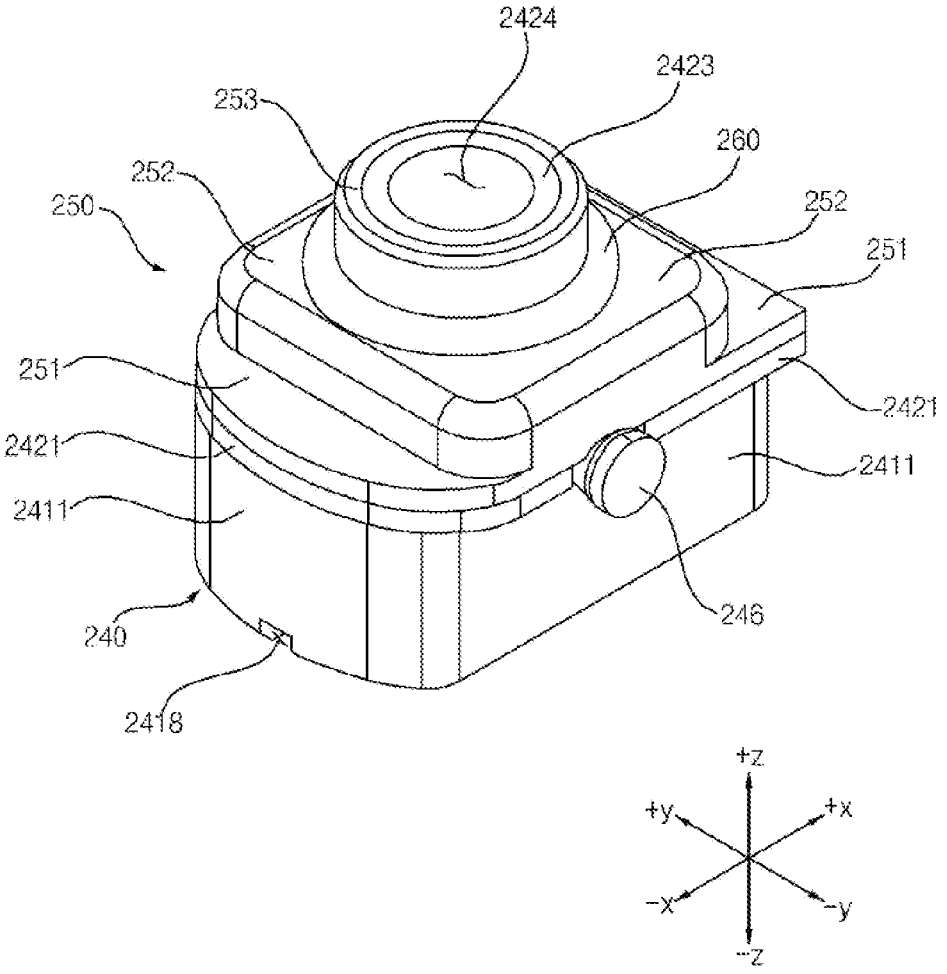

【FIG. 13】
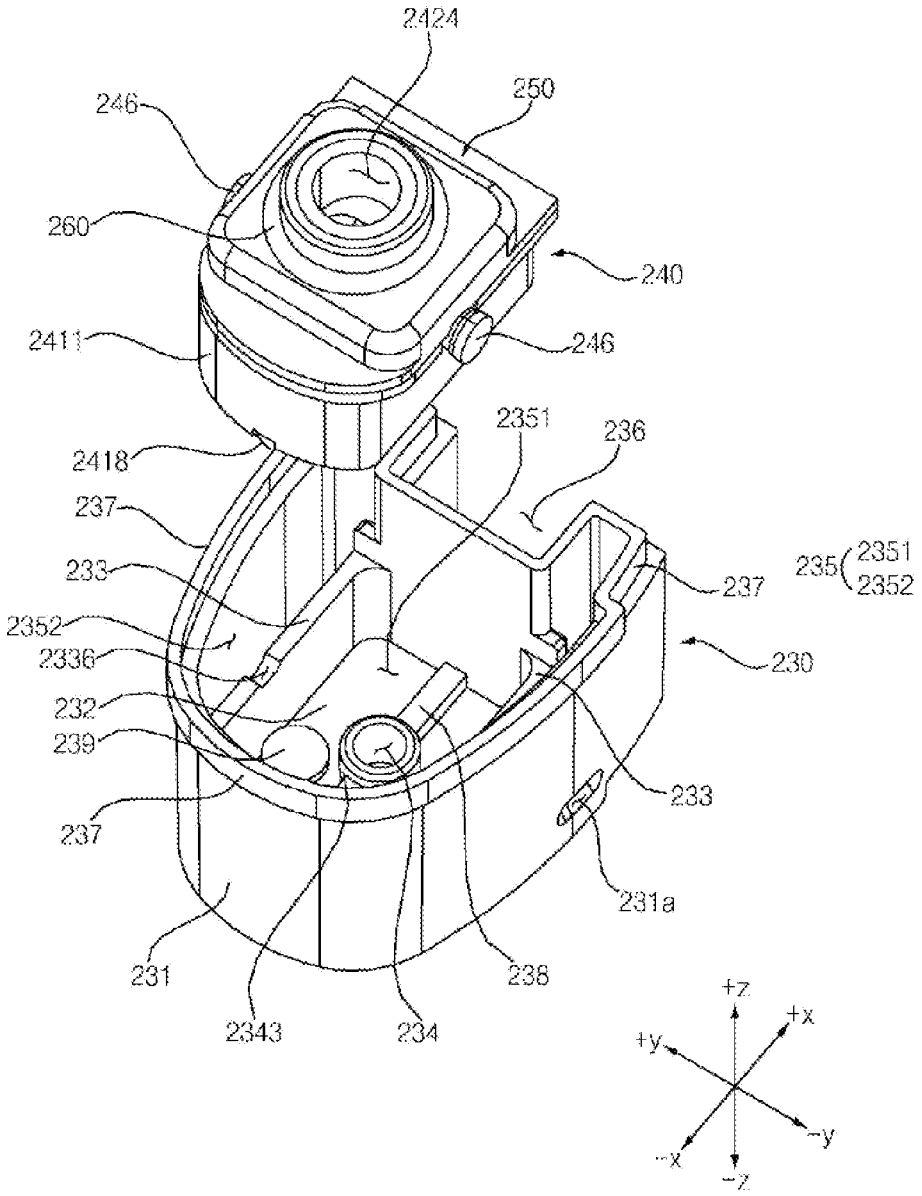

【FIG. 14】
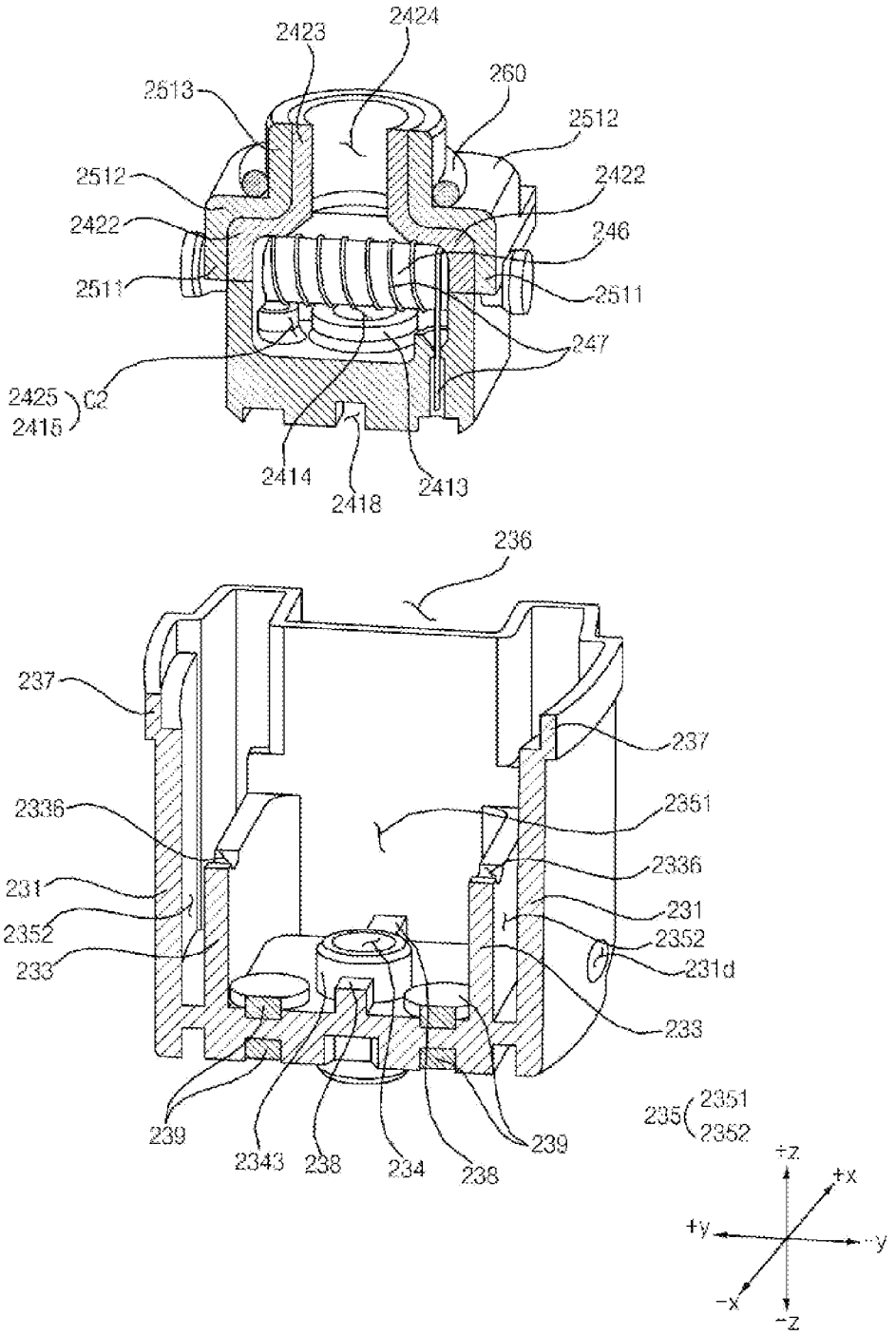

【FIG. 15】
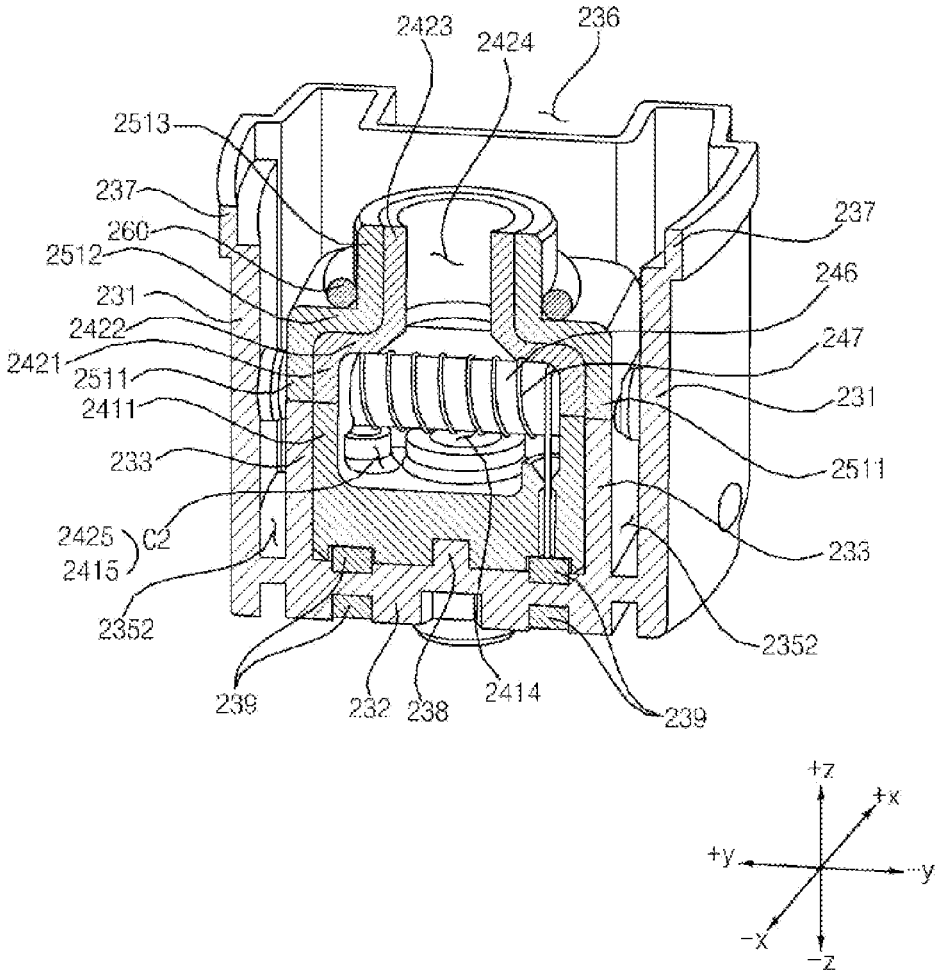

【FIG. 16】
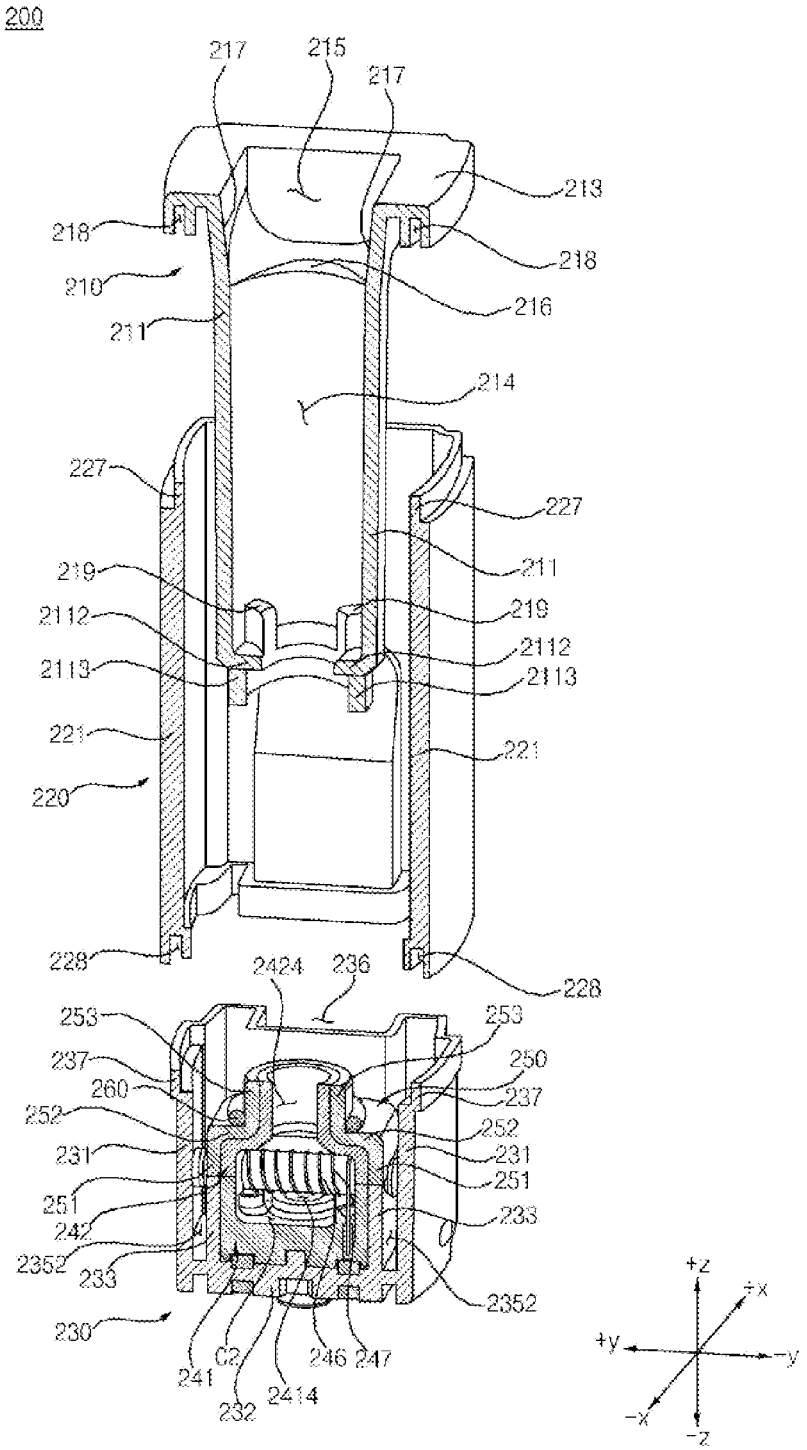

【FIG. 17】
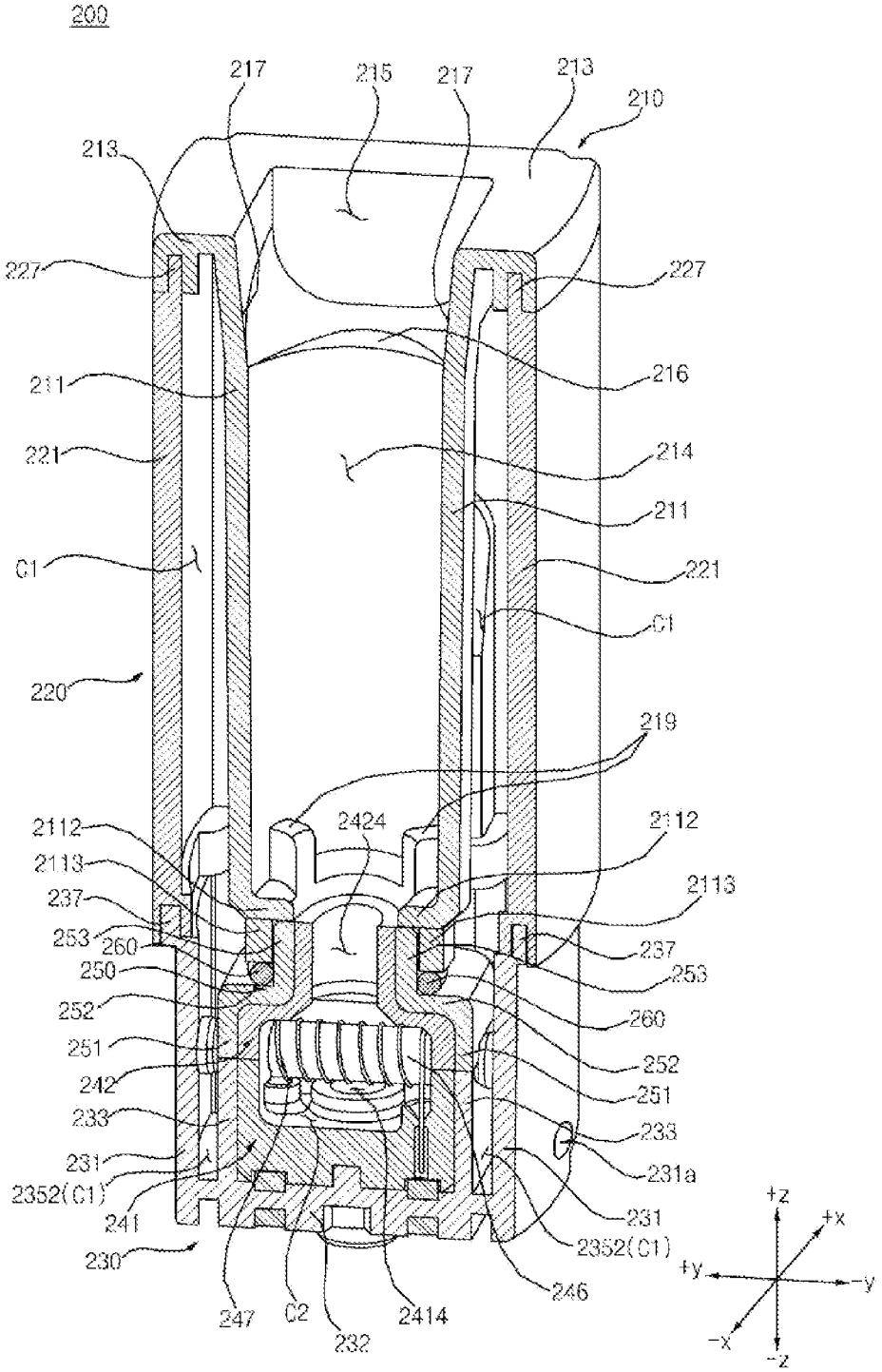

【FIG. 18】
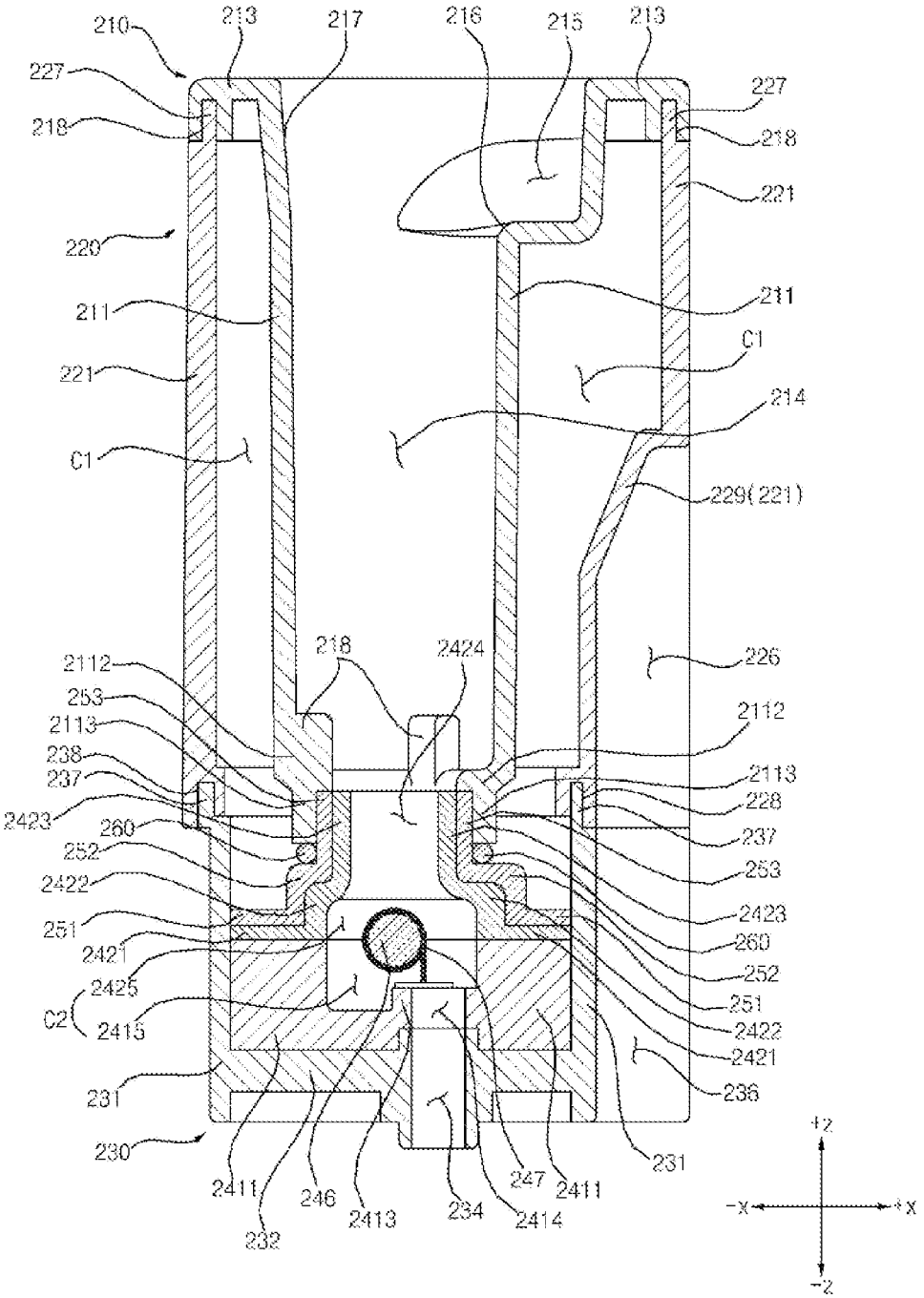

【FIG. 19】
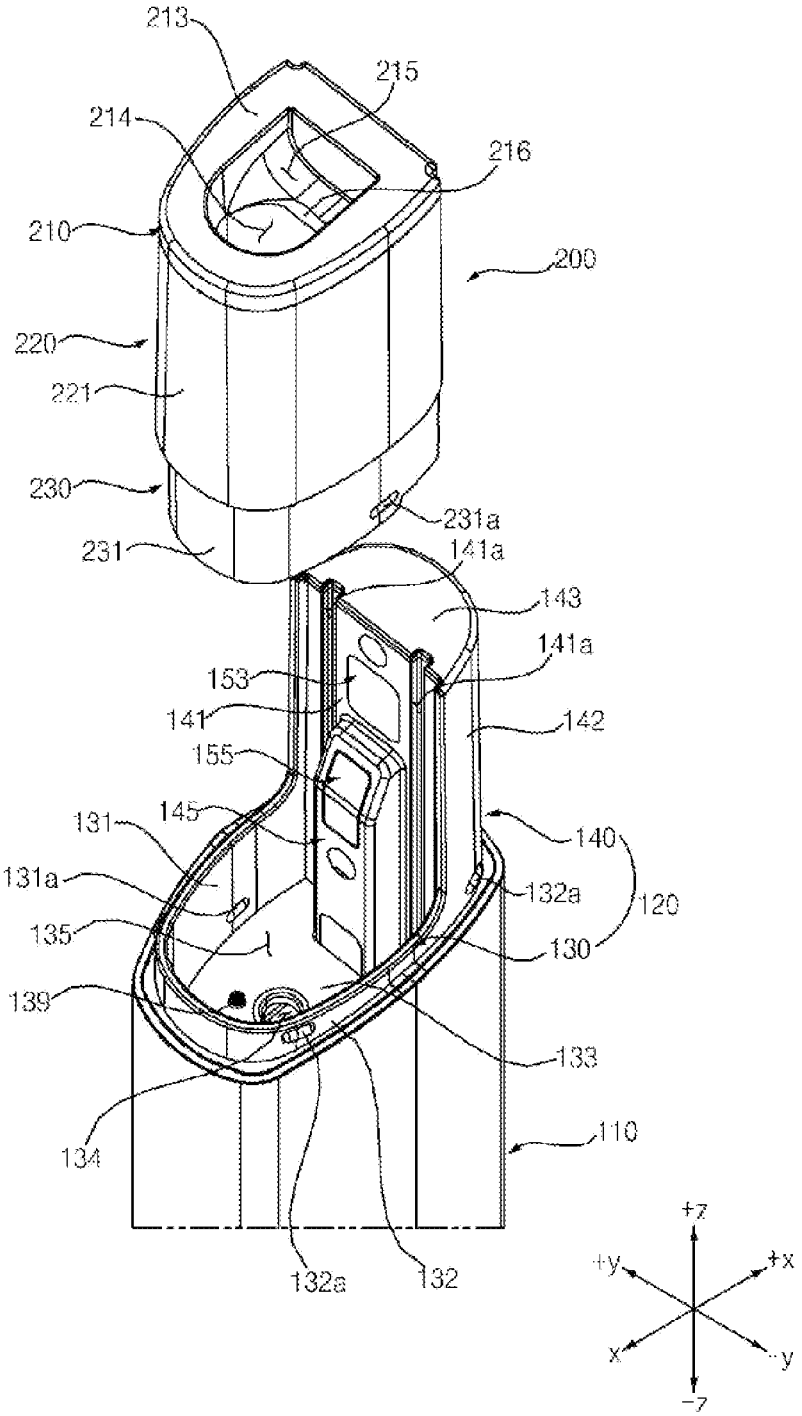

【FIG. 20】
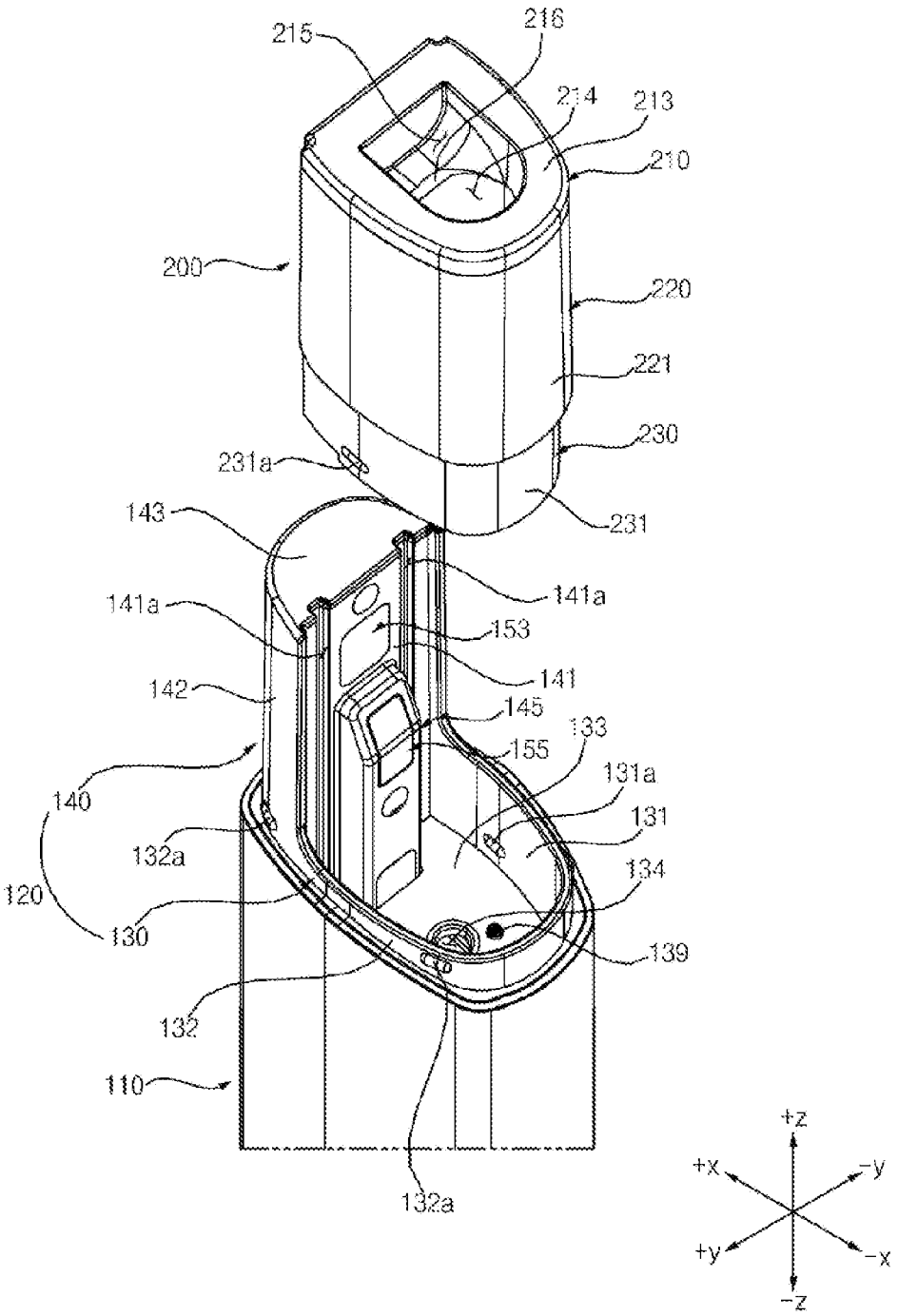

【FIG. 21】
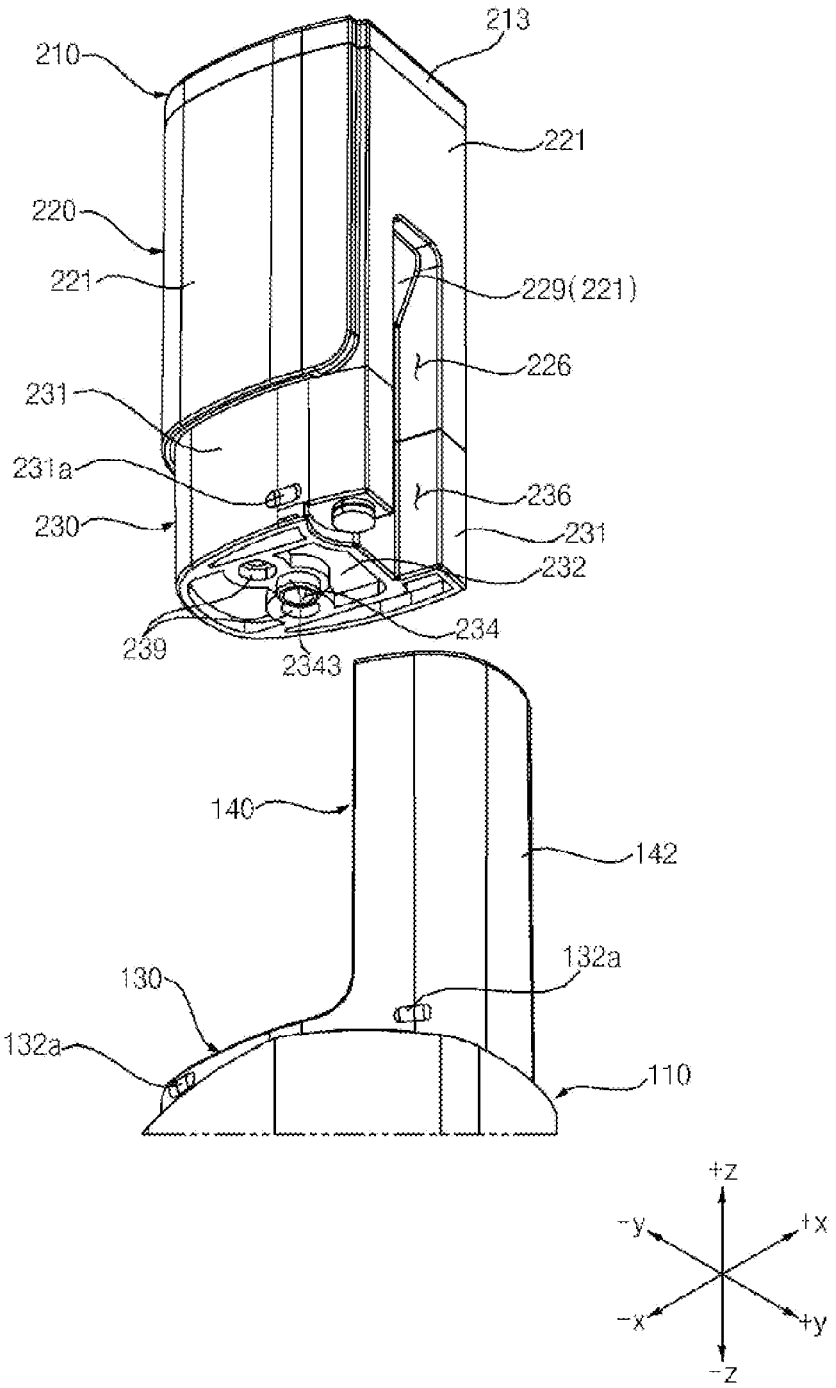

【FIG. 22】
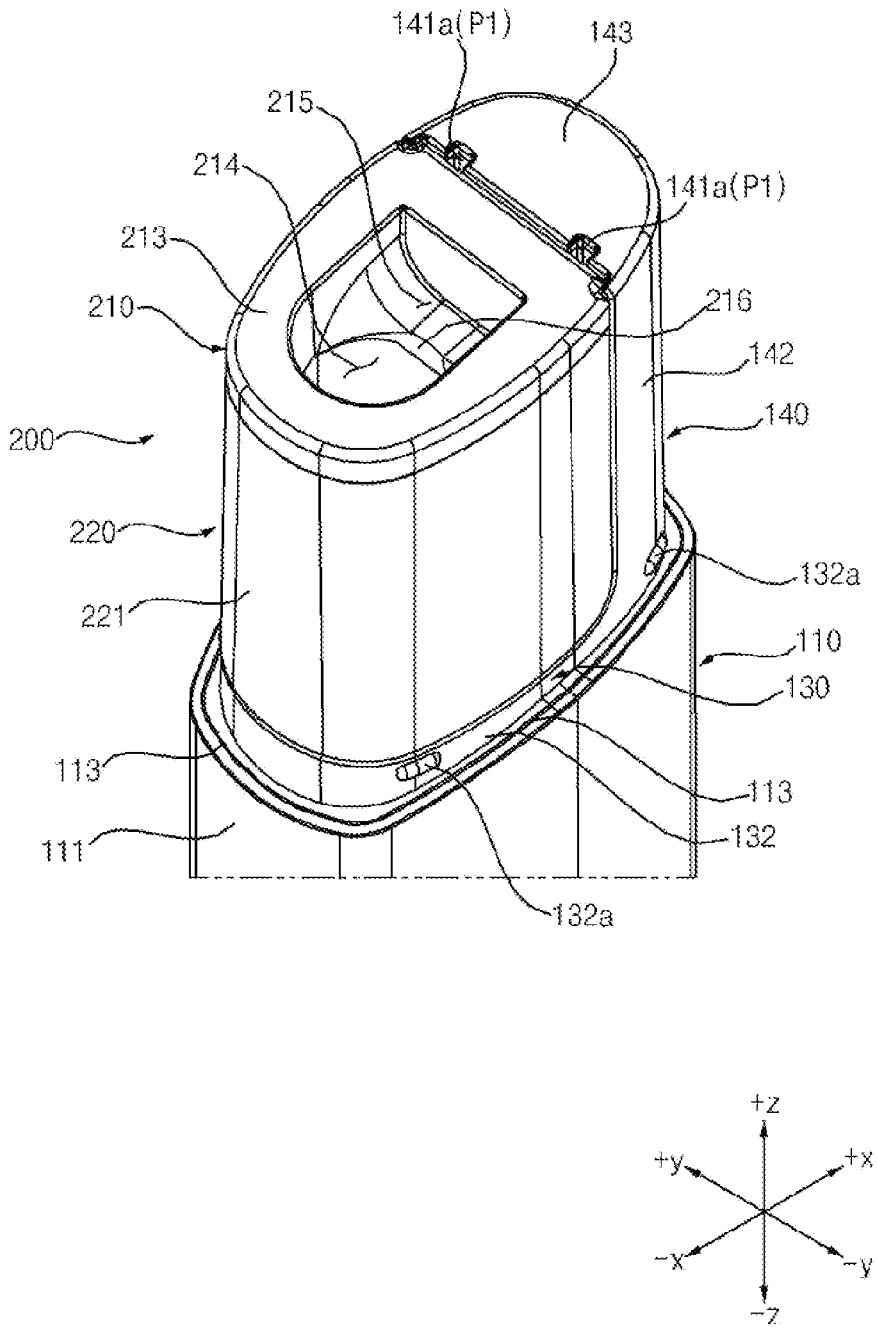

【FIG. 23】
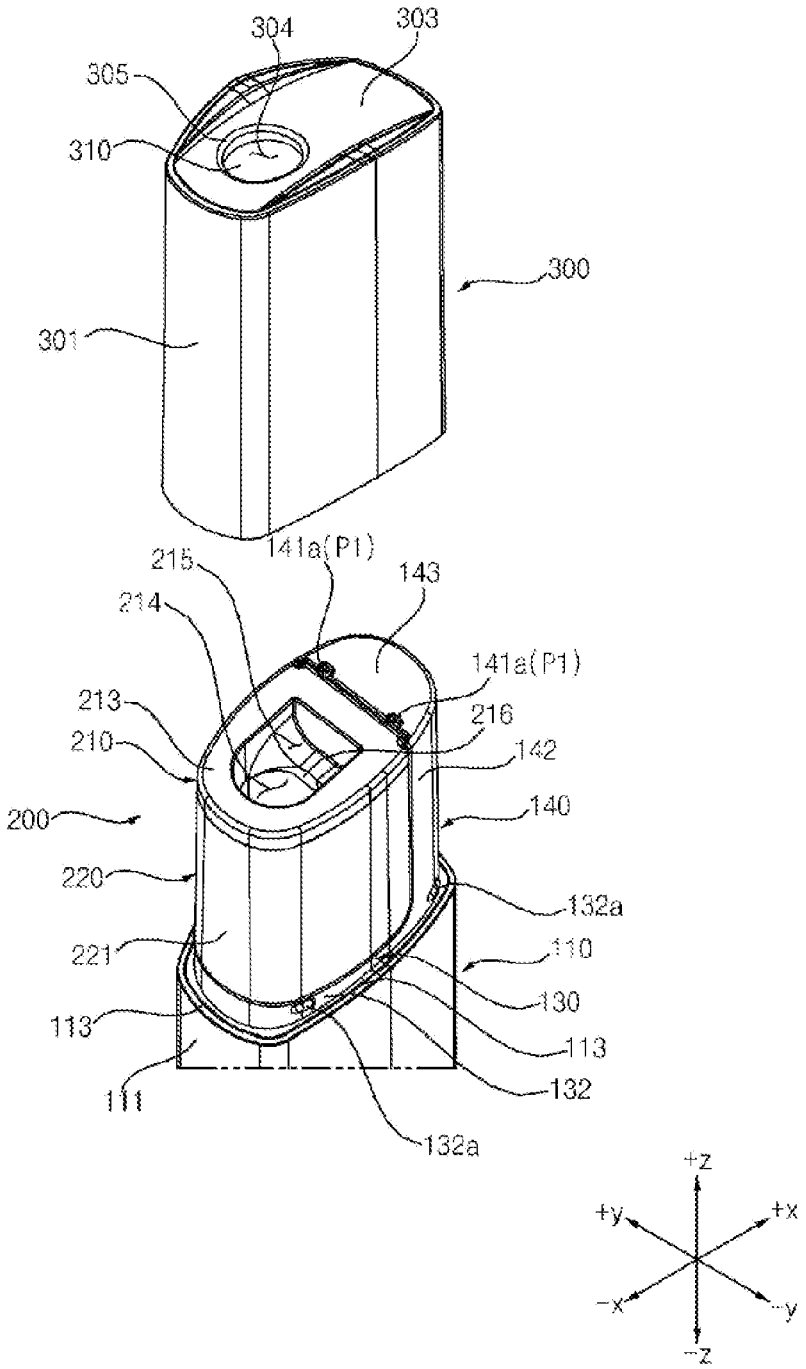

【FIG. 24】
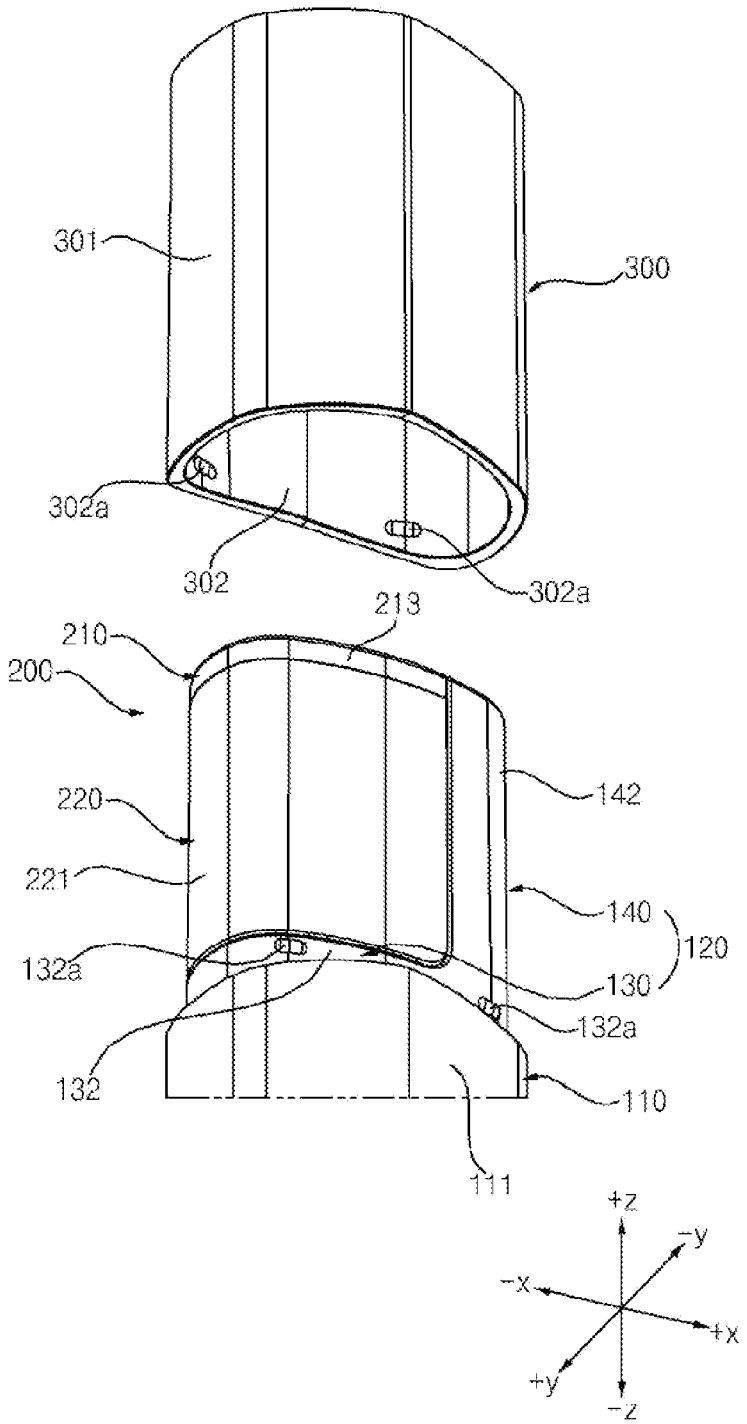

【FIG. 25】
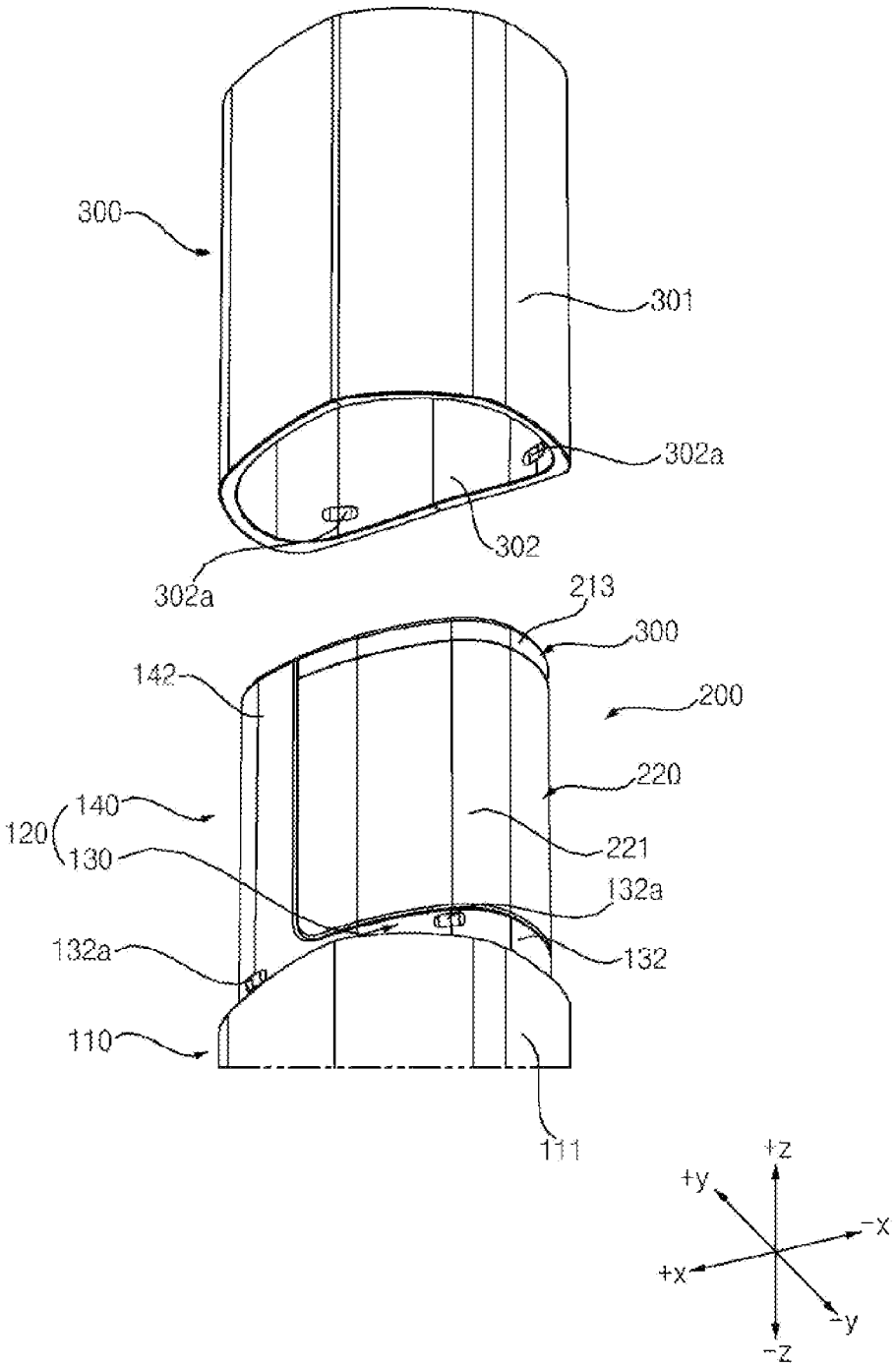

【FIG. 26】
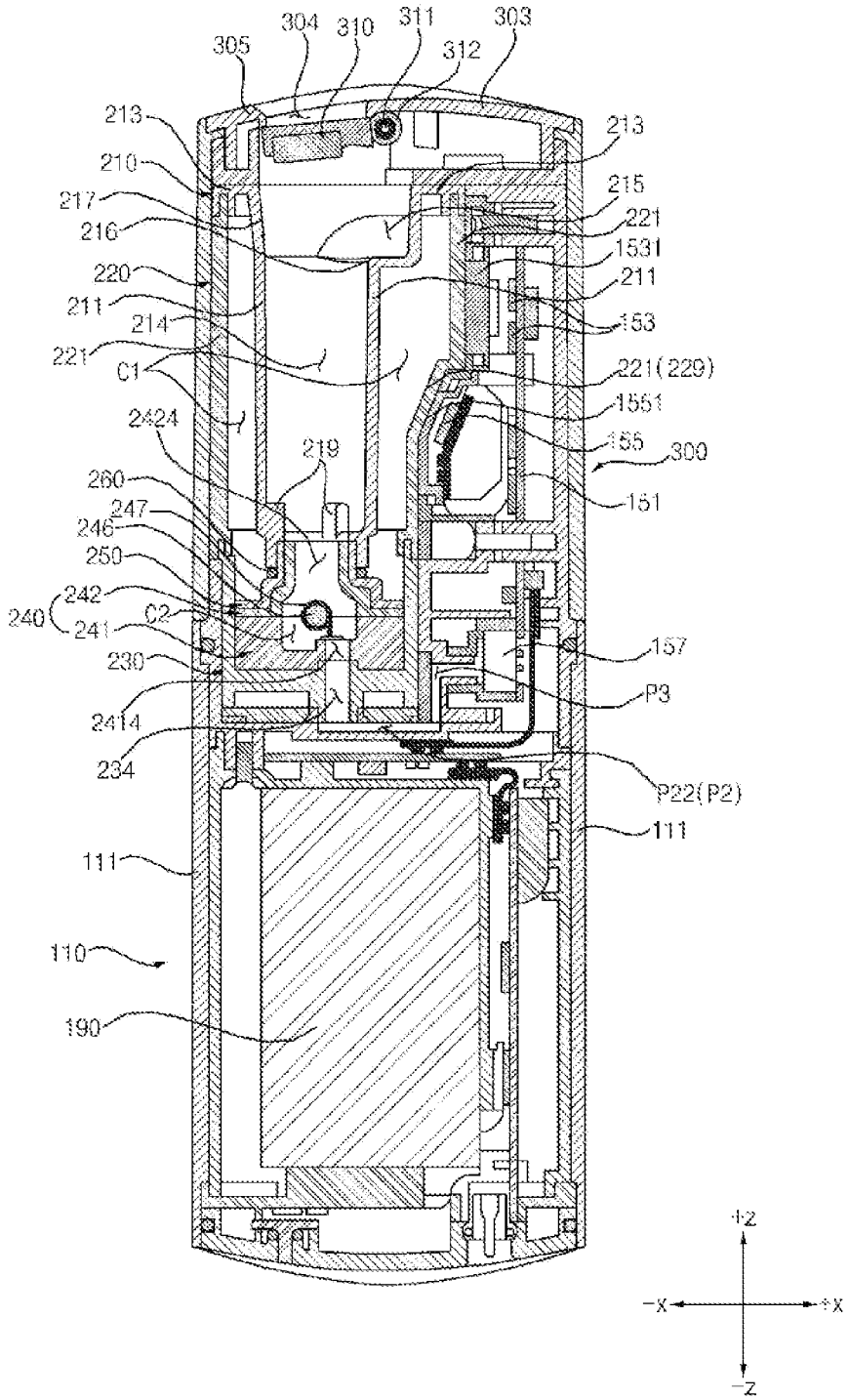

【FIG. 27】
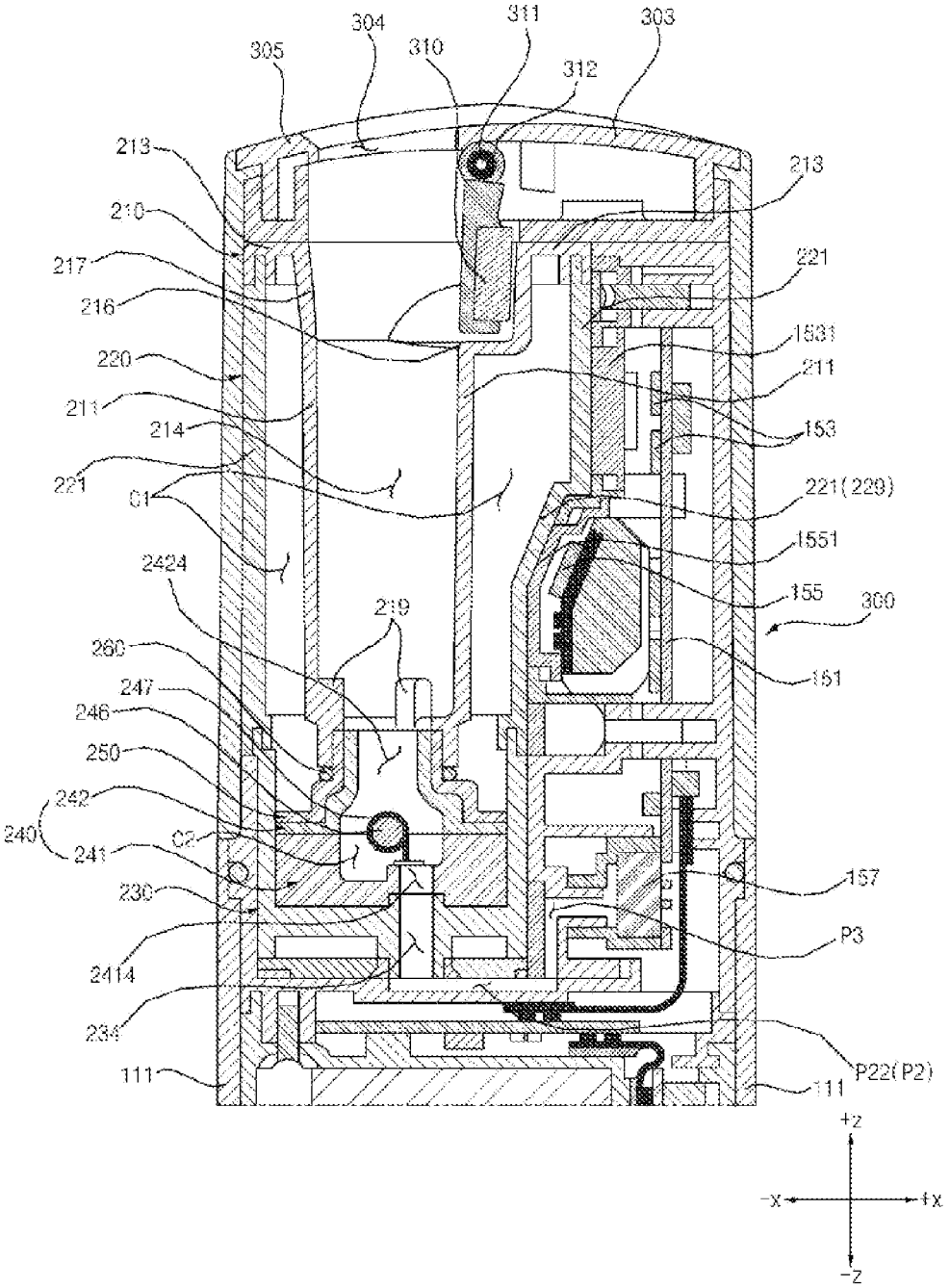

【FIG. 28】
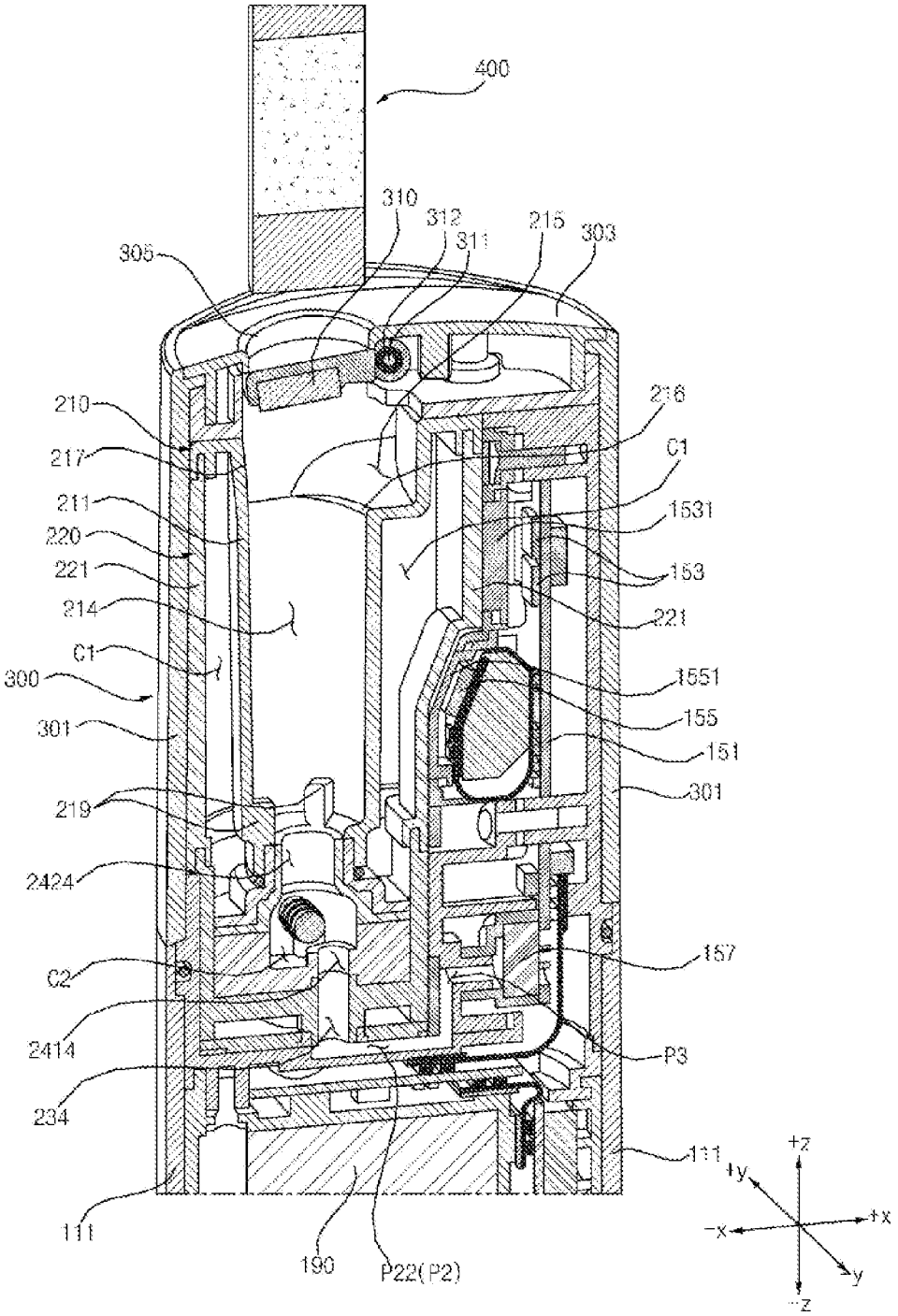

【FIG. 29】
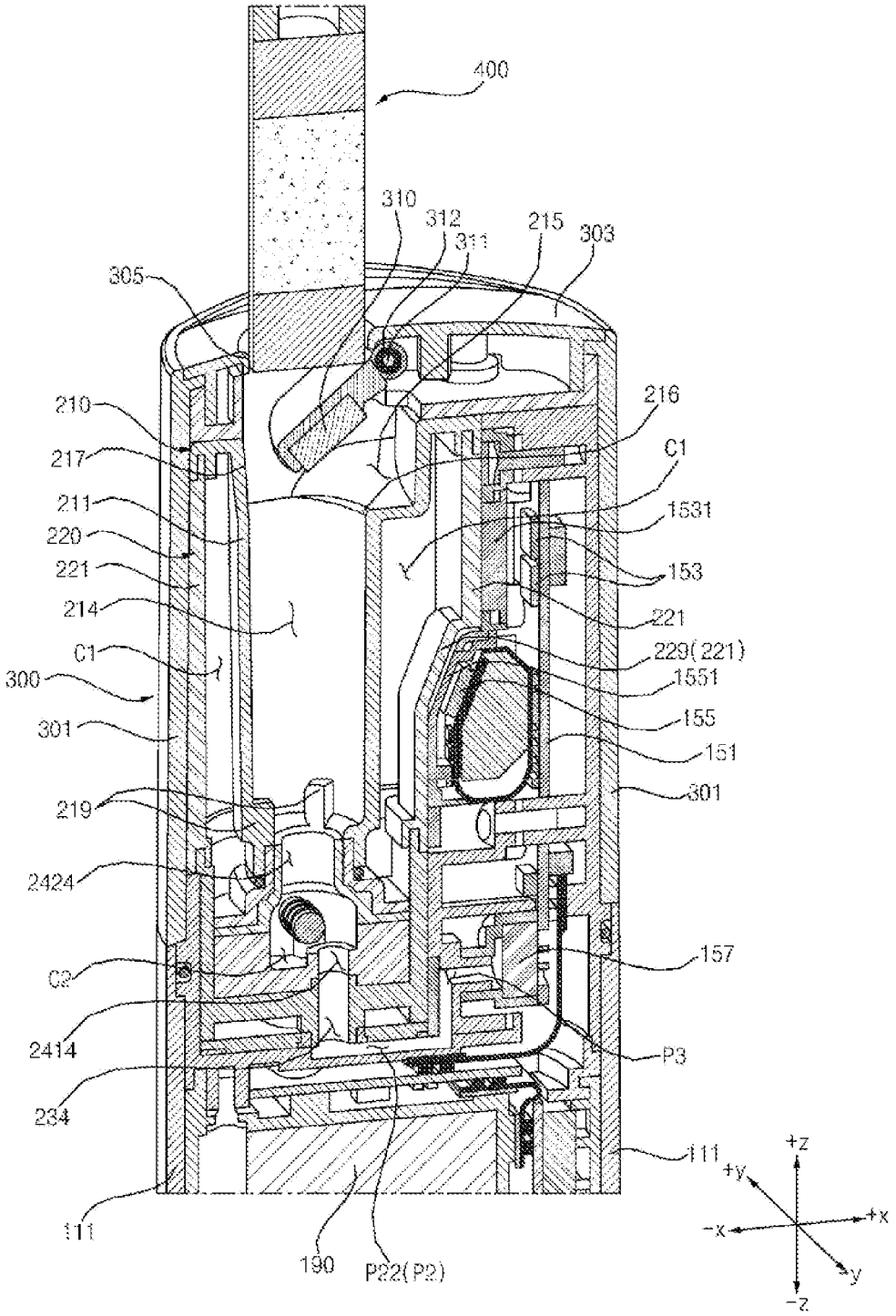

【FIG. 30】
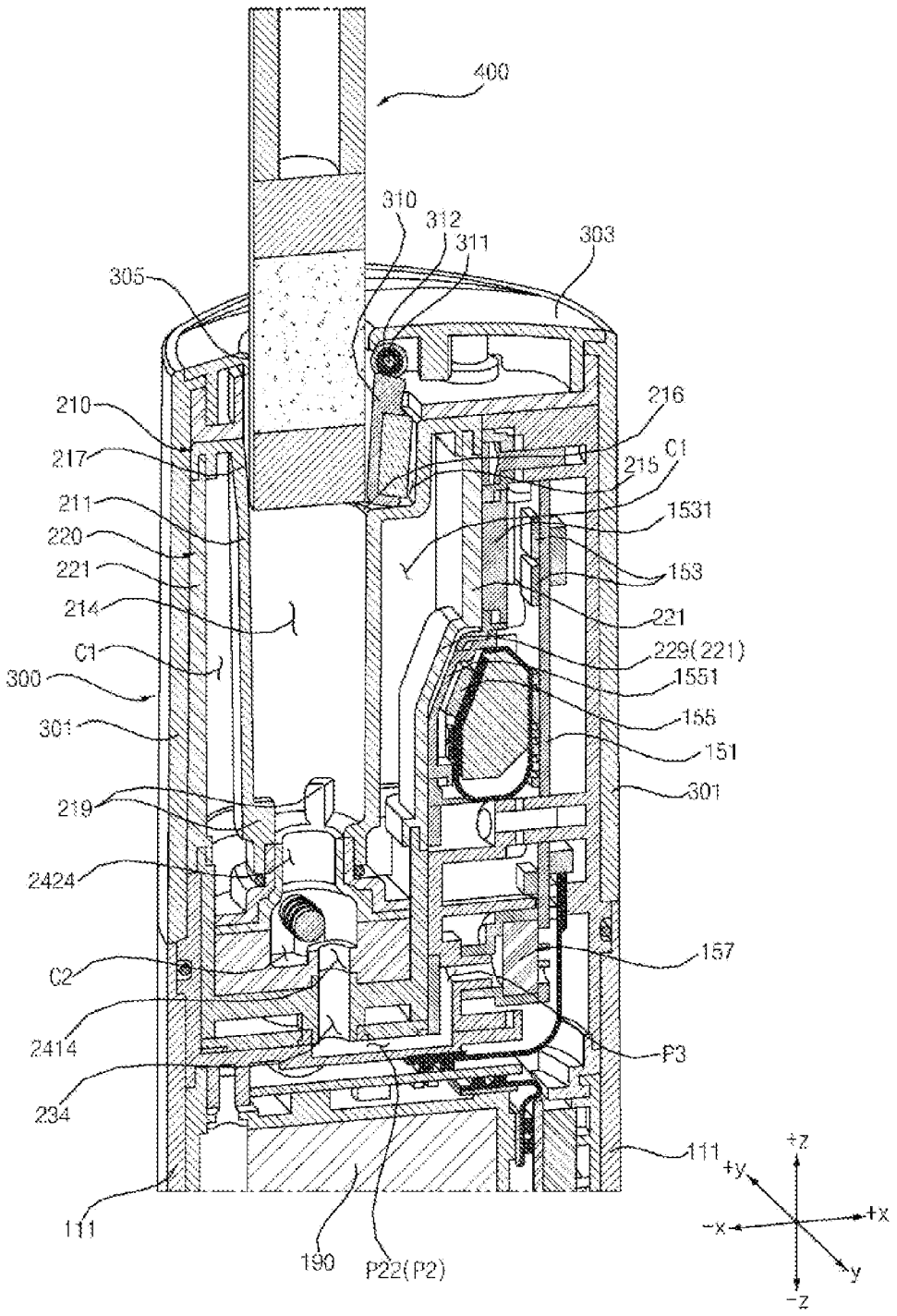

【FIG. 31】
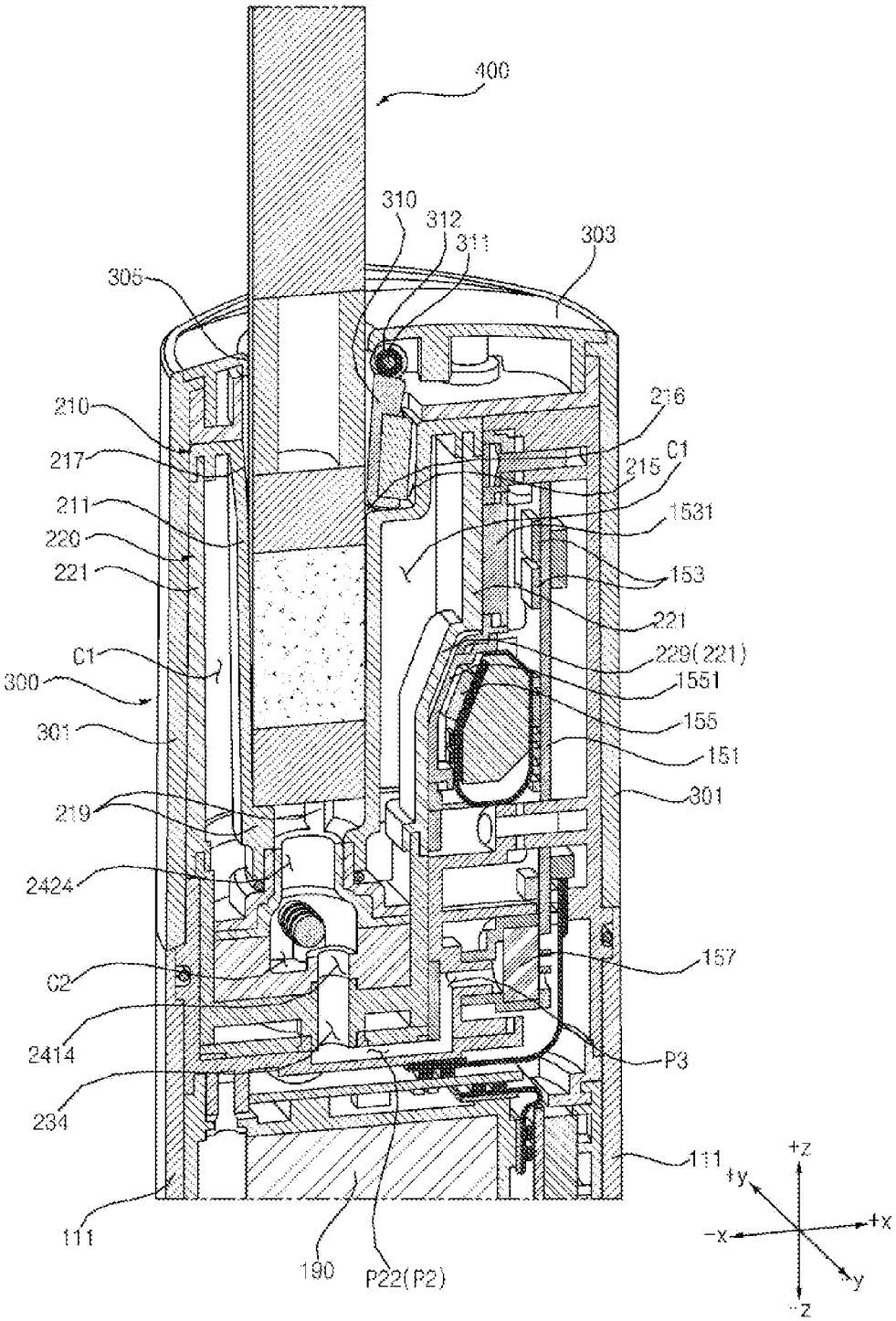

【FIG. 32】
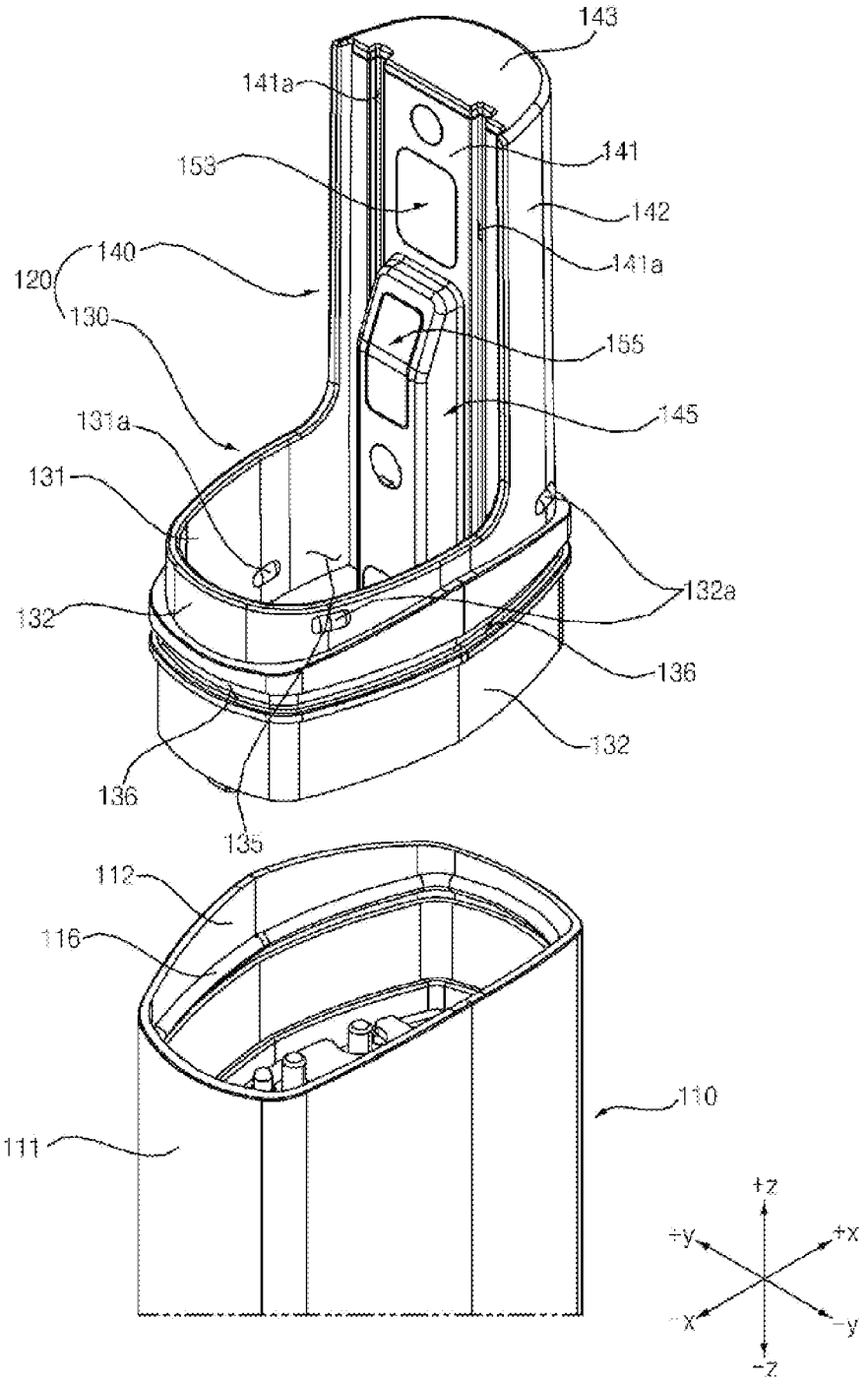

【FIG. 33】
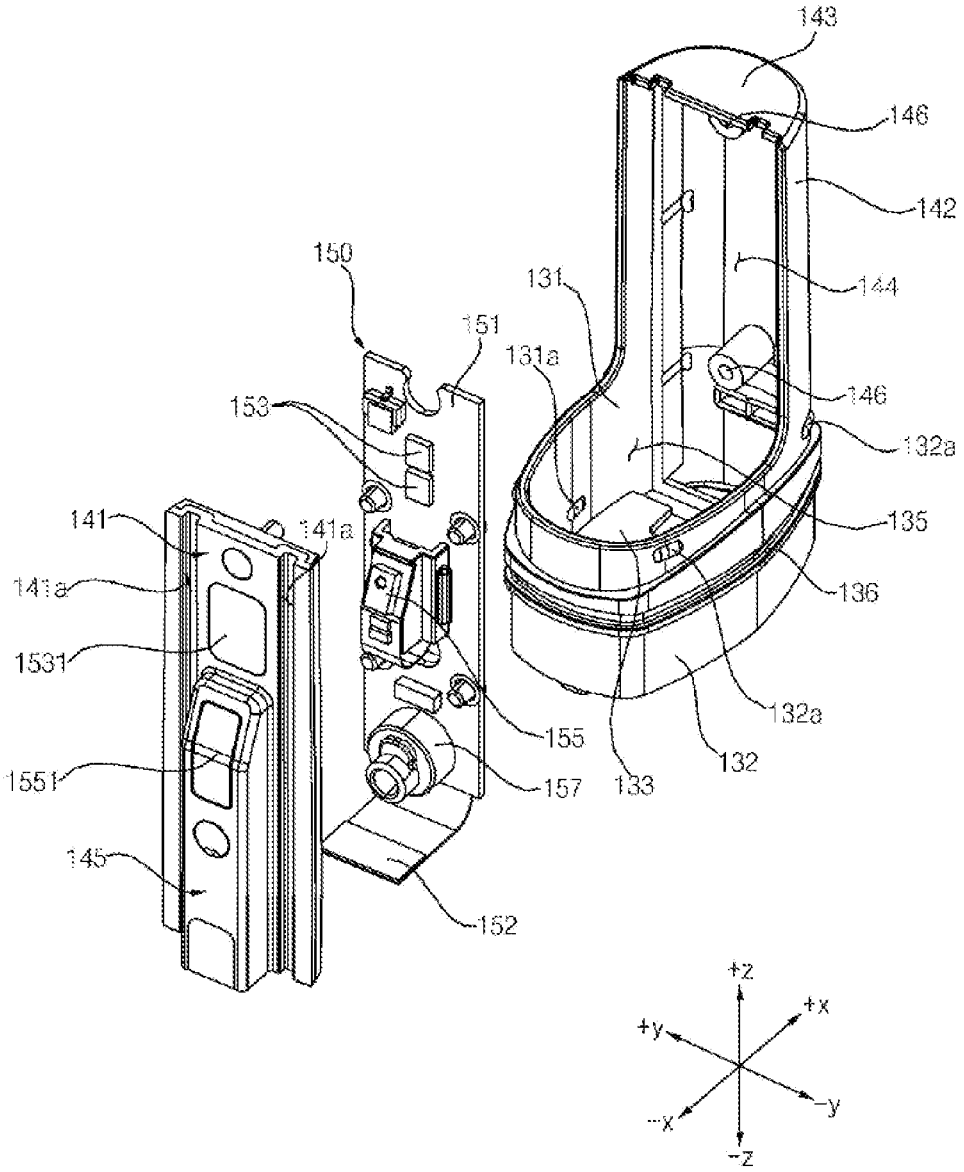

【FIG. 34】
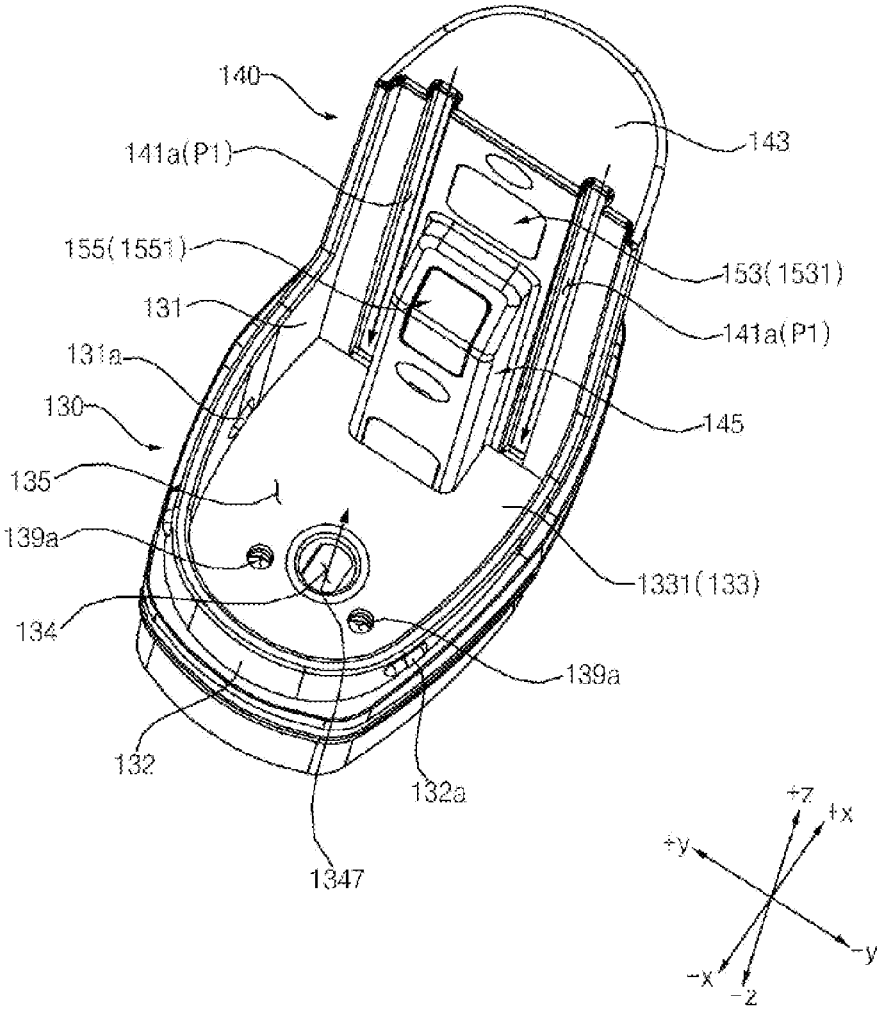

【FIG. 35】
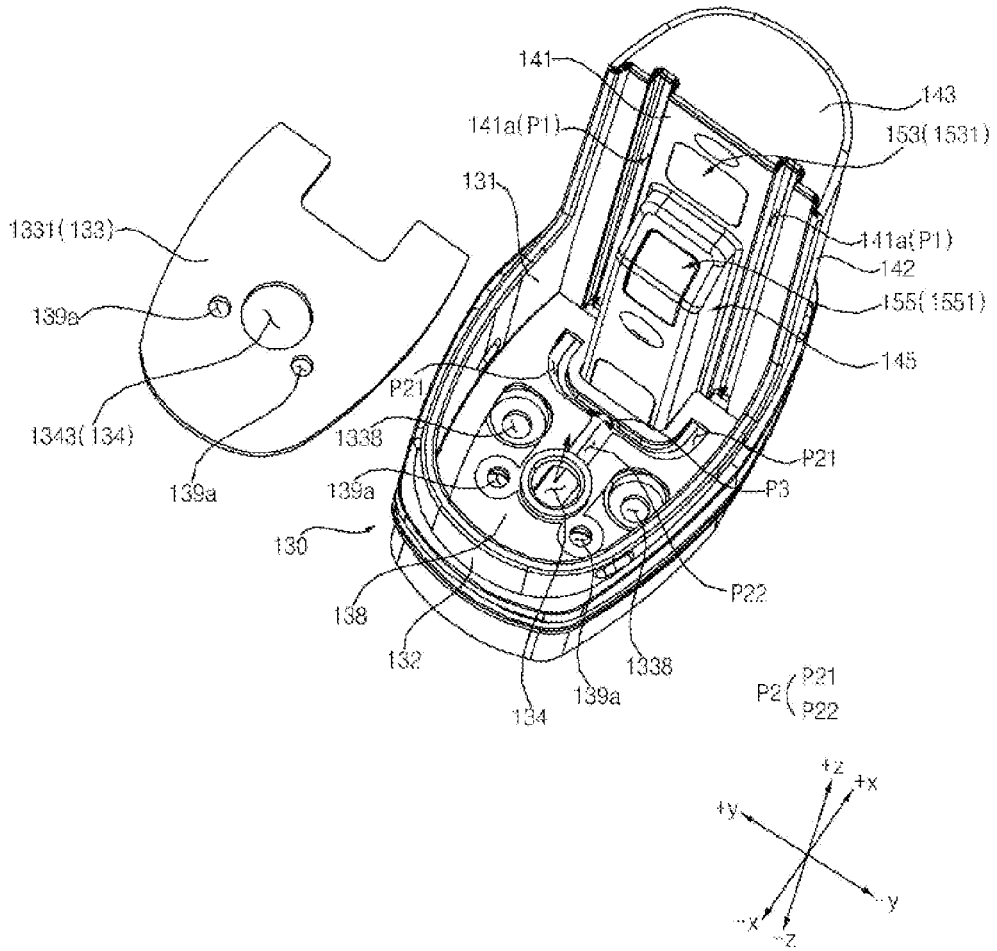

[FIG. 36]
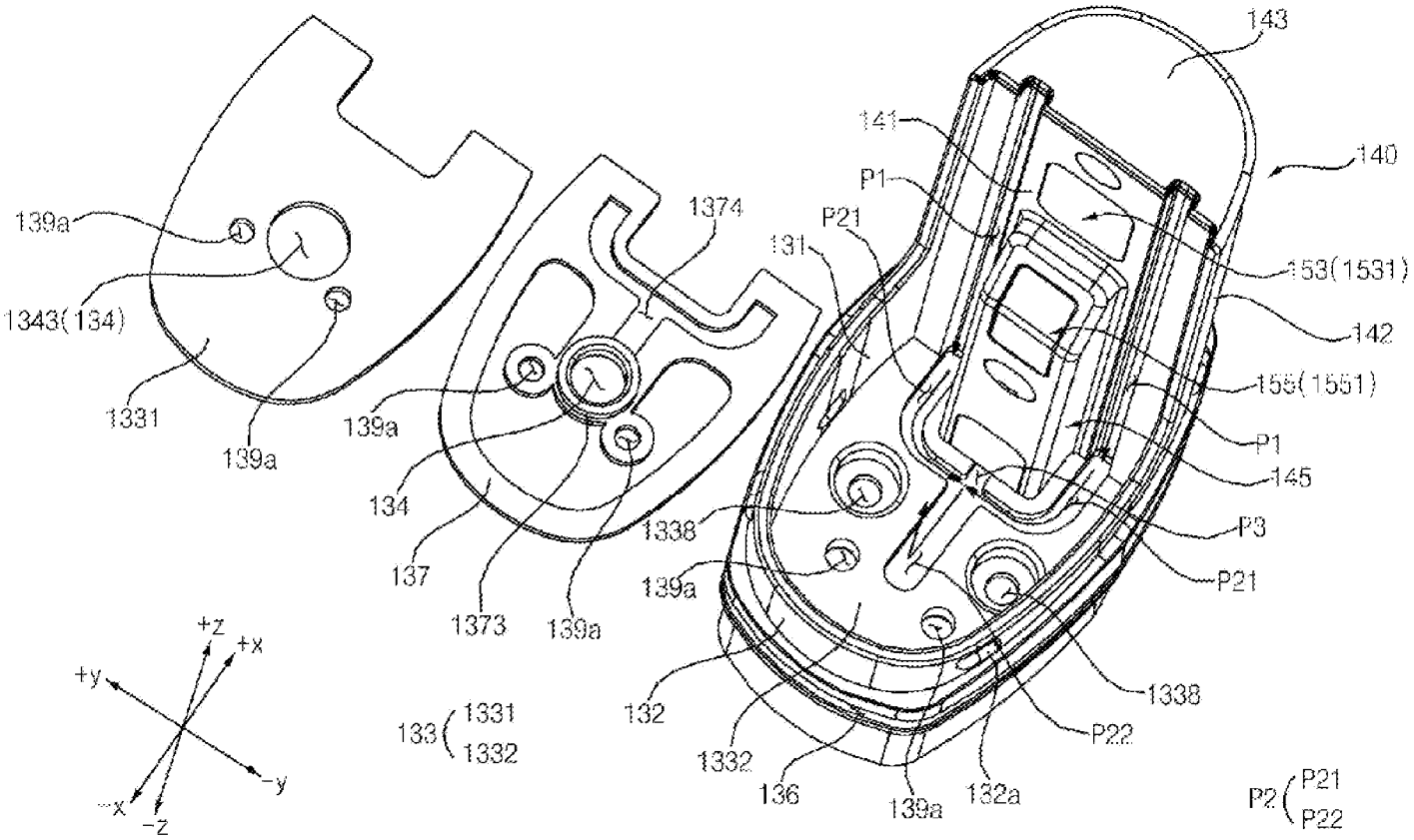

【FIG. 37】
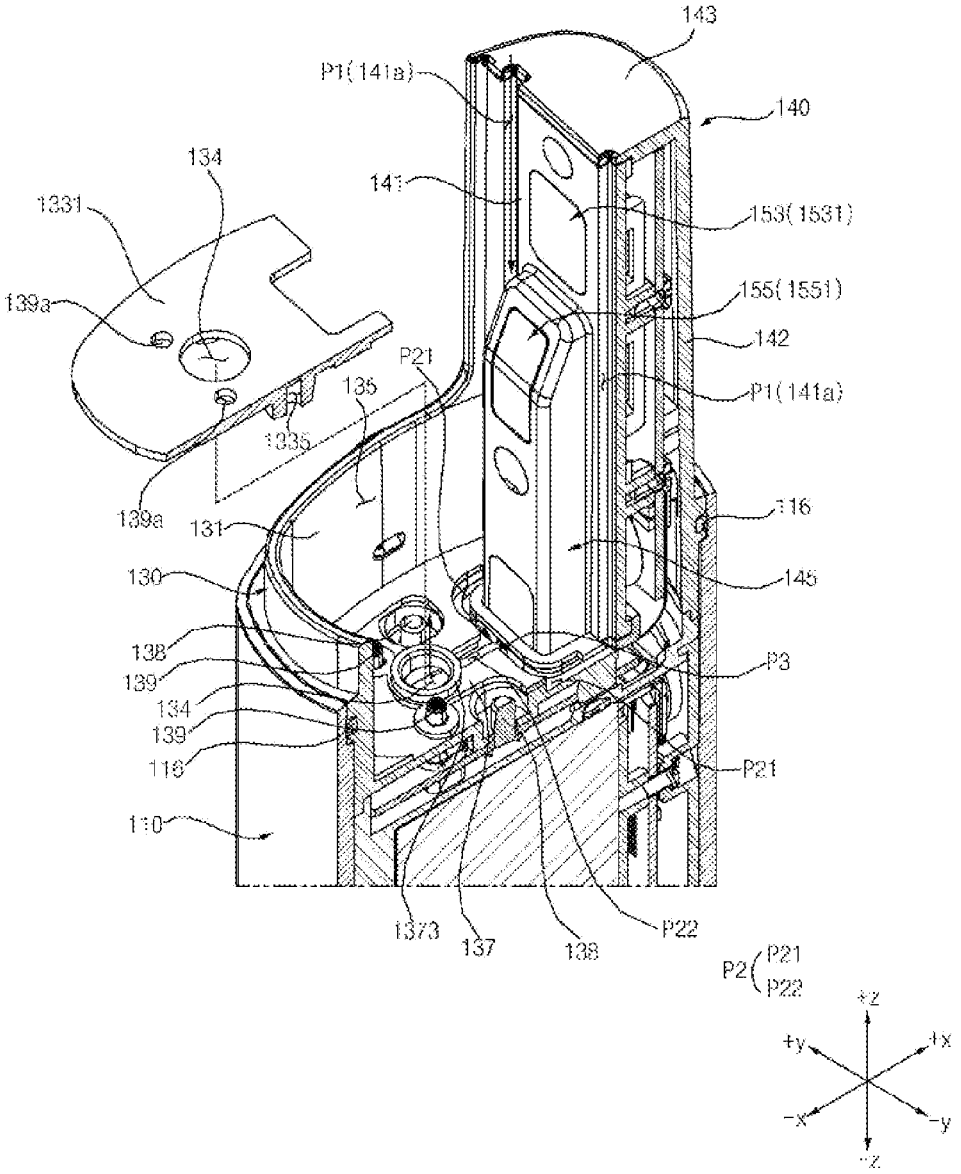

【FIG. 38】
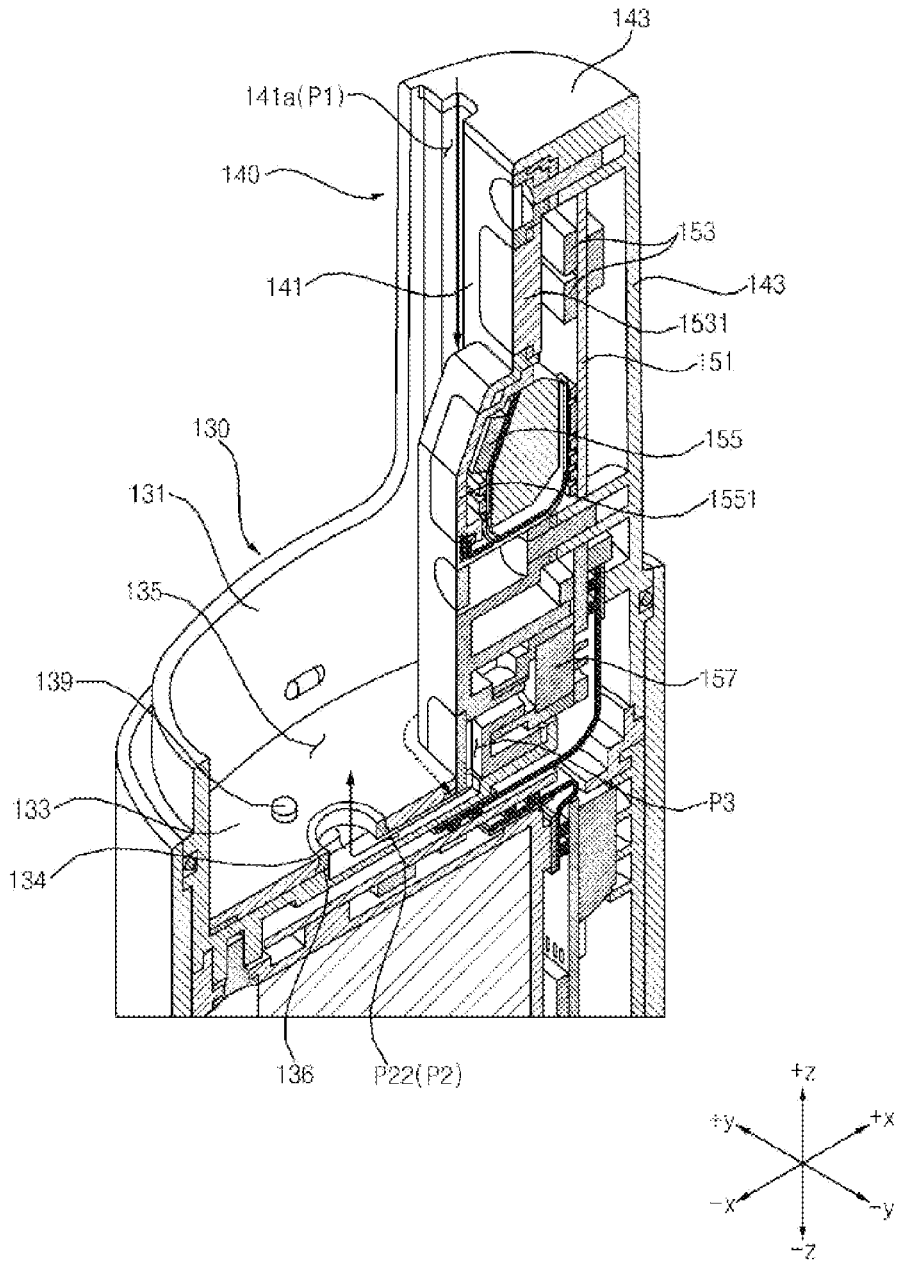

【FIG. 39】
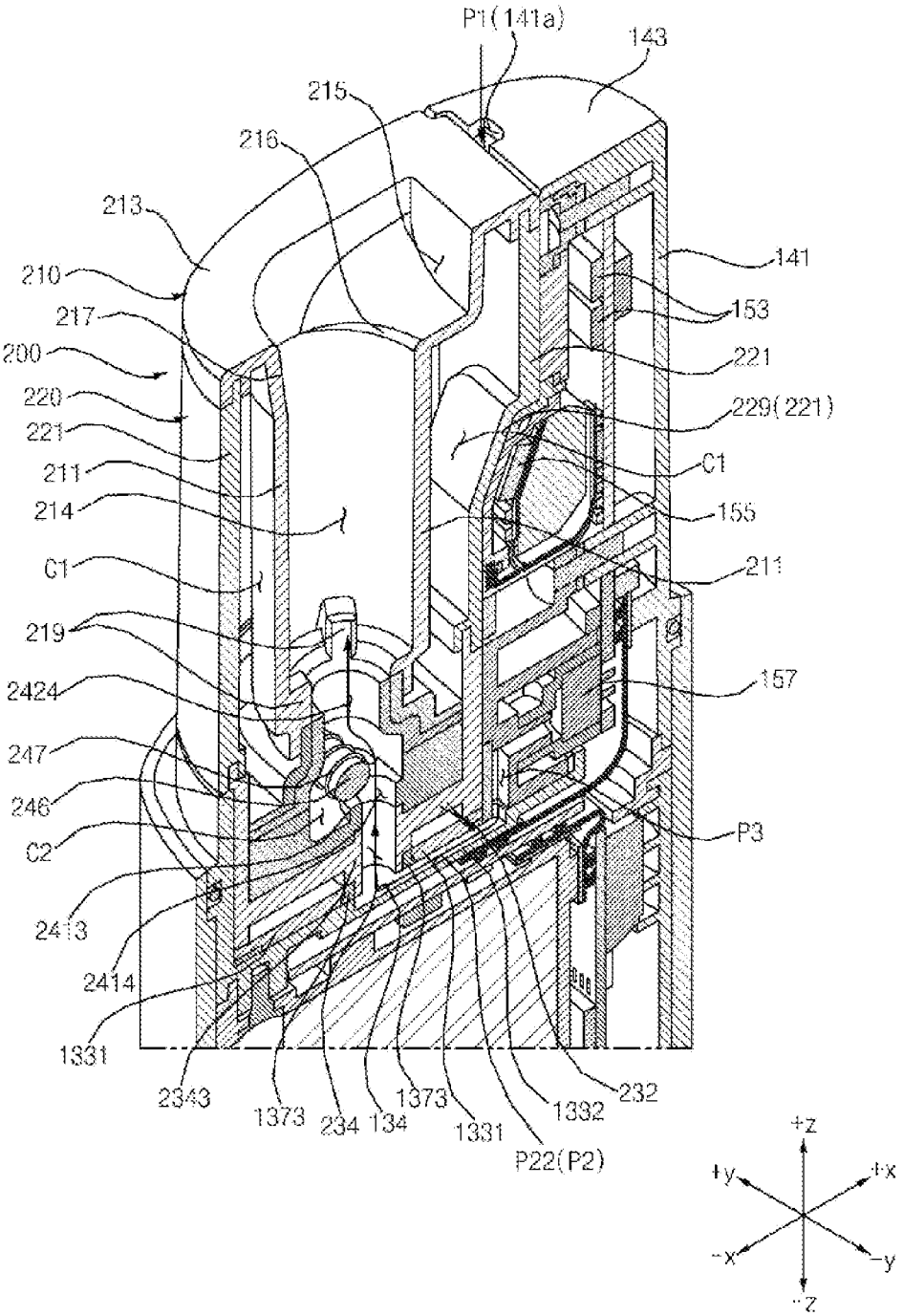

【FIG. 40】
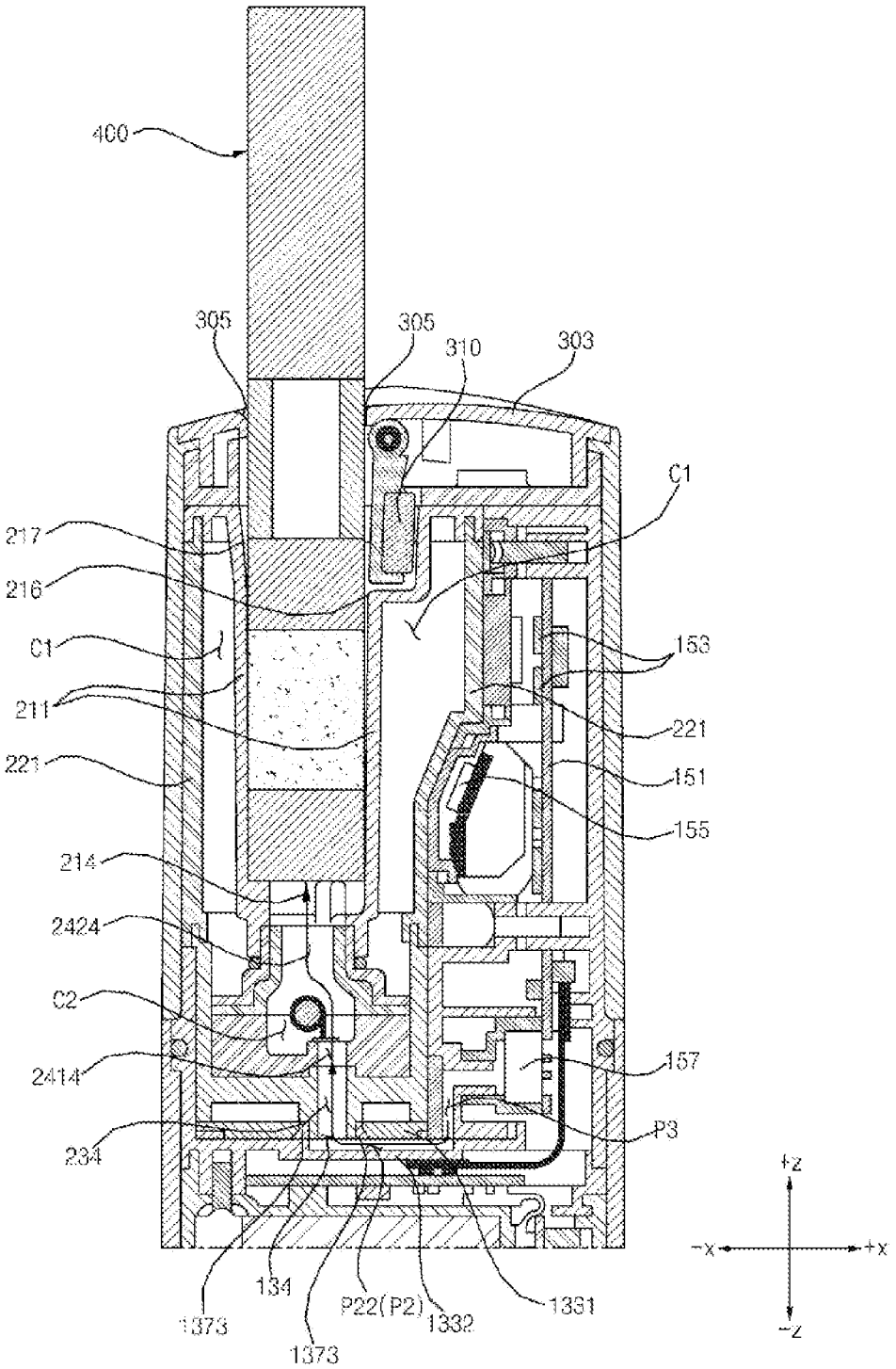

【FIG. 41】
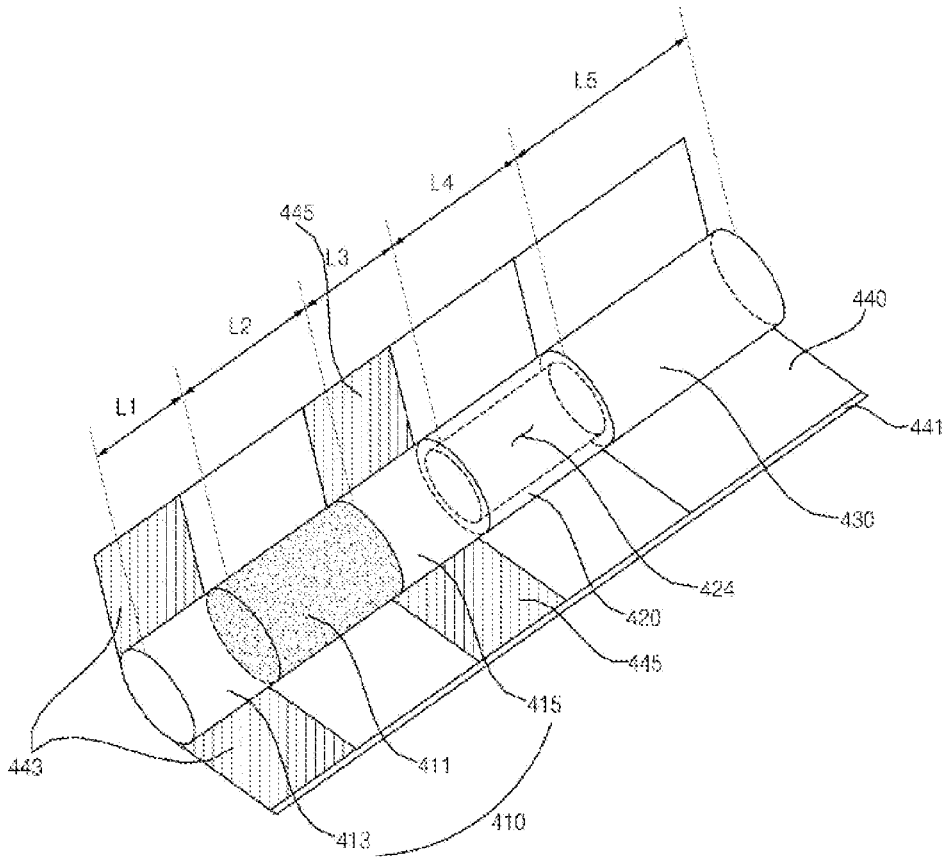

CARTRIDGE AND AEROSOL-GENERATING DEVICE INCLUDING THE SAME

CROSS-REFERENCE TO RELATED APPLICATIONS

This application is the National Stage filing under 35 U.S.C. 371 of International Application No. PCT/KR2022/007176, filed on May 19, 2022, which claims the benefit of earlier filing date and right of priority to Korean Application No. 10-2021-0064511, filed on May 20, 2021, the contents of which are all hereby incorporated by reference herein their entirety.

TECHNICAL FIELD

The present disclosure relates to a cartridge and an aerosol-generating device including the same.

BACKGROUND ART

An aerosol-generating device is a device that extracts certain components from a medium or a substance by forming an aerosol. The medium may contain a multicomponent substance. The substance contained in the medium may be a multicomponent flavoring substance. For example, the substance contained in the medium may include a nicotine component, an herbal component, and/or a coffee component. Recently, various research on aerosol-generating devices has been conducted.

DISCLOSURE OF INVENTION

Technical Problem

It is an object of the present disclosure to solve the above and other problems.

It is another object of the present disclosure to provide a cartridge and an aerosol-generating device including the cartridge, which are capable of improving convenience of assembly.

It is still another object of the present disclosure to provide a cartridge and an aerosol-generating device including the cartridge, which are capable of improving stability of coupling between components.

It is yet another object of the present disclosure to provide a cartridge and an aerosol-generating device including the cartridge, which are capable of preventing leakage of liquid stored in the cartridge.

It is still yet another object of the present disclosure to provide a cartridge and an aerosol-generating device including the cartridge, which are capable of improving efficiency of airflow.

It is a further object of the present disclosure to provide an aerosol-generating device capable of preventing malfunction of a sensor configured to detect airflow.

It is still a further object of the present disclosure to provide a cartridge and an aerosol-generating device including the cartridge, which are capable of improving efficiency of liquid storage.

Solution to Problem

In accordance with an aspect of the present disclosure for accomplishing the above objects, there is provided a cartridge including a pipe defining an insertion space having an opening toward an outside of the cartridge: a first chamber configured to store a liquid and positioned outside of the pipe: a second chamber in communication with the insertion space; an upper frame disposed between the pipe and the second chamber and comprising a connecting hole allowing communication between the second chamber and the insertion space: a lower frame disposed below the upper frame and configured to define the second chamber together with the upper frame: a wick provided in the second chamber and configured to be in communication with the first chamber through an opening between the upper frame and the lower frame: and a heater configured to heat the wick, wherein securing the pipe applies pressure to the upper frame toward the lower frame.

Advantageous Effects of Invention

According to at least one of embodiments of the present disclosure, it is possible to provide a cartridge and an aerosol-generating device including the cartridge, which are capable of improving convenience of assembly.

According to at least one of embodiments of the present disclosure, it is possible to provide a cartridge and an aerosol-generating device including the cartridge, which are capable of improving stability of coupling between components.

According to at least one of embodiments of the present disclosure, it is possible to provide a cartridge and an aerosol-generating device including the cartridge, which are capable of preventing leakage of liquid stored in the cartridge.

According to at least one of embodiments of the present disclosure, it is possible to provide a cartridge and an aerosol-generating device including the cartridge, which are capable of improving efficiency of airflow.

According to at least one of embodiments of the present disclosure, it is possible to provide an aerosol-generating device capable of preventing malfunction of a sensor configured to detect airflow.

According to at least one of embodiments of the present disclosure, it is possible to provide a cartridge and an aerosol-generating device including the cartridge, which are capable of improving efficiency of liquid storage.

Additional applications of the present disclosure will become apparent from the following detailed description. However, because various changes and modifications will be clearly understood by those skilled in the art within the spirit and scope of the present disclosure, it should be understood that the detailed description and specific embodiments, such as preferred embodiments of the present disclosure, are merely given by way of example.

BRIEF DESCRIPTION OF DRAWINGS

The above and other objects, features, and other advantages of the present disclosure will be more clearly understood from the following detailed description taken in conjunction with the accompanying drawings, in which:

FIGS. 1 to 41 are views showing examples of an aerosol-generating device according to embodiments of the present disclosure.

BEST MODE FOR CARRYING OUT THE INVENTION

Hereinafter, the embodiments disclosed in the present specification will be described in detail with reference to the accompanying drawings, and the same or similar elements are denoted by the same reference numerals even though they are depicted in different drawings, and redundant descriptions thereof will be omitted.

In the following description, with respect to constituent elements used in the following description, the suffixes "module" and "unit" are used only in consideration of facilitation of description, and do not have mutually distinguished meanings or functions.

In addition, in the following description of the embodiments disclosed in the present specification, a detailed description of known functions and configurations incorporated herein will be omitted when the same may make the subject matter of the embodiments disclosed in the present specification rather unclear. In addition, the accompanying drawings are provided only for a better understanding of the embodiments disclosed in the present specification and are not intended to limit the technical ideas disclosed in the present specification. Therefore, it should be understood that the accompanying drawings include all modifications, equivalents, and substitutions within the scope and sprit of the present disclosure.

It will be understood that although the terms "first", "second", etc., may be used herein to describe various components, these components should not be limited by these terms. These terms are only used to distinguish one component from another component.

It will be understood that when a component is referred to as being "connected to" or "coupled to" another component, it may be directly connected to or coupled to another component, or intervening components may be present. On the other hand, when a component is referred to as being "directly connected to" or "directly coupled to" another component, there are no intervening components present.

As used herein, the singular form is intended to include the plural forms as well, unless the context clearly indicates otherwise.

Referring to FIGS. 1 and 2, an aerosol-generating device according to the present disclosure may include at least one of a body 100, a cartridge 200, and a cap 300.

The body 100 may include at least one of a lower body 110 and an upper body 120. The lower body 110 may receive therein various components required for control or supply of power, such as a battery and a controller. The lower body 110 may determine the appearance of at least a portion of the aerosol-generating device. The upper body 120 may be disposed above the lower body 110. The cartridge 200 may be coupled to the upper body 120. The body 100 may be referred to as a main body 100.

The upper body 120 may include a mount 130 and a column 140. The mount 130 may be disposed on the lower body 110. The mount 130 may provide a mount space 135 in which the lower portion of the cartridge 200 is inserted. The mount 130 may be configured so as to be open at the upper side thereof and to surround the mount space 135. The mount 130 may surround the lower portion of the cartridge 200, which is inserted into the mount space 135. The cartridge 200 may be fastened to the mount 130. The mount 130 may support the lower portion of the cartridge 200.

The column 140 may be disposed on the lower body 110. The column 140 may have an elongate shape. The column 140 may extend upwards from one side of the mount 130. The column 140 may face a side wall of the cartridge 200. The column 140 may be disposed so as to be parallel to the cartridge 200. The column 140 may cover or support a side wall of the cartridge 200.

The cartridge 200 may be removably coupled to the body 100. The cartridge 200 may provide a space capable of storing liquid therein. The cartridge 200 may have therein an insertion space 214. The insertion space 214 may be open at the upper end thereof so as to define an opening. The insertion space 214 may be exposed to the outside through the opening. The opening may be defined as one end of the insertion space 214.

The cartridge 200 may include a container 205. The container 205 may define the appearance of the cartridge 200. The container 205 may define the insertion space 214, which is open at the upper side thereof and extends vertically. A stick 400 (see FIG. 31) may be inserted into the insertion space 214.

A cap 300 may be removably coupled to the body 100. The cap 300 may cover the cartridge 200. The cap 300 may cover at least a portion of the body 100. The cartridge 200 may be inserted into the cap 300. At least a portion of the body 100 may be inserted into the cap 300. The cap 300 may protect at least a portion of the cartridge 200 and/or the body 100 from the outside. A user is able to separate the cap 300 from the body 100 and replace the cartridge 200.

The cap 300 may be coupled to the upper portion of the body 100. The cap 300 may be coupled to the upper side of the lower body 110. The cap 300 may cover the upper body 120. The upper body 120 may be inserted into the cap 300. The side wall 301 of the cap 300 may surround the side portion of the cartridge 200. The side wall 301 of the cap 300 may surround the side portion of the upper body 120. The upper wall 303 of the cap 300 may cover the upper portion of the cartridge 200. The upper wall 303 of the cap 300 may cover the upper portion of the column 140.

The cap 300 may have an insertion opening. The upper wall 303 of the cap 300 may be opened so as to form the insertion opening 304. The insertion opening 304 may be formed at a position corresponding to the insertion space 214. The insertion opening 304 may be formed at the upper end of the insertion space 214. A cover 310 may be disposed adjacent to the insertion opening 304. The cover 310 may open and close the insertion opening.

Referring to FIG. 3, the cartridge 200 may include a first part 210. The cartridge 200 may include a second part 220. The cartridge 200 may include a third part 230. The second part 220 may be disposed between the first part 210 and the third part 230. A portion of the first part 210 may be disposed on the second part 220. The first part 210 may be coupled to the second part 220. The third part 230 may be disposed underneath the second part 220. The third part 230 may be coupled to the second part 220. The container 205 may be composed of the first part 210, the second part 220, and the third part 230, which are coupled to one another.

The first part 210 may cover the upper portion of the cartridge 200. A first part head 213 may cover the upper side of the second part 220. The first part head 213 may be open so as to form the insertion space 214. The first part head 213 may be open so as to form a cover groove 215. A portion of the insertion space 214 may be extended in one direction so as to form the cover groove 215.

The second part 220 may be configured to have a hollow shape. The second part 220 may surround the side portion of the internal space thereof. One surface of the second part 220 may be rounded. The periphery of the upper end of the second part 220 may be coupled to the periphery of the lower end of the first part head 213. The periphery of the lower end of the second part 220 may be coupled to the periphery of the upper end of the third part 230.

The third part 230 may be disposed underneath the second part 220. The third part 230 may provide a space in which a wick 246 (see FIG. 18) and a heater 247 (see FIG. 18) are mounted. The third part 230 may cover the lower portion of the cartridge 200.

Referring to FIGS. 3 and 4, one side of the outer wall of the container 205 may have a rounded convex shape. The other side of the outer wall of the container 205 may have a flat shape. The other side of the outer wall of the container 205 may be depressed toward the insertion space 214 so as to form depressed portions 226 and 236. One side of the column 140 may be inserted into the depressed portions 226 and 236.

One side of the outer wall 221 of the second part 220 may have a rounded convex shape. The other side of the outer wall 221 of the second part 220 may have a flat shape, and may be partially depressed so as to form the first depressed portion 226. A sloping portion 229 may be formed at the upper portion of the first depressed portion 226 by inclining the outer wall 221 of the second part 220.

One side of the side wall 231 of the third part 230 may have a rounded convex shape. The other side of the side wall 231 of the third part 230 may have a flat shape, and may be partially depressed so as to form the second depressed portion 236. The first depressed portion 226 may be continuous with the second depressed portion 236. The upper end of the second depressed portion 236 may be open, and may be connected to the lower end of the first depressed portion 226. The lower end of the second depressed portion 236 may be open.

The lower portion of the cartridge 200 may be open so as to form a cartridge inlet 234. Air outside the cartridge 200 may be introduced into the cartridge 200 through the cartridge inlet 234. The lower portion of the third part 230 may be opened so as to form the cartridge inlet 234.

Referring to FIGS. 5 and 6, the first part 210 may include a pipe 211 defining the insertion space 214. The pipe 211 may extend longitudinally in one direction. The pipe 211 may surround the insertion space 214. The two opposite ends of the pipe 211 may be open. The pipe 211 may have a cylindrical shape. The pipe 211 may be connected to the first part head 213. The pipe 211 may extend downwards from the first part head 213. The first part head 213 may be open so as to form an opening communicating with the insertion space 214.

An engagement portion 2112 may be formed at the lower portion of the pipe 211. One end of the pipe 211 may be depressed toward the insertion space 214 so as to form the engagement portion 2112. The engagement portion 2112 may include a portion that projects toward the insertion space 214 from the inner circumferential surface of the pipe 211 (see FIG. 16). The engagement portion 2112 may be formed between the pipe 211 and a recess portion 2113. The engagement portion 2112 may extend along the periphery of the pipe 211. The engagement portion may have a ring shape.

The recess portion 2113 may be formed at the lower portion of the pipe 211. The recess portion 2113 may have a cylindrical shape. The recess portion 2113 may constitute the lower end of the pipe 211. The lower end of the pipe 211 may be depressed toward the insertion space so as to form the recess portion 2113. The recess portion 2113 may have a diameter smaller than that of the pipe 211. The recess portion 2113 may extend vertically.

The cover groove 215 may be connected to one end or an opening of the insertion space 214. The upper end of the pipe 211 may be depressed in an outward direction of the insertion space 214 so as to form the cover groove 215. A portion of the insertion space 214 may be extended in one direction so as to form the cover groove 215. The first part head 214 may be depressed downwards so as to form the cover groove 215. A portion of the first part head 213 may surround at least a portion of the cover groove 215.

The second part 220 may have a hollow shape, and may have a second part space 225 therein. The second part 220 may have a tube shape, which is open at the upper and lower ends thereof. The outer wall 221 of the second part 220 may surround the side portion of the second part space 225. The pipe 211 may be inserted into the second part space 225. The first part head 213 may cover the upper portion of the second part space 225. The first part head 213 may be coupled to the upper end of the second part 220.

A first rim 227 may project upwards from the outer wall 221 of the second part 220. The first rim 227 may extend along the outer wall 221 of the second part 220. A first rim groove 218 may be depressed upwards from the lower end of the first part head 213. The first rim groove 218 may be adjacent to the edge of the first part head 213. The first rim groove 218 may have a shape corresponding to the first rim 227. The first rim 227 may be inserted into the first rim groove 218. The first rim 227 may be inserted into the first rim groove 218, and may be bonded to the first part head 213.

Consequently, the first part 210 may be coupled to the second part 220. The second part 220 may be supported by the first part 210 in all directions excluding the downward direction.

The third part 230 may have a third part space 235 therein. The third part space 235 may be open at the upper side thereof. The third part 230 may cover the side portion and the lower portion of the third part space 235. The lower portion of the third part 230 may be open so as to form the cartridge inlet 234. The cartridge inlet 234 may communicate with the third part space 235.

A second rim 237 may project upwards from the upper end of the side wall 231 of the third part 230. The second rim 237 may extend along the side wall 231 of the third part 230. A second rim groove 228 may be depressed from the lower end of the outer wall 221 of the second part 220. The second rim groove 228 may extend along the outer wall 221 of the second part 220. The second rim groove 228 may have a shape corresponding to the second rim 237. The second rim 237 may be inserted into the second rim groove 228. The second rim 237 may be inserted into the second rim groove 228, and may be bonded to the outer wall 221 of the second part 220.

The cartridge 200 may include a frame 240. The frame 240 may be disposed inside the third part 230. The third part 230 may support the frame 240. The frame 240 may have a space therein. The wick 246 may be mounted in the frame 240. A heater 247 configured to heat the wick 246 may be mounted in the frame 240. The frame 240 may include a chamber inlet 2414 and a connecting hole 2424. The frame 240 may support the first part 210. The frame 240 may support the lower end of the pipe 211. The frame 240 may be made of an elastic material. The frame 240 may be made of rubber or silicone.

The frame 240 may include a first frame 241 and a second frame 242. The first frame 241 may be coupled to the second frame 242. The second frame 242 may cover the first frame 241. The wick 246 may be disposed between the first frame 242 and the second frame 242. The first frame 241 may be referred to as a lower frame 241. The second frame 242 may be referred to as an upper frame 242.

One side of the first frame 241 may be open so as to form the chamber inlet 2414. The chamber inlet 2414 may communicate with the internal space of the frame 240. One side of the second frame 242 may be open so as to form the connecting hole 2424. The connecting hole 2424 may communicate with the internal space of the frame 240. Air may be introduced into the frame 240 through the chamber inlet 2414, and may be discharged to the outside of the frame 240 through the connecting hole 2424.

The connecting hole 2424 may communicate with the insertion space 214. The lower end of the pipe 211 may be inserted into the connecting hole 2424. The recess portion 2113 may be inserted into the connecting hole 2424. The second frame 242 may support the lower end of the pipe 211 around the connecting hole 2424.

The cartridge 200 may include a support 250. The support 250 may be disposed between the frame 240 and the pipe 211. The support 250 may cover the upper portion of the second frame 242. The support 250 may have therein a through hole 254. The connecting hole 2424 may be positioned in the through hole 254. The through hole 254 may have a diameter larger than that of the connecting hole 2424. The portion of the second frame 242 that constitutes the connecting hole 2424 may be inserted into the through hole 254. The lower surface of the support 250 may support the frame 240. The upper surface of the support 250 may support the first part 210. The engagement portion 2112 may be supported by the upper surface of the support 250. The through hole 254 may be referred to as a support hole 254.

The cartridge 200 may include a gasket 260. The gasket 260 may be disposed between the support 250 and the pipe 211. The gasket 260 may have a ring shape. The gasket 260 may be made of an elastic material. The gasket 260 may be made of rubber or silicone. The gasket 260 may be in close contact with the engagement portion 2112. The gasket 260 may be in close contact with the recess portion 2113.

Referring to FIGS. 7 to 9, the upper surface of a first frame body 2411 may be in contact with the lower surface of a second frame body 2421. The upper surface of the first frame body 2411 may be depressed downwards so as to form a first frame space 2415. The first frame space 2415 may be open at the upper side thereof.

One side of the first frame body 2411 may be open so as to form the chamber inlet 2414. The chamber inlet 2414 may communicate with the first frame space 2415. The bottom of the first frame space 2415 may be open so as to form the chamber inlet 2414.

A chamber inlet port 2413 may surround the side portion of the chamber inlet 2414. The chamber inlet port 2413 may include a portion that extends in the circumferential direction of the chamber inlet 2414. The chamber inlet port 2413 may project upwards from the bottom of the first frame space 2415. The upper end of the chamber inlet port 2413 may be positioned higher than the bottom of the first frame space 2415.

The first frame body 2411 may be depressed downwards so as to form a first wick groove 2416 around the first frame space 2415. The first wick groove 2416 may include a pair of first wick grooves 2416. The two ends of the wick 246 may be inserted into or be in close contact with respective ones of the pair of first wick grooves 2416.

One side of the first frame body 2411 may be open so as to form a heater insertion hole 2417. The bottom of the first frame space 2415 may be open so as to form the heater insertion hole 2417. The chamber inlet 2414 may be spaced apart from the heater insertion hole 2417. The heater insertion hole 2417 may include a pair of heater insertion holes. The heater 247 may be wound around the wick 246. The two ends of the heater 247 may be inserted into the pair of heater insertion holes 2417, and may be exposed to the outside of the first frame 241. Each of the two ends of the heater 247 may be inserted into a corresponding one of the pair of heater insertion holes 2417.

The lower portion of the first frame body 2411 may be depressed upwards so as to form a positioning groove 2418. The positioning groove 2418 may have a shape that extends longitudinally in one direction. The positioning groove 2418 may be connected to the chamber inlet 2414.

The lower surface of the second frame body 2421 may be in contact with the upper surface of the first frame body 2411. The thickness of the second frame body 2421 may be less than the thickness of the first frame body 2411. The lower surface of the second frame body 2421 may be depressed upwards so as to form a second frame space 2425. The second frame space 2425 may be open at the lower side thereof. The second frame space 2425 may be connected to the first frame space 2415. The second frame space 2425 may be connected to the first frame space 2415 so as to form a second chamber C2 (see FIG. 17).

The second frame body 2421 may be depressed upwards so as to form a frame cover 2422. The frame cover 2422 may project in an upward direction of the second frame body 2421. The frame cover 2422 may surround or cover one side of the second frame space 2425. The frame cover 2422 may be referred to as a chamber cover 2422.

One side of the frame cover 2422 may be open so as to form the connecting hole 2424. The connecting hole 2424 may communicate with the second frame space 2425. The upper portion of the second frame space 2425 may be open so as to form the connecting hole 2424.

The frame port 2423 may surround the connecting hole 2424. The frame port 2423 may extend upwards from the frame cover 2422. The frame port 2423 may have a cylindrical shape. The frame port 2423 may be open at the upper and lower sides thereof.

The second frame body 2421 may be depressed upwards so as to form a second wick groove 2426 around the second frame space 2425. The second wick groove 2426 may include a pair of wick grooves. The pair of wick grooves 2426 may be formed at positions corresponding to respective ones of the pair of first wick grooves 2416. The two ends of the wick 246 may be inserted into or be in close contact with respective ones of the pair of second wick grooves 2426. Each second wick groove 2426 may be connected to a corresponding one of the first wick grooves 2416 so as to form a hole. The ends of the wick 246 may extend through the hole defined between the first wick groove 2416 and the second wick groove 2426, and may be exposed to the outside.

Referring to FIGS. 10 to 12, the support 250 may cover the upper portion of the frame 240. A support body 251 may cover the upper portion of the second frame body 2421. A support cover 252 may cover the upper portion of the frame cover 2422.

The support cover 252 may be depressed upwards from the support body 251. The support cover 252 may project upwards from the support body 251. The support cover 252 may surround one side of the support space 255. The support cover 252 may surround the frame cover 2422.

The support body 251 may be depressed upwards so as to form the support space 255. The support space 255 may be open at the lower side thereof. The support space 255 may be surrounded by the support cover 252. The frame cover 2422 may be disposed in or inserted into the support space 255.

A support port 253 may extend upwards from the support cover 252. The support port 253 may surround the periphery of the support hole 254. The support port 253 may be open at the upper and lower sides thereof. The support port 253 may have a cylindrical shape. The support hole 254 may communicate with the support space 255.

The frame port 2423 may be inserted into the support hole 254 formed in the support port 253. The connecting hole 2424 may be disposed in the support port 253 and the support hole 254. The support port 253 may have a diameter larger than that of the frame port 2423. The inner circumferential surface of the support port 253 may be in close contact with the outer circumferential surface of the frame port 2423.

The gasket 260 may have the shape of a ring having an internal space. The gasket 260 may be made of an elastic material. The gasket 260 may be made of rubber. A gasket hole 264 may be defined as the internal space in the gasket 260. The gasket 260 may surround the side portion of the gasket hole 264. The gasket hole 264 may be open at the upper and lower sides thereof.

The support port 253 may extend through the gasket hole 264. The gasket 260 may extend along the periphery of the support port 253. The gasket 260 may be in close contact with the periphery of the support port 253. The gasket 260 may be in close contact with the upper side of the support cover 252. The gasket 260 may be in close contact with the region between the support port 253 and the support cover 252.

The support body 251 may be depressed upwards so as to form a third wick groove 256 around the support space 255. The third wick groove 256 may include a pair of wick grooves. The two ends of the wick 246 may be in close contact with respective ones of the pair of third wick grooves 256.

Referring to FIGS. 13 to 15, the frame 240 may be disposed in the third part space 235. The third part space 235 may be open at the upper portion thereof. The side wall 231 of the third part 230 may surround the side portion of the third part space 235. The bottom 232 of the third part 230 may cover the lower portion of the third part space 235. The frame 240 may be inserted downwards into the third part space 235.

A support wall 233 may extend upwards from the bottom of the third part 230. The support wall 233 may partition the third part space 235 into a frame reception space 2351 and a wick exposure space 2352. The support wall 233 may include a plurality of support walls. The support wall 233 may include a pair of support walls. The pair of support walls 233 may be oriented parallel to each other. The frame reception space 2351 may be positioned between the pair of support walls 233. The wick exposure space 2352 may include a pair of wick exposure spaces. The frame reception space 2351 may be disposed between the pair of wick exposure spaces 2352. The frame reception space 2351 may be open at the upper side thereof. The wick exposure space 2352 may be open at the upper side thereof.

The first frame 241 may be inserted into or disposed in the frame reception space 2351 between the pair of support walls 233. The support walls 233 may cover or support the side portion of the first frame 241. The support walls 233 may cover or support two opposite side portions of the first frame 241. The support walls 233 may be disposed parallel to the side portion of the first frame 241. The bottom 232 of the third part 230 may cover or support the lower portion of the first frame 241 in the frame reception space 2351.

The upper ends of the support walls 233 may be in close contact with the lower end of the periphery of the support 250. The support 250 may not cover the upper sides of the wick exposure spaces 2352. The upper ends of the support walls 233 may be depressed downwards so as to form fourth wick grooves 2336. The fourth wick grooves 2336 may include a pair of wick grooves. The pair of fourth wick grooves 2336 may be formed in respective ones of the pair of support walls 233. The pair of fourth wick grooves 2336 may be formed at positions corresponding to respective ones of the pair of third wick grooves 256 (see FIG. 11).

The fourth wick grooves 2336 may be connected to the third wick grooves 256 so as to form holes. The two ends of the wick 246 may extend through the holes defined between the third wick grooves 256 and the fourth wick grooves 2336, and may be disposed in or exposed to the wick exposure spaces 2352. The two ends of the wick 246 may be disposed in or exposed to respective ones of the pair of wick exposure spaces 2352. The center of the wick 246 may be positioned between the pair of support walls 233.

The bottom 232 of the third part 230 may be opened so as to form the cartridge inlet 234. The cartridge inlet 234 may be disposed between the pair of support walls 233. The cartridge inlet 234 may communicate with the frame reception space 2351. The cartridge inlet port 2343 may surround the side portion of the cartridge inlet 234. The cartridge inlet port 2343 may extend upwards from the bottom 232 of the third part 230. The upper end of the cartridge inlet port 2343 may be positioned higher than the bottom 232 of the third part 230. The cartridge inlet port 2343 may be inserted into the chamber inlet 2414. The outer circumferential surface of the cartridge inlet port 2343 may be in close contact with the inner circumferential surface of the chamber inlet port 2413. The cartridge inlet 234 may be disposed lower than the chamber inlet 2414. The cartridge inlet 234 may communicate with the chamber inlet 2414.

A positioning protrusion 238 may project upwards from the bottom 232 of the third part 230. The positioning protrusion 238 may extend longitudinally in one direction. The positioning protrusion 238 may have a shape corresponding to the positioning groove 2418. The positioning protrusion 238 may be connected to the cartridge inlet port 2343. The positioning protrusion 238 may be inserted into the positioning groove 2418, and may be in close contact with the first frame 241.

A heater terminal 239 may be formed on the bottom 232 of the third part 230. The heater terminal 239 may be exposed to the frame reception space 2351. The heater terminal 239 may be exposed to the lower side of the third part 230. The heater terminal 239 may be in contact with the heater 247. The heater terminal 239 may electrically connect a battery or a controller (not shown) to the heater 247.

The second rim 237 may project or extend upwards from the side wall 231 of the third part 230. The second rim 237 may extend along the side wall 231 of the third part 230. The second rim 237 may be formed at the edge of the upper end of the third part 230. The second rim 237 may surround the side portion of the upper end of the third part space 235.

Referring to FIGS. 16 and 17, the second part 220 may be coupled to the first part 210. The second part 220 may be coupled to the third part 230.

The first rim 227 of the second part 220 may be inserted into the first rim groove 218 in the first part 210. The first part 210 may surround the first rim 227 near the first rim groove 218, and may be in close contact therewith. The first part 210 may support the inner circumferential surface, the outer circumferential surface, and the upper surface of the first rim 227 near the first rim groove 218. The first rim 227 may support the lower portion of the periphery of the first part head 213. The first rim 227 may be bonded to the first part head 213 in the state of being inserted into the first rim groove 218.

The second rim 237 of the third part 230 may be inserted into the second rim groove 228 in the second part 220. The second part 220 may surround the second rim 237 near the second rim groove 228, and may be in close contact therewith. The second part 230 may support the inner circumferential surface, the outer circumferential surface, and the upper surface of the second rim 237 near the second rim groove 228. The second rim 237 may support the lower end of the outer wall 221 of the second part 220. The second rim 237 may be bonded to the outer wall 221 of the second part 220 in the state of being inserted into the second rim groove 228.

The container 205 may be composed of the first part 210, the second part 220, and the third part 230, which are coupled to one another. The container 205 may have a first chamber C1 and the insertion space 214 therein. The first chamber C1 and the insertion space 214 may be isolated from each other by means of the pipe 211. The insertion space 214 may be positioned inside the pipe 211. The first chamber C1 may be positioned outside the pipe 211. The first chamber C1 may store liquid therein. The stick 400 (see FIG. 31) may be inserted into the insertion space 214.

The first chamber C1 may be surrounded by the first part 210, the second part 220, and the third part 230. The first part 213 may cover the upper end of the first chamber C1. The pipe 211 may cover at least a portion of the inner circumferential surface of the first chamber C1. The outer wall 221 of the second part 220 may cover at least a portion of the outer circumferential surface of the first chamber C1. When the first part 210, the second part 220, and the third part 230 are coupled to one another, the wick exposure spaces 2352 may constitute the lower portion of the first chamber C1.

The second chamber C2 may be formed when the first frame space 2415 is connected to the second frame space 2425. The second chamber C2 may be surrounded by the first frame body 2411 and the second frame body 2421. The chamber inlet 2414 may communicate with the second chamber C2. The connecting hole 2424 may communicate with the second chamber C2.

The wick 246 may be mounted in the second chamber C2. The wick 246 may be connected to the first chamber C1. The liquid stored in the first chamber C1 may be supplied to the wick 246. When the wick 246, to which the liquid is supplied, is heated by the heater 247, an aerosol may form in the second chamber C2. Air may be introduced into the second chamber C2 through the cartridge inlet 234 and the chamber inlet 2414. The air that is introduced into the second chamber C2 may be mixed with the aerosol that is generated in the second chamber C2, and may be supplied to the insertion space 214 through the connecting hole 2424.

When the first part 210, the second part 220, and the third part 230 are coupled to one another, the support 250 may support the lower end of the pipe 211. The gasket 260 may be disposed or interposed between the lower end of the pipe 211 and the support 250. The pipe 211 may press the support 250 downwards.

The engagement portion 2112 may project toward the insertion space 214 from the lower end of the pipe 211. The engagement portion 2112 may project toward the insertion space 214 from the inner circumferential surface of the pipe 211. The engagement portion 2112 may extend along the inner circumferential surface of the pipe 211. The engagement portion 2112 may have a ring shape. The engagement portion 2112 may be in contact or close contact with the upper end of the support port 253. The support port 253 may support the engagement portion 2112. When the first part 210, the second part 220, and the third part 230 are coupled to one another, the engagement portion 2112 may press the support port 253 downwards.

The recess portion 2113 may project downwards from the engagement portion 2113. The recess portion 2113 may have a cylindrical shape. The recess portion 2113 may be in contact or close contact with the outer circumferential surface of the support port 253. The recess portion 2113 may be in contact or close contact with the upper portion of the gasket 260. The gasket 260 may extend along the periphery of the recess portion 2113. When the first part 210, the second part 220, and the third part 230 are coupled to one another, the recess portion 2113 may press the gasket 260 and the support port 252 downwards. The gasket 260 may be in close contact with the support cover 252, the support port 253, and the lower end of the recess portion 2113. The gasket 260 may seal the gap between the inner circumferential surface of the recess portion 2113 and the outer circumferential surface of the support port 253.

The first frame 241 may be made of an elastic material. The second frame 242 may be made of an elastic material. The gasket 260 may be made of an elastic material. The elastic material may be rubber.

The lower end of the pipe 211 may press the gasket 260 downwards. When the gasket 260 is pressed, the gasket 260 may be deformed in shape due to the elasticity thereof. The gasket 260 may apply downward force to the support 250 due to the restoring force thereof. The lower end of the pipe 211 and the gasket 260 may press the support cover 252 near the support port 253 downwards. A portion of the support cover 252 near the support port 253 may be deformed in shape downwards toward the support space 255 (see FIG. 11) and the upper side of the second frame 242. The support 250 may be pressed to the first frame 241, and the first frame 241 and the second frame 242 may be pressed downwards such that the first frame 241 and the second frame 242 are pressed to each other. The support 250 may be pressed to the upper end of the support wall 233. The support wall 233 may support the support 250. The ends of the wick 246 may be in close contact with the first wick groove 2416, the second wick groove 2426, the third wick groove 256, and the fourth wick groove 2336.

Accordingly, the first chamber C1 configured to store liquid therein may be disposed so as to surround the stick 400 (see FIG. 31) and/or the insertion space 214 into which the stick 400 is inserted, thereby improving the efficiency of use of the space configured to store liquid therein.

In addition, because the distance between the stick 400 and the wick 246 connected to the first chamber C1 and the heater 247 is reduced, it is possible to improve efficiency in heat transfer of aerosol.

Furthermore, it is possible to prevent the liquid stored in the first chamber C1 from leaking to the outside of the second chamber C2 and the cartridge 200 through the gap between the assembled components.

In addition, it is possible to minimize a bonded area and the number of components and to improve convenience of assembly.

Furthermore, it is possible to increase the rigidity of the region to which the cartridge 200 is coupled.

Referring to FIG. 18, the cartridge inlet 234 and the chamber inlet 2424 may be aligned with each other. The wick 246 may be aligned with the connecting hole 2424. The connecting hole 2424 and the insertion space 214 may be aligned with each other.

The chamber may be misaligned with the wick 246. The chamber inlet 2414 may be misaligned with the connecting hole 2424. The chamber inlet 2414 may be misaligned with the insertion space 214. The chamber inlet 2414 may be deviated in one direction based on the second chamber C2. The chamber inlet 2424 may be deviated toward the column 140.

The chamber inlet port 2413 may extend upwards from the bottom of the second chamber C2. The upper end of the chamber inlet port 2413 may be positioned higher than the bottom of the second chamber C2.

Consequently, it is possible to prevent the liquid droplets generated in the second chamber C2 from leaking out of the cartridge 200 through the cartridge inlet 234.

In addition, even when a user inclines the aerosol-generating device including the cartridge 200 while performing a sucking action, the liquid droplets may drop toward the bottom of the second chamber C2 from the wick 246 and may be collected thereon, thereby preventing the liquid droplets from moving to the chamber inlet 2414.

Referring to FIGS. 17 and 18, a portion of the insertion space 214 may be extended toward the outside so as to form the cover groove 215. The cover groove 215 may be adjacent to the opening in the upper end of the insertion space 214. The cover groove 215 may be formed by extending the insertion space 214 and by depressing the pipe 211 toward the first chamber C1. The cover groove 215 may extend from the insertion space 214 in the direction in which the periphery of the insertion space 214 is enlarged. The cover groove 215 may be connected to the insertion space 214. The cover groove 215 may extend radially outwards from the insertion space 214. The first part head 213 or the pipe 211 may surround one side of the cover groove 215. The cover groove 215 may be formed by downward depression of the first part head 213. The cover 310 may open the insertion space 214, and may be received in or inserted into the cover groove 215 (see FIG. 27).

A first guide 216 may abut the bottom of the cover groove 215. The first guide 216 may be formed at the upper end of the pipe 211, at which the pipe 211 abuts the bottom of the cover groove 215. The first guide 216 may be formed between the bottom of the cover groove 215 and the insertion space 214. The first guide 216 may be positioned underneath the cover groove 215. The first guide 216 may be inclined toward the lower side of the insertion space 214 from the bottom of the cover groove 215.

The first guide 216 may extend circumferentially along at least a portion of the periphery of the insertion space 214. The first guide 216 may extend circumferentially along at least a portion of the periphery of the pipe 211. The first guide 216 may come into contact with the end of the stick 400 to guide the stick 400 into the insertion space 214 (see FIG. 30).

A second guide 217 may be formed at the upper end of the pipe 211. The second guide 217 may be formed at a position corresponding to the first guide 216 based on the insertion space 214. A portion of the inner circumferential surface of the pipe 211 may be sloped so as to form the second guide 217. The second guide 217 may obliquely extend toward the lower side of the insertion space 214 from one side of the first part head 213. One end of the second guide 217 may be positioned higher than the first guide 216.

The second guide 217 may extend circumferentially along at least a portion of the periphery of the insertion space 214. The second guide 217 may extend circumferentially along at least a portion of the periphery of the pipe 211. The second guide 216 may come into contact with the end of the stick 400 to guide the stick 400 into the insertion space 214 (see FIG. 29).

A stick stopper 219 may project inwards from the periphery of the insertion space 214 at a position near the lower end of the insertion space 214. The stick stopper 219 may project radially inwards. The stick stopper 219 may project toward the insertion space 214 from the inner circumferential surface of the pipe 211.

The stick stopper 219 may include a plurality of stick stoppers. The plurality of stick stoppers 219 may include three stick stoppers. The plurality of stick stoppers 219 may be arranged along the periphery of the insertion space 214. The stick stoppers 219 may be arranged circumferentially. The stick stoppers 219 may be spaced apart from each other. Each of the stick stoppers 219 may have a rib or ring shape, which extends circumferentially along the periphery of the insertion space 214 (see FIG. 31).

Referring to FIGS. 19 to 22, the cartridge 200 may be removably coupled to the upper body 120. The upper body 120 may be disposed on the lower body 110. The upper body 120 may include the mount 130. The upper body 120 may include the column 140.

The mount 130 may have the mount space 135, which is open at the upper portion thereof. The inner surface 131 and the bottom 133 of the mount 130 may surround at least a portion of the mount space 135. The inner wall 141 of the column 140 may face or cover one side of the mount space 135. The third part 230 may be inserted into the mount space 135. The mount 130 may surround the third part 230 inserted into the mount space 135. When the third part 230 is coupled to the mount 130, the first part 210 and the second part 220 may be disposed above the mount 130.

The cartridge 200 may be coupled to the mount 130 in a snap-fit manner. The third part 230 may be removably fastened to the mount 130. When the third part 230 is inserted into the mount space 135, a coupling groove 231*a* formed in the third part 230 may be engaged with a coupling protrusion 131*a* formed on the mount 130.

The coupling groove 231*a* may be formed by inward depression of the side wall 231 of the third part 230. The coupling groove 231*a* may include a plurality of coupling grooves, which are formed in two sides of the side wall 231 of the third part 230.

The coupling protrusion 131*a* may be formed by projection of the inner surface 131 of the mount 130. The coupling protrusion 131*a* may include a plurality of coupling protrusions, which are formed on two sides of the inner surface 131 of the mount 130. The coupling protrusions 131*a* may be formed at positions corresponding to respective ones of the coupling grooves 231*a*.

The mount 130 may support the lower portion of the cartridge 200. The mount 130 may support the side wall 231 and the bottom 232 of the third part 230. The mount 130 may support the periphery of the lower portion of the outer wall 221 of the second part 220.

The column 140 may extend upwards from one side of the mount 130. The column 140 may face or cover one side of the mount space 135. The outer surface 142 of the column 140 may be integrally formed with the outer surface 132 of the mount 130, and may extend therefrom. The column 140 may extend to a height corresponding to the height of the cartridge 200. The upper wall 143 of the column 140 may be formed at a height corresponding to the upper end of the cartridge 200. The column 140 may be formed parallel to the cartridge 200. The inner wall 141 of the column 140 may face or support one side wall of the cartridge 200.

A sensor reception portion 145 may project toward the cartridge 200 or the mount space 135 from the inner wall 141 of the column 140. The sensor reception portion 145 may extend upwards along the column 140 from the bottom of the mount 130. The upper portion of the sensor reception portion 145 may be inclined upwards. The sensor reception portion 145 may be inserted into the depressed portion 226. The upper portion of the sensor reception portion 145 may face the sloping portion 229.

A light source 153 (see FIG. 26) may be mounted in the column 140. The light source 153 may be mounted on the inner wall 141 of the column 140 so as to face the cartridge 200. The light source 153 may be disposed at an upper side of the sensor reception portion 145. A first sensor 155 may be mounted in the sensor reception portion 145. The first sensor 155 may be mounted to the upper portion of the sensor reception portion 145. The sensor reception portion 145 may surround the first sensor 155. A second sensor 157 (see FIG. 26) may be mounted in the sensor reception portion 145. The second sensor 157 may be mounted in the column 140. The second sensor 157 may be mounted to the lower portion of the sensor reception portion 145 (see FIG. 26). The sensor reception portion 145 may surround the second sensor 157.

The cartridge inlet 234 may communicate with a mount hole 134. The cartridge inlet port 2343, which defines the cartridge inlet 234, may project downwards from the bottom 232 of the third part 230. The cartridge inlet port 2343 may be inserted into the mount hole 134.

Consequently, the cartridge 200 may be removably coupled to the body 100.

The cartridge 200 may be coupled to the body 100, and may thus be stably supported thereby.

The inner wall 141 of the column 140 may be depressed so as to form a first channel groove 141*a*. The first channel groove 141*a* may extend vertically along the column 140. The first channel groove 141*a* may be formed parallel to the column 140. The first channel groove 141*a* may extend downwards beyond the bottom 133 of the mount 130 from the upper wall 143 of the column 140. The upper side of the first channel groove 141*a* may be open.

The first channel groove 141*a* may include a plurality of first channel grooves. The first channel grooves 141*a* may be formed at two lateral sides, with the sensor reception portion 145 interposed therebetween. The first channel grooves 141*a* may be formed in a region other than the sensor reception portion 145. The first channel grooves 141*a* may be spaced apart from the sensor reception portion 145. The first channel grooves 141*a* may be formed parallel to the sensor reception portion 145.

When the cartridge 200 is coupled to the upper body 120, the first channel grooves 141*a* may be positioned between one side wall of the cartridge 200 and the inner wall 141 of the column 140. A first channel P1 may be defined as the path defined by the first channel groove 141*a* between one side wall of the cartridge 200 and the inner wall 141 of the column 140. The first channel P1 may be formed between the cartridge 200 and the column 140. The first channel P1 may extend vertically along the column 140. The first channel P1 may be open at the upper side thereof. The first channel P1 may communicate with the cartridge inlet 234 and the mount hole 134. The first channel P1 may allow the outside to communicate with the cartridge inlet 234.

Referring to FIGS. 23 to 25, the cap 300 may be removably coupled to the body 100. The cap 300 may be coupled to the body 100 in a snap-fit manner. The cap 300 may protect the cartridge 200 and a portion of the body 100 from the outside. A user may separate the cap from the body 100, and may replace the cartridge 200.

A coupling protrusion 132*a* may be formed on the outer surfaces 132 and 142 of the upper body 120. The coupling protrusion 132*a* may include a plurality of coupling protrusions. The coupling protrusions 132*a* may be formed at two lateral sides of the upper body 120. The coupling protrusions 132*a* may project in a convex or round shape. One of the plurality of coupling protrusions 132*a* may project outwards from the outer surface 132 of the mount 130. The coupling protrusions 132*a* may be formed on the outer surface 142 of the column 140.

A coupling groove 302*a* may be formed by outwardly depressing the inner surface 302 of the cap 300. The coupling groove 302*a* may be formed in two lateral sides of the cap 300. The coupling groove 302*a* may be formed in a convex or round shape. The coupling groove 302*a* may include a plurality of coupling grooves 302*a*. The coupling grooves 302*a* may be formed at positions corresponding to respective ones of the coupling protrusions 132*a*. The coupling protrusions 132*a* may be inserted into the coupling grooves 302*a*. When the cap 300 covers the cartridge 200 and the upper body 120, the coupling protrusions 132*a* and the coupling grooves 302*a* are engaged with each other, thereby coupling the cap to the upper body 120. When the coupling protrusions 132*a* are inserted into the coupling grooves 302*a*, the coupling protrusions 132*a* and the coupling grooves 302*a* may guide the cap 300 to the normal position.

The upper-end periphery 113 of the lower body 110 may project further outwards than the upper body 120. The upper-end periphery 113 of the lower body 110 may extend along the periphery of the upper body 120. The upper-end periphery 113 of the lower body 110 may be disposed underneath the upper body 120. When the cap 300 is coupled to the body 100, the lower end of the side wall 301 of the cap 300 may be brought into contact with the upper-end periphery 113 of the lower body 110. The upper-end periphery 113 of the lower body 110 may restrict the downward movement of the cap 300 beyond the lower end of the upper body 120.

Referring to FIG. 26, the cartridge 200 may be coupled to the body 100. The cartridge 200 may have the first chamber C1 configured to store liquid therein. The cartridge 200 may have the insertion space 214 isolated from the first chamber C1. The pipe 211 may partition the internal space in the container 205 into the first chamber C1 and the insertion space 214. The cartridge 200 may have an opening formed in one end of the insertion space 214. The opening may expose the insertion space 214 to the outside.

The lower body 110 may receive a battery 190 therein. The lower body 110 may receive various controllers therein. The battery 190 may supply power to various components of the aerosol-generating device. The controllers may control the operation of the various components of the aerosol-generating device.

A second channel P2 may be formed underneath the cartridge 200. The second channel P2 may be formed in the mount 130. The second channel P2 may be formed between the cartridge inlet 234 and the lower end of the first channel P1. The second channel P2 may connect the cartridge inlet 234 to the lower end of the first channel P1.

The wick 246 may be mounted in the second chamber C2. The wick 246 may be connected to the first chamber C1. The wick 246 may receive liquid from the first chamber C1. The heater 247 may heat the wick 246. The heater 247 may be mounted in the second chamber C2. The heater 247 may be wound around the wick 246 multiple turns. The heater 247 may be electrically connected to the battery 190 and/or the controller. The heater 247 may be a resistive coil. When the heater 247 is activated to heat the wick 246, the liquid supplied to the wick 246 is atomized, thereby generating an aerosol in the second chamber C2.

A printed circuit board (PCB) assembly 150 may be mounted in the column 140. The PCB assembly 150 may include a PCB 151. The PCB assembly 150 may include the light source 153. The PCB assembly 150 may include the first sensor 155. The PCB assembly 150 may include the second sensor 157. The light source 153 may be mounted on the PCB 151. The first sensor 155 may be mounted on the PCB 151. The second sensor 157 may be mounted on the PCB 151. The light source 153, the first sensor 155, and the second sensor 157 may be mounted on a single PCB 151. The PCB assembly 150 may extend along the column 140.

The light source 153 may be mounted in the column 140. The light source 153 may be mounted on the inner wall 141 of the column 140 so as to face the cartridge 200. The light source 153 may be disposed above the sensor reception portion 145. The light source 153 may provide the first chamber C1 with light. The light source 153 may be an LED.

Accordingly, it is possible to check the amount of liquid remaining in the cartridge 200 and the condition of the stick 400 (see FIG. 31), even in the dark.

In addition, various designs for the aerosol-generating device may be provided by virtue of the light emitted from the light source 153.

The first sensor 155 may be mounted in the column 140 and the sensor reception portion 145. The first sensor 1550 may be mounted on the upper portion of the sensor reception portion 145. The first sensor 155 may be disposed below the light source 153. The first sensor 155 may be oriented so as to face the insertion space 214. The first sensor 155 may be oriented so as to be inclined upwards.

The first sensor 155 may detect information about the cartridge 200. For example, the first sensor 155 may detect at least one of information about variation in the remaining amount of the liquid stored in the first chamber C1 of the cartridge 200, information about the kind of the liquid stored in the first chamber C1 of the cartridge 200, information about whether or not the stick 400 (see FIG. 31) is inserted into the insertion space 214 in the cartridge 200, information about the kind of the stick 400 inserted into the insertion space 214 in the cartridge 200, information about the used amount or the remaining amount of the stick 400 inserted into the insertion space 214 in the cartridge 200, information about whether or not the cartridge 200 inserted into the insertion space 214 of the cartridge 200 is coupled to the body 100, and information about the kind of cartridge 200 coupled to the body 100. The information about the cartridge 200 is not limited thereto.

The first sensor 155 may detect variation in the electromagnetic characteristics of the cartridge 200, and may thus detect the information about the cartridge 200. The first sensor 155 may detect variation in electromagnetic characteristics caused by an adjacent object. The first sensor 155 may be, for example, a capacitance sensor. The first sensor 155 may be, for example, a magnetic proximity sensor. The kind of the first sensor 155 is not limited thereto. For example, when the stick 400 is inserted into the insertion space 214 in the cartridge 200 or when the amount of the liquid stored in the first chamber C1 varies, variation in the electromagnetic characteristics detected by the first sensor 155 occurs, and the first sensor 155 may measure the variation to detect the information about the cartridge 200.

The second sensor 157 may be mounted in the column 140 and the sensor reception portion 145. The second sensor 157 may be mounted on the lower portion of the sensor reception portion 145. The second sensor 157 may be disposed below the first sensor 155. The first sensor 155 may detect the flow of air. The second sensor 157 may detect the flow of air introduced into the cartridge inlet 234. The second sensor 157 may be a pressure sensor or an airflow sensor. The second sensor 157 may face one side of the cartridge 200.

The second sensor 157 may detect the flow of air flowing through a third channel P3 communicating with the second channel P2. The second sensor 157 may be disposed upstream of the second chamber C2 and the cartridge inlet 234.

Accordingly, it is possible to detect various information about the aerosol-generating device and to improve user convenience.

Referring to FIGS. 26 and 27, the cover 310 may open and close the insertion space 214. The cover 310 may open and close the opening through which the insertion space 214 is exposed to the outside. The cover 310 may be mounted adjacent to the opening of the insertion space 214. The cover 310 may be mounted adjacent to the upper end of the insertion space 214. For example, the cover 310 may be mounted on the first part 210 adjacent to the upper end of the insertion space 214. For example, the cover 310 may be mounted on the cap 300 adjacent to the upper end of the insertion space 214.

The cover 310 may be pivotably mounted. The cover 310 may be pivoted so as to open and close the insertion space 214. The cover 310 may be pivoted toward the inside or the lower side of the insertion space 214 so as to open the insertion space 214. The direction in which the cover 310 is pivoted so as to open the insertion space 214 may be referred to as a first direction. The cover 310 may be pivoted toward the outside or the upper side of the insertion space 214 so as to close the insertion space 214. The direction in which the cover 310 is pivoted so as to close the insertion space 214 may be referred to as a second direction.

The cover 310 may be mounted near the insertion opening 304 in the cap 300. The cover 310 may be pivotably mounted on the cap 300. The cover 310 may be pivoted so as to open and close the insertion opening 304. The cover 310 may be pivoted in the first direction so as to open the insertion opening. The cover 310 may be pivoted in the second direction so as to close the insertion opening 304.

A spring 312 may provide the cover 310 with elastic force in the second direction. The spring 312 may support at one end thereof the cover 310 and at the other end thereof the first part 210 or the cap 300. The spring 312 may be wound around a pivot shaft 311 of the cover 310.

Referring to FIGS. 28 to 31, when the end of the stick 400 is brought into contact with the cover 310 and pushes the cover 310, the cover 310 is pivoted in the first direction so as to open the insertion space 214. The stick 400 may be inserted into the insertion space 214 while pushing the cover 310. When the stick 400 is separated from the insertion space 214, the cover 310 is pivoted in the second direction so as to close the insertion space 214.

The stick 400 may be inserted into the insertion space 214 through the insertion opening 304. When one end of the stick 400 is brought into contact with the cover 310 and thus pushes the cover 310, the cover 310 may be pivoted in the first direction so as to open the insertion space 214 and the insertion opening 304. The stick 400 may pass through the insertion opening 304 while pushing the cover 310. When the stick 400 is separated from the insertion space 214, the cover 310 may be pivoted in the second direction so as to close the insertion space 214 and the insertion opening 304.

When the stick 400 is inserted into the insertion space 214, one end of the stick 400 may be exposed to the outside of the cap 300, and the other end of the stick 400 may be disposed immediately above the second chamber C2. A user may inhale air while holding the one end of the stick 400 in his/her mouth.

The cap 300 may include an insertion opening wall 305 constituting the periphery of the insertion opening 304. The insertion opening wall 305 may have a shape that extends circumferentially. The inner circumferential surface of the insertion opening wall 305 may surround the periphery of the insertion opening 304.

The inner circumferential surface of the insertion opening wall 305 may be rounded. The inner circumferential surface of the insertion opening wall 305 may be convex or rounded inwards toward the insertion opening 304. The inner circumferential surface of the insertion opening wall 305 may become narrow and then wide moving downwards from above.

The end or the periphery of the cover 310 may catch on the lower side of the insertion opening wall 305. When the cover 310 closes the insertion opening 304, the insertion opening wall 305 may be brought into contact with the cover 310, thus limiting the movement of the cover 310. In other words, the insertion opening wall 305 may be brought into contact with the end or the periphery of the cover 310, thus limiting pivoting movement of the cover 310 upwards from the insertion opening 304. The cover 310 may have a size larger than that of the insertion opening 304.

Referring to FIGS. 28 and 29, when the end of the stick 400 passes through the insertion opening 304, the end of the stick 400 may be brought into contact with the insertion opening wall 305. When the end of the stick 400 is brought into contact with the insertion opening wall 305, the insertion opening wall 305 may guide the stick 400 to the normal position in the insertion opening 304. When the stick 400 passes through the insertion opening 304, the end of the stick 400 may push the cover 310, thus pivoting the cover 310 in the first direction.

Referring to FIGS. 29 and 30, when the stick 400 passes through the insertion opening 304, the cover 310 may be pivoted in the first direction, and may be received or inserted into the cover groove 215. At this time, the cover 310 may overlap the pipe 211.

Referring to FIGS. 30 and 31, the stick 400 may be inserted into the insertion space 214 while sliding along the surface of the cover 310. The second guide 217 may be disposed at a position opposed to the pivot shaft of the cover 310 based on the insertion opening 304. The second guide 217 may be disposed at a position opposed to the cover groove 215.

When the stick 400 is inserted into the insertion space 214, the end of the stick 400 may be brought into contact with the second guide 217. When the end of the stick 400 is brought into contact with the second guide 217, the second guide 217 may guide the stick 400 to the normal position in the insertion space 214.

The first guide 216 may be disposed at a position that is opposed to the second guide 217. The first guide 216 may be disposed lower than the second guide 217. The first guide 216 may be disposed at the lower side of the cover groove 215. The first guide 216 may be disposed below the cover 310. The first guide 216 may extend circumferentially along the inner circumferential surface of the pipe 211. When the stick 400 is inserted into the insertion space 214, the end of the stick 400 may be brought into contact with the first guide 216. The end of the stick 400 may be first brought into contact with the second guide 217 so as to be positioned, and may then be brought into contact with the first guide 216. When the end of the stick 400 is brought into contact with the first guide 216, the first guide 216 may guide the stick 400 to the normal position in the insertion space 214.

When the stick 400 is inserted into the insertion space 214, the end of the stick 400 may be brought into contact with the stick stopper 219. The stick stopper 219 may be brought into contact with the end of the stick 400, thus restricting the downward movement of the stick 400 beyond the insertion space 214 or into the second chamber C2.

Accordingly, the stick 400, which is inserted into the insertion space 214, may pivot the cover 310, whereby the cover 310 opens the insertion space 214.

Furthermore, when a user pushes the cover 310 using the stick 400, the stick 400 may be guided to the normal position thereof so as to allow the stick 400 to smoothly pass through the insertion opening 304. Even when the cover 310 applies external force to the end of the stick 400 in the second direction, the stick 400 may be guide so as to be precisely inserted into the insertion space 214.

Furthermore, even when stick 400 pushes the cover 310, thus causing the cover 310 to be disposed in the insertion space 214, the cover 310 may be received in the cover groove 215, whereby the stick 400 may be brought into close contact with the wall defining the insertion space 214. Accordingly, when a user inhales air through the stick 400, it is possible to prevent air from unnecessarily flowing between the wall of the insertion space 214 and the stick 400.

In addition, it is possible to restrict movement of the stick 400 into the second chamber C2.

Furthermore, because the cover 310 is pivoted when the stick 400 is separated from the insertion space 214, it is possible to automatically close the insertion space 214.

In addition, it is possible to protect the interior of the insertion space 214 from external contaminants.

Referring to FIG. 32, the upper body 120 may be coupled to the upper portion of the lower body 110. The mount 130 may cover the upper portion of the lower body 110. The lower portion of the mount 130 may be surrounded by the upper portion of the side wall 111 of the lower body 110. The mount 130 may be coupled to the upper portion of the lower body 110. The mount 130 may be fastened to the lower body so as not to be separated. The mount 130 may be threadedly coupled to the lower body 110.

A rib groove 136 may be formed in the outer surface 132 of the mount 130. The rib groove 136 may have a shape such that the outer surface 132 of the mount 130 is depressed inwards. The rib groove 136 may have a shape that extends along the periphery of the outer surface 132 of the mount 130.

A body rib 116 may have a shape that projects from the inner circumferential surface of the side wall 111. The body rib 116 may have a shape that extends along the inner circumferential surface of the side wall 111 of the lower body 110. The body rib 116 may be made of an elastic material. The body rib 116 may be made of, for example, rubber, silicone, or the like. The body rib 116 may be inserted into or in close contact with the rib groove 136 in the mount 130. The body rib 116 may be in close contact with the rib groove 136 so as to stably hold the mount 130 at the normal position in the lower body 110 and to prevent the upper body 120 from shaking with respect to the lower body 110.

Referring to FIGS. 32 and 33, the column 140 may extend upwards from one side of the mount 130. The column 140 may surround a portion of the mount space 135. The column 140 may have an installation space 144 therein. The installation space 144 may have a shape that extends vertically along the column 140. The installation space 144 may be open toward the mount space 135. The installation space 144 may be surrounded by the inner wall 141, the outer wall 142, and the upper wall 143 of the column 140.

The column 140 may receive therein the PCB assembly 150, which has been mentioned above. The PCB assembly 150 may be mounted in the installation space 144. The installation space 144 may be referred to as an assembly reception space 144.

The PCB assembly 150 may include at least one of the PCB 151, the light source 153, the first sensor 155, and the second sensor 157. The PCB assembly 150 may extend vertically along the column 140. The PCB assembly 150 may be disposed in the column 140 in the direction in which the cartridge 200 is oriented. A connector 152 may be formed at one end of the PCB assembly 150 for electrical connection.

The PCB 151 may extend vertically along the column 140. The PCB 151 may be an FPCB (Flexible Printed Circuit Board). The connector 152 may be formed at one end of the PCB 151.

The light source 153 may be mounted on the PCB 151. The light source 153 may include at least one light source. The first sensor 155 may be mounted on the PCB 151. The light source 153, the first sensor 155, and the second sensor 157 may be mounted at different locations on the single PCB 151. The light source 153 may include a plurality of light sources, which are arranged on the PCB 151.

The first sensor 155 may be mounted below the light source 153. The first sensor 155 may be mounted above the second sensor 157. The first sensor 155 may be disposed so as to face the first chamber C1. The first sensor 155 may be disposed so as to face the insertion space 214. The second sensor 157 may face the mount space 135. Because the first sensor 155 is inclined upwards, the sensitivity of the first sensor 155 may be improved when the first sensor 155 is used to detect information about the stick 400.

The inner wall 141 of the column 140 may partition the internal space into the installation space 144 and the mount space 135. The inner wall 141 may cover one side of the installation space 144. The inner wall 141 may cover the PCB assembly 150. The inner wall 141 may be coupled to the column 140 by virtue of threaded engagement between a screw hole 146 in the installation space 144 and a screw. The inner wall 141 may be referred to as a column cover 141. The PCB assembly 150 may be coupled to the column cover 141. The first channel groove 141*a* may be formed by depression of the column cover 141 toward the installation space 144.

A first window 1531 may be formed in the column cover 141. The first window 1531 may cover or face the light source 153. The light emitted from the light source 153 may be transmitted through the first window 1531.

A second window 1551 may be formed in the column cover 141. The second window 1551 may be disposed below the first window 1531. The second window 1551 may be formed at the upper portion of the sensor reception portion 145. The second window 1551 may cover or face the first sensor 155. The second window 1551 may allow an electromagnetic wave to be transmitted therethrough.

Referring to FIGS. 34 to 36, the bottom 133 of the mount 130 may include a first bottom 1331 and a second bottom 1332. The first bottom 1331 may be disposed above the second bottom 1332 so as to cover the second bottom 1332. The first bottom 1331 may face the mount space 135. The first bottom 1331 may be disposed at the lower side of the mount space 135. The mount hole 134 may be formed through the first bottom 1331. The mount hole 134 may face the mount space 135. The first channel P1, which is defined by the first channel groove 141, may extend downwards beyond the first bottom 1331. The first channel P1 may extend to the second bottom 1332 from the upper wall 143 of the column 140. A pair of first channels P1 may be formed at two lateral sides based on the sensor reception portion 145.

The second channel P2 may be formed between the first bottom 1331 and the second bottom 1332. The second channel P2 may be formed by depression of at least one of the first bottom 1331 and the second bottom 1332. The second channel P2 may be formed by downward depression of the second bottom 1332. The first bottom 1331 may cover the second channel P2. One end of the second channel P1 and one end of the first channel P1 may be connected to each other. The second channel P2 and the first channel P1 may extend so as to intersect each other. The second channel P2 may connect the first channel P1 to the mount hole 134.

The second channel P2 may be divided into a first portion P21 of the second channel and a second portion P22 of the second channel. The first portion P21 of the second channel may be connected to the first channel P1. The first portion P21 of the second channel may include a plurality of first portions. A pair of first portions P21 of the second channel may be respectively connected to the pair of first channels P1. The pair of first portions P21 of the second channel may extend to surround the periphery of the lower end of the sensor reception portion 145. The pair of first portions P21 of the second channel may converge. The pair of first portions P21 of the second channel may converge at a position near the sensor reception portion 145.

The second portion P22 of the second channel may be connected to the mount hole 134. The second portion P22 of the second channel may be connected to the point at which the pair of first portions P21 of the second channel converge. The second portion P22 of the second channel may connect the first portions P21 of the second channel to the mount hole 134. The second portion P22 of the second channel may extend in one direction from the pair of first portions P21 of the second channel.

The third channel P3 may be connected to the second channel P2. The third channel P3 may connect the second channel P2 to the internal space in the column 140. The third channel P3 may be formed at a position that is opposed to the second portion P22 of the second channel based on the point at which the pair of first portions P21 of the second channel converge. The third channel P3 may extend to the inside of the sensor reception portion 145 from the point at which the first portions P21 of the second channel converge. The third channel P3 may extend through the lower end of the sensor reception portion 145.

A portion of the third channel P3 may be formed in the second bottom 1332. A portion of the third channel P3 may be formed by downward depression of the second bottom 1332. A portion of the third channel P3 may be connected to the point at which the pair of first portions P21 of the second channel converge. Another portion of the third channel P3 may extend toward the inside of the sensor reception portion 145 from the lower end of the sensor reception portion 145.

A channel seal 137 may be disposed between the first bottom 1331 and the second bottom 1332. The channel seal 137 may be made of an elastic material. The channel seal 137 may be made of rubber or silicone. The periphery of the channel seal 137 may have a shape corresponding to the periphery of the first bottom 1331. The periphery of the channel seal 137 may have a shape corresponding to the periphery of the second bottom 1332. The channel seal 137 may be in close contact with both the first bottom 1331 and the second bottom 1332.

The channel seal 137 may be open in a shape corresponding to the second channel P2 so as to form an opening 1374. The opening 1374 may be disposed above the second channel P2. The channel seal 137 may cover an area neighboring the second channel P2.

The periphery of the channel seal 137 may be in close contact with the inner surface 131 of the mount 130. A portion of the periphery of the channel seal 137 may be in close contact with the inner wall 141 of the column 140 and the sensor reception portion 145.

The channel seal 137 may seal the gap between the first bottom 1331 and the inner surface 131 of the mount 130. The channel seal 137 may seal the gap between the first bottom 1331 and the inner wall 141 of the column 140. The channel seal 137 may seal the gap between the first bottom 1331 and the sensor reception portion 145. The channel seal 137 may seal the gap between the second channel P2 and the first bottom 1331. The channel seal 137 may seal the gap between the second bottom 1332 and the inner surface 131 of the mount 130. The channel seal 137 may seal the gap between the second bottom 1332 and the inner wall 141 of the column 140. The channel seal 137 may seal the gap between the second bottom 1332 and the sensor reception portion 145. The channel seal 137 may cover a portion of the third channel P3 formed in the second bottom 1332.

A channel seal port 1373 may be formed at one side of the channel seal 137. The channel seal port 1373 may have a cylindrical shape. The channel seal port 1373 may project upwards. The channel seal port 1373 may be disposed above the second portion P22 of the second channel. The mount hole 134 may be formed in the channel seal port 1373. The channel seal port 1373 may extend through a first bottom hole 1343 formed in the first bottom 1331. The channel seal port 1373 may be in close contact with the first bottom 1331 around the first bottom hole 1343 and the mount hole 134.

Accordingly, when air flows through the channels P1, P2, and P3, the air may pass through the channels P1, P2, and P3 without leaking through the gaps between the assembled components.

The terminal hole 139*a* may be formed through the first bottom 1331. The terminal hole 139*a* may be formed through the second bottom 1332. The terminal hole 139*a* may be formed through the channel seal 137. The terminal hole 139*a* may include a pair of terminal holes formed through the first bottom 1331. The terminal hole 139*a* may include a pair of terminal holes formed through the second bottom 1332. The terminal hole 139*a* may include a pair of terminal holes formed through the channel seal 137. The terminal hole 139*a* may be positioned so as to avoid the second channel P2 and the third channel P3.

A first threaded hole 1338 may be formed through the second bottom 1332. The first threaded hole 1338 may be positioned so as to avoid the terminal hole 139*a*. The first threaded hole 1338 may include a plurality of first threaded holes. The first threaded holes 1338 may be positioned so as to avoid the second channel P2 and the third channel P3.

Referring to FIG. 37, a connecting terminal 139 may extend through the terminal holes 139*a*, and may be exposed from the first bottom 1331 upwards. The connecting terminal 139 may be in contact with the heater terminal 239 (see FIG. 4), and may connect the battery 190 or the controller (without a reference numeral) to the heater 247.

A second threaded hole 1335 may be formed in the first bottom 1331. The second threaded hole 1335 may be open in the downward direction of the first bottom 1331. A threaded portion may be formed on the inner circumferential surface of the second threaded hole 1335. The second threaded hole 1335 may be formed at a position corresponding to the first threaded hole 1338. A screw 138 may extend through the lower body 110 and the first threaded hole 1338. The screw 138 may be engaged with the second threaded hole 1335 through the first threaded hole 1338 so as to couple the mount 130 to the lower body 110.

Referring to FIGS. 38 and 39, the cartridge 200 may be inserted into the mount space 135. The mount 130 may surround and support the third part 230 of the cartridge 200 inserted into the mount space 135. The bottom 1331 of the mount 130 may support the bottom 232 of the third part 230. The cartridge inlet port 2343 may be inserted into the mount hole 134. The cartridge inlet port 2343 may be in close contact with the channel seal port 1373. The cartridge inlet port 234 may communicate with the mount hole 134.

The third channel P3 may connect the second channel P2 to the internal space in the column 140. The third channel P3 may be connected to the second sensor 157. The second sensor 157 may face the third channel P3. The second sensor 157 may detect the flow of air flowing through the third channel P3.

The second sensor 157 may be disposed above the second channel P2. The third channel P3 may include a portion that extends toward the second sensor 157 from the second channel P2. The second sensor 157 may be located upstream of the mount hole 134.

Accordingly, it is possible to prevent the liquid generated in the second chamber C2 or the liquid leaking from the second chamber C2 from accumulating at the second sensor 157 and to prevent malfunction of the second sensor 157.

Referring to FIGS. 39 and 40, when a user inhales air while holding the stick in his/her mouth, the air may be introduced into the aerosol-generating device. External air may pass through the gap between the insertion opening wall 305 of the cap 300 and the stick 400, and may be introduced into the aerosol-generating device. The air that has been introduced into the aerosol-generating device may sequentially pass through the first channel P1 and the second channel P2, and may be introduced into the cartridge 200 through the mount hole 134 and the cartridge inlet 234. The air that has been introduced into the cartridge 200 may be introduced into the second chamber C2 through the chamber inlet 2414. The air that has been introduced into the second chamber C2 may pass through the connecting hole 2424 in conjunction with the aerosol generated in the second chamber C2, and may be supplied to the stick 400 in the insertion space 214, thereby being transmitted to the user. When the air flows through the second channel P2, the second sensor 157 may detect the flow of air in the third channel P3 connected to the second channel P2.

Referring to FIG. 41, the aforementioned stick 400 may include a medium portion 410. The stick 400 may include a cooling portion 420. The stick 400 may include a filter portion 430. The cooling portion 420 may be disposed between the medium portion 410 and the filter portion 430. The stick 400 may include a wrapper 440. The wrapper 440 may wrap the medium portion 410. The wrapper 440 may wrap the cooling portion 420. The wrapper 440 may wrap the filter portion 430. The stick 400 may have a cylindrical shape.

The medium portion 410 may include a medium 411. The medium portion 410 may include a first medium cover 413. The medium portion 410 may include a second medium cover 415. The medium 411 may be disposed between the first medium cover 413 and the second medium cover 415. The first medium cover 413 may be disposed at one end of the stick 400. The medium portion 410 may have a length of 24 mm.

The medium 411 may contain a multicomponent substance. The substance contained in the medium may be a multicomponent flavoring substance. The medium 411 may be composed of a plurality of granules. Each of the plurality of granules may have a size of 0.4 mm to 1.12 mm. The granules may account for approximately 70% of the volume of the medium 411. The length L2 of the medium 411 may be 10 mm. The first medium cover 413 may be made of an acetate material. The second medium cover 415 may be made of an acetate material. The first medium cover 413 may be made of a paper material. The second medium cover 415 may be made of a paper material. At least one of the first medium cover 413 or the second medium cover 415 may be made of a paper material, and may be crumpled so as to be wrinkled, and a plurality of gaps may be formed between the wrinkles so that air flows therethrough. Each of the gaps may be smaller than each of the granules of the medium 411. The length L1 of the first medium cover 413 may be shorter than the length L2 of the medium 411. The length L3 of the second medium cover 115 may be shorter than the length L2 of the medium 411. The length L1 of the first medium cover 413 may be 7 mm. The length L2 of the second medium cover 115 may be 7 mm.

Accordingly, each of the granules of the medium 411 may be prevented from being separated from the medium portion 410 and the stick 400.

The cooling portion 420 may have a cylindrical shape. The cooling portion 420 may have a hollow shape. The cooling portion 420 may be disposed between the medium portion 410 and the filter portion 430. The cooling portion 420 may be disposed between the second medium cover 415 and the filter portion 430. The cooling portion 420 may be formed in the shape of a tube that surrounds a cooling path 424 formed therein. The cooling portion 420 may be thicker than the wrapper 440. The cooling portion 420 may be made of a paper material thicker than that of the wrapper 440. The length L4 of the cooling portion 420 may be equal or similar to the length L2 of the medium 411. The length L4 of each of the cooling portion 420 and the cooling path 424 may be 10 mm. When the stick 400 is inserted into the aerosol-generating device (refer to FIG. 3), at least part of the cooling portion 420 may be exposed to the outside of the aerosol-generating device.

Accordingly, the cooling portion 420 may support the medium portion 410 and the filter portion 430, and may secure the rigidity of the stick 400. In addition, the cooling portion 420 may support the wrapper 440 between the medium portion 410 and the filter portion 430, and may provide a portion to which the wrapper 440 is adhered. In addition, the heated air and aerosol may be cooled while passing through the cooling path 424 in the cooling portion 420.

The filter portion 430 may be composed of a filter made of an acetate material. The filter portion 430 may be disposed at the other end of the stick 400. When the stick 400 is inserted into the aerosol-generating device (refer to FIG. 3), the filter portion 430 may be exposed to the outside of the aerosol-generating device. The user may inhale air in the state of holding the filter portion 430 in the mouth. The length L5 of the filter portion 430 may be 14 mm.

The wrapper 440 may wrap or surround the medium portion 410, the cooling portion 420, and the filter portion 430. The wrapper 440 may form the external appearance of the stick 400. The wrapper 440 may be made of a paper material. An adhesive portion 441 may be formed along one edge of the wrapper 440. The wrapper 440 may surround the medium portion 410, the cooling portion 420, and the filter portion 430, and the adhesive portion 441 formed along one edge of the wrapper 440 and the other edge thereof may be adhered to each other. The wrapper 440 may surround the medium portion 410, the cooling portion 420, and the filter portion 430, but may not cover one end or the other end of the stick 400.

Accordingly, the wrapper 440 may fix the medium portion 410, the cooling portion 420, and the filter portion 430, and may prevent these components from being separated from the stick 400.

A first thin film 443 may be disposed at a position corresponding to the first medium cover 413. The first thin film 443 may be disposed between the wrapper 440 and the first medium cover 413, or may be disposed outside the wrapper 440. The first thin film 443 may surround the first medium cover 413. The first thin film 443 may be made of a metal material. The first thin film 443 may be made of an aluminum material. The first thin film 443 may be in close contact with the wrapper 440, or may be coated thereon.

A second thin film 445 may be disposed at a position corresponding to the second medium cover 415. The second thin film 445 may be disposed between the wrapper 440 and the second medium cover 415, or may be disposed outside the wrapper 440. The second thin film 445 may be made of a metal material. The second thin film 445 may be made of an aluminum material. The second thin film 445 may be in close contact with the wrapper 440, or may be coated thereon.

Accordingly, when a sensor configured to detect a stick is provided in the aerosol-generating device, it is possible to detect whether or not a stick 400 is inserted into the aerosol-generating device. Furthermore, when the sensor is a capacitance sensor, the capacitance sensor may detect whether or not a stick 400 is inserted into the aerosol-generating device based on variation in electromagnetic characteristics caused by insertion of the stick 400.

Referring to FIGS. 1 to 41, a cartridge 200 according to one aspect of the present disclosure include a pipe 211 defining an insertion space 214 having an opening toward an outside of the cartridge 200, a first chamber C1 configured to store a liquid and positioned outside of the pipe, a second chamber C2 in communication with the insertion space 214, an upper frame 242 disposed between the pipe 211 and the second chamber C2 and a connecting hole 2424 allowing communication between the second chamber C2 and the insertion space 214, a lower frame 241 disposed below the upper frame and configured to define the second chamber C2 together with the upper frame 242, a wick 246 provided in the second chamber C2 and configured to be in communication with the first chamber C1 through an opening between the upper frame 242 and the lower frame 241, and a heater 247 configured to heat the wick 246, wherein securing the pipe 211 applies pressure to the upper frame 242 toward the lower frame 241.

In addition, according to another aspect of the present disclosure, the cartridge 200 may further include a first part 210 including the pipe 211 and a first part head 213 extending outwards from an upper end of the pipe 211 to cover an upper portion of the first chamber C1, a third part 230 in which the lower frame 241 is accommodated, the third part 230 supporting the lower frame 241 and forming a lower portion of the first chamber C1, and a second part 220 defining a space into which the pipe 211 is inserted, the second part 220 supporting the first part 210 and the third part 230 and defining a portion of the first chamber C1.

In addition, according to another aspect of the present disclosure, the cartridge 200 may include a first rim groove 218 formed along a periphery of the first part head 213, a first rim 227 projecting upwards from an upper end of the second part 220 and configured to be inserted into the first rim groove 218, a second rim groove 228 formed along a periphery of a lower end of the second part 220, and a second rim 237 projecting upwards from an upper end of the third part 230 and configured to inserted into the second rim groove 228.

In addition, according to another aspect of the present disclosure, the cartridge may further include a support wall 233 projecting from a bottom of the third part 230 to define a space in which the lower frame 241 is accommodated, wherein the support wall separates the space from the first chamber and is configured to surround a side portion of the lower frame 241.

In addition, according to another aspect of the present disclosure, the support wall 233 may be configured to provide support to a support 250 covering the upper frame 242, wherein the support is configured to support the pipe 211 and the upper frame 242, the wick 246 may extend between the support wall 233 and the support 250 and may be configured to be in communication with the first chamber C1, and the pipe 211 may press the support 250 toward the upper frame 242 and the lower frame 241.

In addition, according to another aspect of the present disclosure, the cartridge may further include a support 250 covering the upper frame 242 and configured to support the pipe.

In addition, according to another aspect of the present disclosure, the upper frame 242 may include a frame port 2423 extending vertically and defining the connecting hole 2424, and the support 250 may include a support port 253 extending vertically and configured to surround an outer circumferential surface of the frame port 2423, wherein an inner circumferential surface of the pipe 211 is configured to be secured to the support port.

In addition, according to another aspect of the present disclosure, the pipe 211 may include an engagement portion 2112 projecting inwardly at an inner circumferential surface thereof toward the insertion space 214 and configured to be supported by an upper end of the support port 253.

In addition, according to another aspect of the present disclosure, the engagement portion 2112 may extend along the inner circumferential surface of the pipe. 211

In addition, according to another aspect of the present disclosure, the cartridge may further include a gasket 260 disposed between the pipe 211 and the support 250.

In addition, according to another aspect of the present disclosure, the upper frame 242 may include a frame port 2423 extending vertically and defining the connecting hole 2424, the support 250 may include a support port 253 extending vertically and configured to surround an outer circumferential surface of the frame port 2423, wherein an inner circumferential surface of the pipe 211 is configured to be secured to the support port, and the gasket 260 may is disposed along an outer circumferential surface of the support port 253 at a lower end of the support port 253.

In addition, according to another aspect of the present disclosure, the gasket 260 may be made of an elastic material.

In addition, according to another aspect of the present disclosure, at least one of the lower frame 241 or the upper frame 242 may be made of an elastic material.

In addition, according to another aspect of the present disclosure, the cartridge may further include a positioning groove 2418 formed at the lower frame 241 and configured to engage with a corresponding positioning protrusion 238 of the third part to secure the lower frame.

In addition, according to another aspect of the present disclosure, the lower frame 241 may include a chamber inlet port 2413 projecting upwards from a bottom of the second chamber C2 and defining a chamber inlet 2414.

In addition, according to another aspect of the present disclosure, a position of the chamber inlet 2414 may be misaligned with a center of the wick 246.

In addition, according to another aspect of the present disclosure, an upper end of the pipe 211 may include a guide 217 angled inwardly toward a lower end of the insertion space 214.

In addition, according to another aspect of the present disclosure, an aerosol-generating device includes the cartridge 200, and a body 100 to which the cartridge 200 is coupled.

Certain embodiments or other embodiments of the disclosure described above are not mutually exclusive or distinct from each other. Any or all elements of the embodiments of the disclosure described above may be combined with another or combined with each other in configuration or function.

For example, a configuration "A" described in one embodiment of the disclosure and the drawings and a configuration "B" described in another embodiment of the disclosure and the drawings may be combined with each other. Namely, although the combination between the configurations is not directly described, the combination is possible except in the case where it is described that the combination is impossible.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A cartridge comprising:

a pipe defining an insertion space having an opening toward an outside of the cartridge;

a first chamber configured to store a liquid and positioned outside of the pipe;

a second chamber in communication with the insertion space;

an upper frame disposed between the pipe and the second chamber and comprising a connecting hole allowing communication between the second chamber and the insertion space;

a lower frame disposed below the upper frame and configured to define the second chamber together with the upper frame;

a wick provided in the second chamber and configured to be in communication with the first chamber through an opening between the upper frame and the lower frame; and a heater configured to heat the wick, wherein securing the pipe applies pressure to the upper frame toward the lower frame.

2. The cartridge according to claim 1 further comprising:

a first part comprising the pipe and a first part head extending outwards from an upper end of the pipe to cover an upper portion of the first chamber;

a third part in which the lower frame is accommodated, the third part supporting the lower frame and forming a lower portion of the first chamber; and a second part defining a space into which the pipe is inserted, the second part supporting the first part and the third part and defining a portion of the first chamber.

3. The cartridge according to claim 2, further comprising:

a first rim groove formed along a periphery of the first part head;

a first rim projecting upwards from an upper end of the second part and configured to be inserted into the first rim groove;

a second rim groove formed along a periphery of a lower end of the second part; and a second rim projecting upwards from an upper end of the third part and configured to be inserted into the second rim groove.

4. The cartridge according to claim 2, further comprising a support wall projecting from a bottom of the third part to define a space in which the lower frame is accommodated, wherein the support wall separates the space from the first chamber and is configured to surround a side portion of the lower frame.

5. The cartridge according to claim 4, wherein the support wall is configured to provide support to a support covering the upper frame, wherein the support is configured to support the pipe and the upper frame, wherein the wick extends between the support wall and the support and is configured to be in communication with the first chamber, and wherein the pipe presses the support toward the upper frame and the lower frame.

6. The cartridge according to claim 2, further comprising:

a positioning groove formed at the lower frame and configured to engage with a corresponding positioning protrusion of the third part to secure the lower frame.

7. The cartridge according to claim 1, further comprising a support covering the upper frame and configured to support the pipe.

8. The cartridge according to claim 7, wherein the upper frame comprises a frame port extending vertically and defining the connecting hole, and wherein the support comprises a support port extending vertically and configured to surround an outer circumferential surface of the frame port, wherein an inner circumferential surface of the pipe is configured to be secured to the support port.

9. The cartridge according to claim 8, wherein the pipe comprises an engagement portion projecting inwardly at an inner circumferential surface thereof toward the insertion space and configured to be supported by an upper end of the support port.

10. The cartridge according to claim 9, wherein the engagement portion extends along the inner circumferential surface of the pipe.

11. The cartridge according to claim 7, further comprising a gasket disposed between the pipe and the support.

12. The cartridge according to claim 11, wherein the upper frame comprises a frame port extending vertically and defining the connecting hole, wherein the support comprises a support port extending vertically and configured to surround an outer circumferential surface of the frame port, wherein an inner circumferential surface of the pipe is configured to be secured to the support port, and wherein the gasket is disposed along an outer circumferential surface of the support port at a lower end of the support port.

13. The cartridge according to claim 11, wherein the gasket is made of an elastic material.

14. The cartridge according to claim 1, wherein at least one of the lower frame or the upper frame is made of an elastic material.

15. The cartridge according to claim 1, wherein the lower frame comprises:

a chamber inlet port projecting upwards from a bottom of the second chamber and defining a chamber inlet.

16. The cartridge according to claim 15, wherein a position of the chamber inlet is misaligned with a center of the wick.

17. The cartridge according to claim 1, wherein an upper end of the pipe comprises a guide portion angled inwardly toward a lower end of the insertion space.

18. An aerosol-generating device comprising:

the cartridge according to claim 1; and a body to which the cartridge is coupled.

* * * * *